US011759082B2

(12) United States Patent
Morimoto et al.

(10) Patent No.: US 11,759,082 B2
(45) Date of Patent: Sep. 19, 2023

(54) CLEANING MACHINE

(71) Applicant: MAKITA CORPORATION, Anjo (JP)

(72) Inventors: Kenta Morimoto, Anjo (JP); Takuo Arakawa, Anjo (JP)

(73) Assignee: MAKITA CORPORATION, Anjo (JP)

( * ) Notice: Subject to any disclaimer, the term of this patent is extended or adjusted under 35 U.S.C. 154(b) by 0 days.

(21) Appl. No.: 17/691,287

(22) Filed: Mar. 10, 2022

(65) Prior Publication Data

US 2022/0322909 A1 Oct. 13, 2022

(30) Foreign Application Priority Data

Mar. 30, 2021 (JP) ..... 2021-058585

(51) Int. Cl.
*A47L 11/40* (2006.01)
*A47L 9/04* (2006.01)
(Continued)

(52) U.S. Cl.
CPC ..... *A47L 11/4058* (2013.01); *A46B 13/001* (2013.01); *A46B 13/02* (2013.01);
(Continued)

(58) Field of Classification Search
CPC ..... A47L 11/22; A47L 11/24; A47L 11/26; A47L 11/28; A47L 11/282; A47L 11/283;
(Continued)

(56) References Cited

U.S. PATENT DOCUMENTS 1,464,031 A * 8/1923 Daly ..... A47L 11/292 15/50.3
2,268,059 A * 12/1941 Parker ..... A47L 11/4041 15/83
(Continued)

FOREIGN PATENT DOCUMENTS

BE 100465 A3 * 9/1992 ..... A47L 11/282
DE 102014006392 A1 * 11/2015 ..... E01H 1/056
(Continued)

OTHER PUBLICATIONS

JP-2020090875-A translation from Espacenet (Year: 2023).*
(Continued)

*Primary Examiner* — Brian D Keller
*Assistant Examiner* — Tim Brady
(74) *Attorney, Agent, or Firm* — Oliff PLC

(57) ABSTRACT

A cleaning machine may include: a first brush comprising a first brush shaft extending in a left-right direction and a first brush body held by the first brush shaft; a second brush comprising a second brush shaft extending in the left-right direction and a second brush body held on the second brush shaft; a brush supporting member supporting each of the first brush and the second brush such that the first brush and the second brush are rotatable; a body supporting the brush supporting member such that the brush supporting member is pivotable; and a pivot mechanism configured to pivot the brush supporting member with respect to the body. At least the first brush may move with respect to the body in an
(Continued)

up-down direction when the brush supporting member pivots with respect to the body.

17 Claims, 37 Drawing Sheets

(51) Int. Cl.

| | |
|---|---|
| ***A47L 11/24*** | (2006.01) |
| ***A46B 13/00*** | (2006.01) |
| ***A46B 13/02*** | (2006.01) |
| ***A47L 9/00*** | (2006.01) |
| ***A47L 9/32*** | (2006.01) |

(52) U.S. Cl.
CPC ..... *A47L 9/009* (2013.01); *A47L 9/0411* (2013.01); *A47L 9/0472* (2013.01); *A47L 9/0477* (2013.01); *A47L 9/0488* (2013.01); *A47L 9/0494* (2013.01); *A47L 9/325* (2013.01); *A47L 11/24* (2013.01); *A47L 11/4038* (2013.01); *A47L 11/4041* (2013.01); *A47L 11/4069* (2013.01); *A47L 11/4072* (2013.01); *A47L 11/4075* (2013.01); *A46B 2200/3033* (2013.01)

(58) Field of Classification Search
CPC ..... A47L 11/284; A47L 11/4052; A47L 11/4055; A47L 11/4058; A47L 11/4072; A47L 11/4075; A47L 9/009; A47L 9/0411; A47L 9/0472; A47L 9/0477; A47L 9/0488; A47L 9/0494; A47L 9/325
USPC ..... 15/52.1
See application file for complete search history.

(56) References Cited

U.S. PATENT DOCUMENTS

| | | | | | |
|---|---|---|---|---|---|
| 2,683,885 | A * | 7/1954 | Johnson | A47L 11/292 | 222/274 |
| 3,201,819 | A * | 8/1965 | Wilgus | A47L 11/4058 | 15/349 |
| 4,071,920 | A * | 2/1978 | Block | E01H 1/047 | 15/52.1 |
| 4,366,593 | A * | 1/1983 | Parikh | A47L 11/22 | 15/49.1 |
| 4,658,458 | A * | 4/1987 | Berfield | A47L 11/4055 | 15/52.1 |
| 5,884,353 | A * | 3/1999 | Berg | A47L 11/33 | 15/83 |
| 6,450,867 | B1 * | 9/2002 | Legatt | A47L 11/4061 | 451/353 |
| 2002/0124334 | A1 * | 9/2002 | Worwag | A47L 9/0494 | 15/384 |
| 2006/0195992 | A1 * | 9/2006 | Scremin | E01H 1/0854 | 15/79.1 |
| 2021/0085148 | A1 * | 3/2021 | Hopkins | A47L 11/4047 | |

FOREIGN PATENT DOCUMENTS

| | | | |
|---|---|---|---|
| DE | 10 2016 108 540 | A1 | 11/2017 |
| JP | 2002-088727 | A | 3/2002 |
| JP | 6638055 | B1 * | 1/2020 |
| JP | 2020090875 | A * | 6/2020 |

OTHER PUBLICATIONS

JP-6638055-B1 translation from Espacenet (Year: 2023).*
DE-102014006392-A1 translation from Espacenet (Year: 2023).*
BE-100465-A3 translation from Espacenet (Year: 2023).*

* cited by examiner

UP
FRONT
REAR
DOWN
Direction of Gravity
2
4
6
8
8a
8b
12
13
13c
13d
13e
13f
13g
14
18
20
22
24
24a
24b
28
28a
28b
64
108
108d
112
114
114a
114b
114c
114d
118
124
124h
124i
126a
126b
128
130
130a
130b
132
132a
132b
138
140
198
200
202
204
206
208
240
264
264a
264b
266

CLEANING MACHINE

CROSS-REFERENCE TO RELATED APPLICATION

This application claims priority to Japanese Patent Application No. 2021-58585 filed on Mar. 30, 2021, the entire contents of which are hereby incorporated by reference into the present application.

TECHNICAL FIELD

This disclosure herein relates to a cleaning machine.

BACKGROUND

A cleaning machine described in Japanese Patent Application Publication No. 2002-88727 includes a brush including a brush shaft extending in a left-right direction and a brush body held by the brush shaft; a brush supporting member supporting the brush such that the brush is rotatable; a body supporting the brush supporting member such that the brush supporting member is pivotable; and a pivot mechanism configured to pivot the brush supporting member with respect to the body. In the cleaning machine, the brush moves in an up-down direction with respect to the body when the brush supporting member pivots with respect to the body.

SUMMARY

There are cleaning machines that include a plurality of brushes such as the one described above and clean a working plane by rotating the brushes. In such cleaning machines including a plurality of brushes, the distance between the brushes may change when the brushes are individually moved in the up-down direction, which may affect the cleaning performance. The disclosure herein provides a technique that moves brushes in an up-down direction in a cleaning machine including the brushes without changing the distance between the brushes.

A cleaning machine disclosed herein may comprise a first brush comprising a first brush shaft extending in a left-right direction and a first brush body held by the first brush shaft, a second brush comprising a second brush shaft extending in the left-right direction and a second brush body held by the second brush shaft, a brush supporting member supporting each of the first brush and the second brush such that the first brush and the second brush are rotatable, a body supporting the brush supporting member such that the brush supporting member is pivotable, and a pivot mechanism configured to pivot the brush supporting member with respect to the body. At least the first brush may move in an up-down direction with respect to the body when the brush supporting member pivots with respect to the body.

According to the configuration above, at least the first brush can be moved in the up-down direction without changing the distance between the first brush and the second brush.

DETAILED DESCRIPTION

Figure 1:
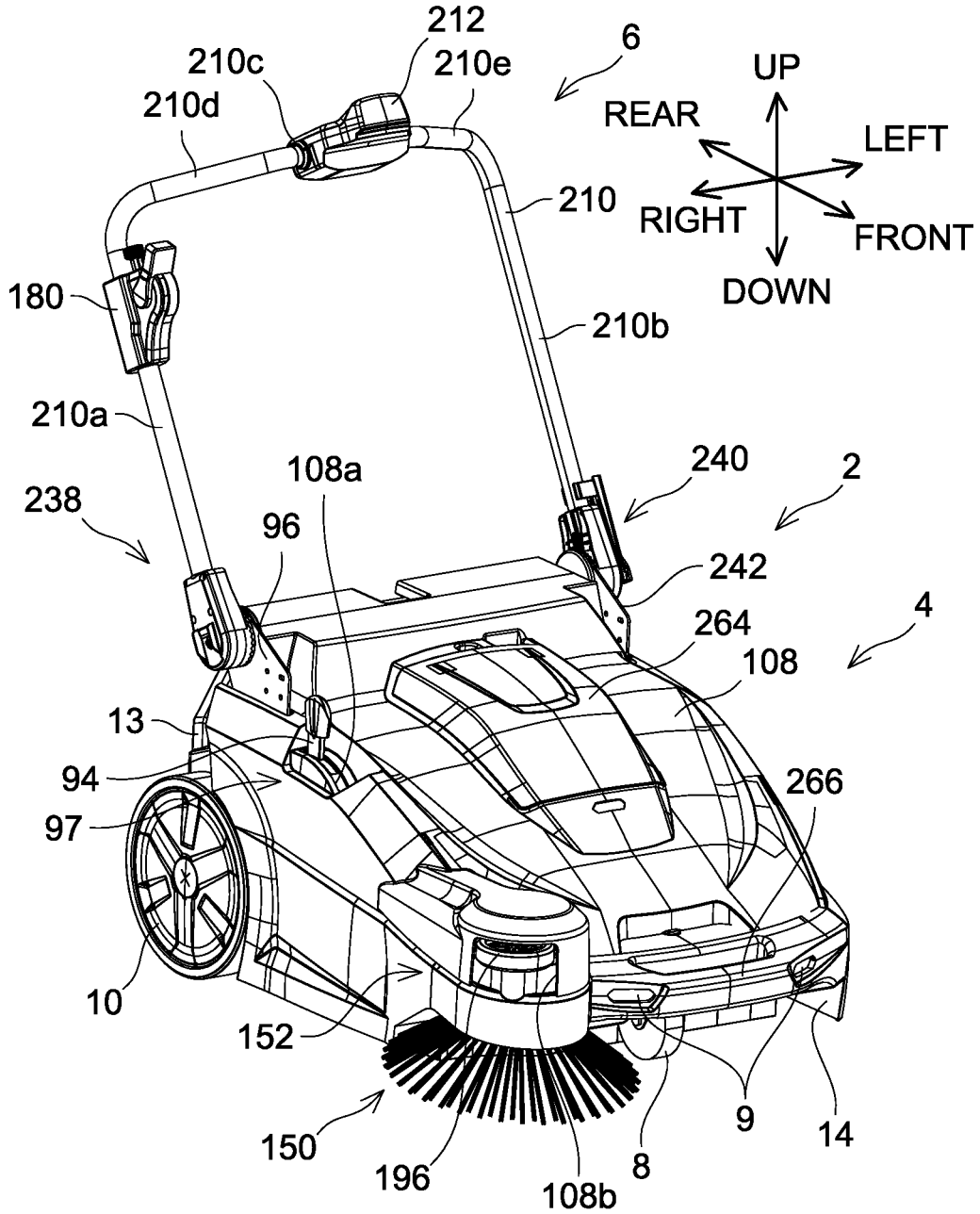
FIG. 1 is a perspective view of a cleaning machine 2 according to an embodiment, as viewed from the upper right front side.

Representative, non-limiting examples of the present disclosure will now be described in further detail with reference to the attached drawings. This detailed description is merely intended to teach a person of skill in the art further details for practicing preferred aspects of the present teachings and is not intended to limit the scope of the present disclosure. Furthermore, each of the additional features and teachings disclosed below may be utilized separately or in conjunction with other features and teachings to provide improved cleaning machines, as well as methods for using and manufacturing the same.

Moreover, combinations of features and steps disclosed in the following detailed description may not be necessary to practice the present disclosure in the broadest sense, and are instead taught merely to particularly describe representative examples of the present disclosure.

Furthermore, various features of the above-described and below-described representative examples, as well as the various independent and dependent claims, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

In one or more embodiments, a cleaning machine may comprise a first brush comprising a first brush shaft extending in a left-right direction and a first brush body held by the first brush shaft, a second brush comprising a second brush shaft extending in the left-right direction and a second brush body held by the second brush shaft, a brush supporting member supporting each of the first brush and the second brush such that the first brush and the second brush are rotatable, a body supporting the brush supporting member such that the brush supporting member is pivotable, and a pivot mechanism configured to pivot the brush supporting member with respect to the body. At least the first brush may move in an up-down direction with respect to the body when the brush supporting member pivots with respect to the body.

According to the configuration above, at least the first brush can be moved in the up-down direction without changing the distance between the first brush and the second brush.

In one or more embodiments, the first brush and the second brush may be arranged along a front-rear direction.

According to the configuration above, in the cleaning machine in which the first brush and the second brush are arranged along the front-rear direction, at least the first brush can be moved in the up-down direction without changing the distance between the first brush and the second brush.

In one or more embodiments, a pivot axis of the brush supporting member and a rotation axis of the second brush may be substantially coaxial.

According to the configuration above, the first brush can be moved in the up-down direction without moving the second brush in the up-down direction.

In one or more embodiments, the brush supporting member may comprise a first brush supporting member supporting one end of the first brush and one end of the second brush such that the first brush and the second brush are rotatable; and a second brush supporting member supporting other end of the first brush and other end of the second brush such that the first brush and the second brush are rotatable.

According to the configuration above, each of the first brush and the second brush can be rotatably supported at its opposing ends. The first brush and the second brush can be supported stably.

In one or more embodiments, the brush supporting member may further comprise a coupling member that couples the first brush supporting member with the second brush supporting member.

According to the configuration above, it is possible to make a pivot angle of the first brush supporting member with respect to the body substantially equal to a pivot angle of the second brush supporting member with respect to the body. At least the first brush can be moved stably in the up-down direction.

In one or more embodiments, the pivot mechanism may be configured to pivot the first brush supporting member with respect to the body.

According to the configuration above, the first brush supporting member and the second brush supporting member can be pivoted with respect to the body by using the pivot mechanism with a simple configuration.

In one or more embodiments, the cleaning machine may further comprise a motor for rotating the first brush and the second brush. The motor may be supported by the brush supporting member.

According to the configuration above, positional relationships between the first brush and the motor and between the second brush and the motor do not change even when the brush supporting member is pivoted with respect to the body, which allows for simplification in a mechanism for transmitting rotation from the motor to the first brush and a mechanism for transmitting rotation from the motor to the second brush.

In one or more embodiments, the cleaning machine may further comprise a brush operation member coupled to the pivot mechanism and configured to receive an operation related to a movement of at least the first brush in the up-down direction from a user.

According to the configuration above, the user can cause at least the first brush to move in the up-down direction by operating the brush operation member.

In one or more embodiments, the brush operation member may be disposed closer to the user than the first brush and the second brush are when viewed from the user.

According to the configuration above, the user can operate the brush operation member more easily.

In one or more embodiments, the brush operation member may comprise a lever supporting member and an operation lever pivotably supported by the lever supporting member.

According to the configuration above, the user can cause at least the first brush to move in the up-down direction simply by pivoting the operation lever.

In one or more embodiments, the body may comprise a housing. The operation lever may project to outside through an opening of the housing. The cleaning machine may further comprise a shutter member attached to the operation lever inside the housing and configured to cover the opening of the housing.

According to the configuration above, it is possible to prevent the user from seeing the inside of the body through the opening of the housing. Further, it is possible to prevent entry of foreign matters into the body through the opening of the housing.

In one or more embodiments, the brush operation member may further comprise an engagement portion disposed on the operation lever and a plurality of engageable portions disposed on the lever supporting member and configured to engage with the engagement portion.

According to the configuration above, a pivot angle of the operation lever with respect to the lever supporting member can be changed among multiple different angles, and thus the position of at least the first brush in the up-down direction with respect to the body can be changed among multiple different positions.

In one or more embodiments, the first brush may move downward with respect to the body when the user tilts the operation lever. The first brush may move upward with respect to the body when the user raises the operation lever.

According to the configuration above, the user can intuitively understand how at least the first brush moves in the up-down direction in response to the operation on the operation lever.

In one or more embodiments, the body may comprise a wheel and a chassis supported by the wheel.

According to the configuration above, at least the first brush can be moved in the up-down direction without changing the distance between the first brush and the second brush in the cleaning machine configured to clean the working plane positioned below the cleaning machine.

In one or more embodiments, the cleaning machine may further comprise a handle extending rearward and upward from the chassis and configured to be gripped by a user.

According to the configuration above, at least the first brush can be moved in the up-down direction without changing the distance between the first brush and the second brush in the cleaning machine operated by the user gripping the handle.

(Embodiment)

Figure 2:
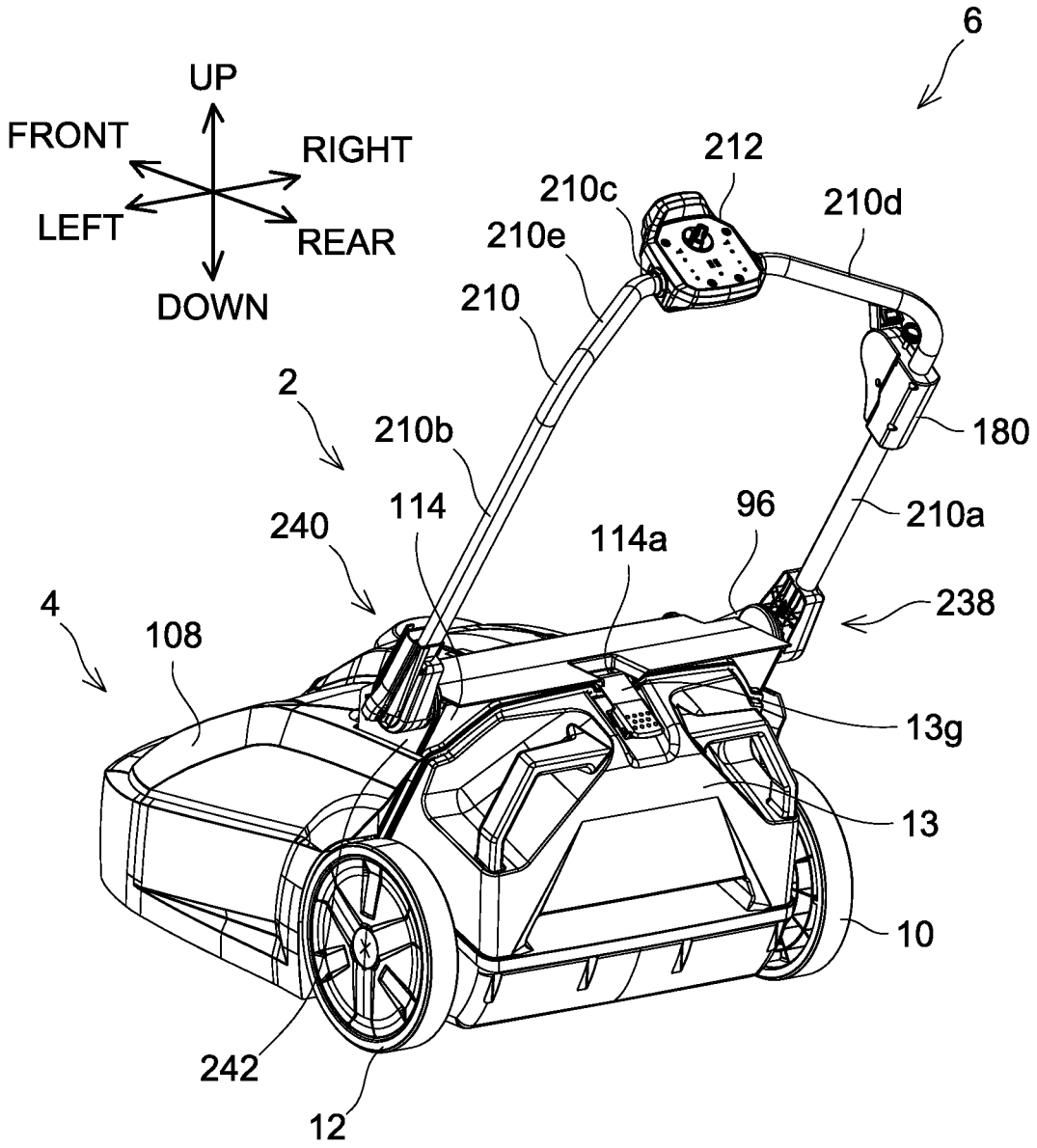
FIG. 2 is a perspective view of the cleaning machine 2 according to the embodiment, as viewed from the upper left rear side.

As illustrated in FIG. 1, a cleaning machine 2 comprises a body unit 4 and a handle unit 6. The body unit 4 comprises a front wheel 8 that contacts a working plane at the center of a front portion of the body unit 4 in a left-right direction, a right rear wheel 10 that contacts the working plane at a right rear portion of the body unit 4, and a left rear wheel 12 (see FIG. 2) that contacts the working plane at a left rear portion of the body unit 4. As illustrated in FIG. 2, a dust container 13 is detachably attached to a rear portion of the body unit 4. The handle unit 6 is connected to an upper rear portion of the body unit 4. When a user stands behind the cleaning machine 2 and pushes it forward with his/her both hands gripping an upper portion of the handle unit 6, the front wheel 8, the right rear wheel 10, and the left rear wheel 12 rotate and the body unit 4 moves forward along the working plane. As illustrated in FIG. 1, a headlight 9 configured to illuminate an area ahead of the body unit 4 is disposed at a front end of the body unit 4.

Figure 3:
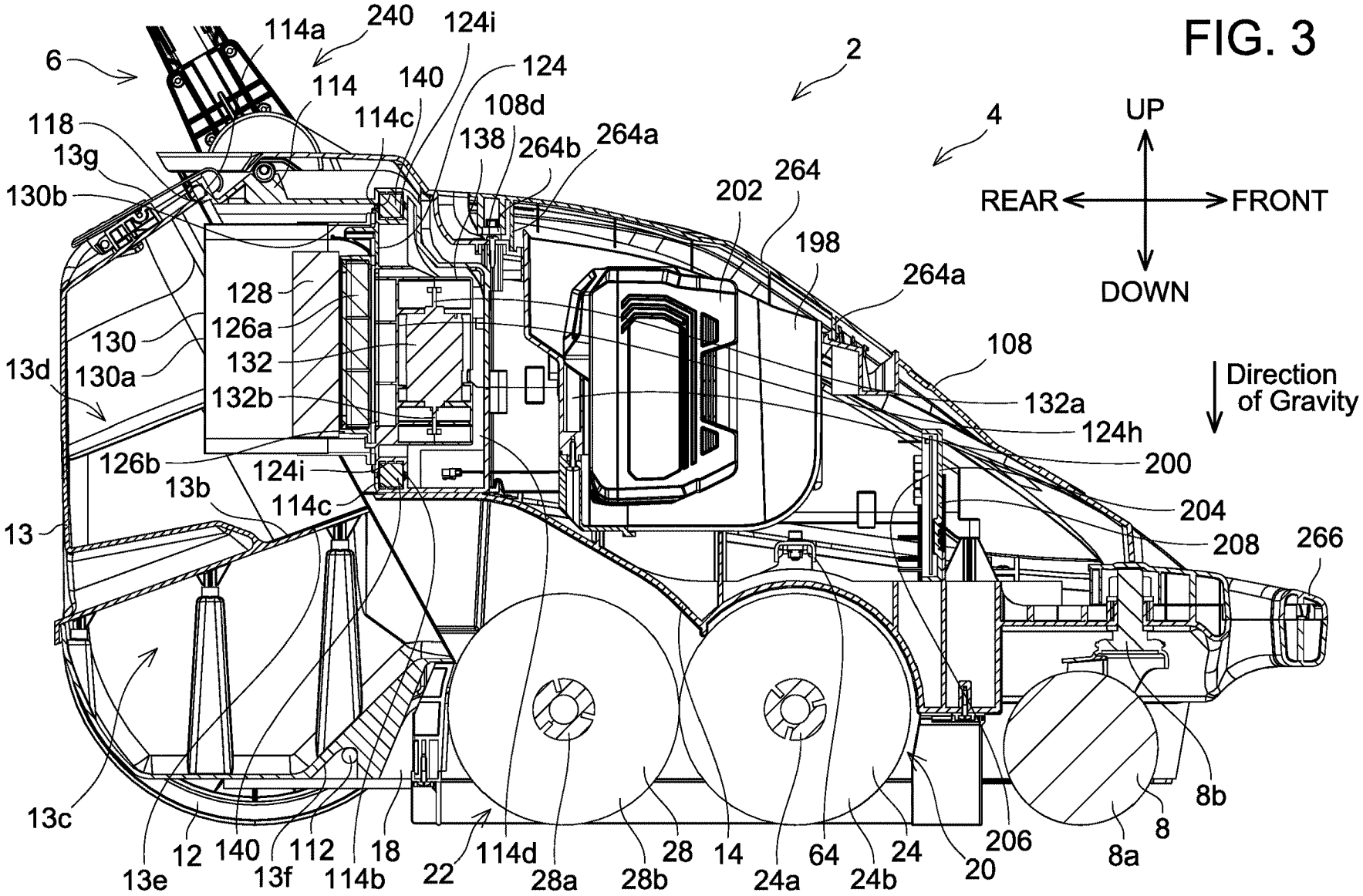
FIG. 3 is a longitudinal cross-sectional view of the cleaning machine 2 according to the embodiment, in the vicinity of its center in a left-right direction.

As illustrated in FIG. 3, the body unit 4 comprises a chassis 14 supporting the front wheel 8, the right rear wheel 10, and the left rear wheel 12. The front wheel 8 is a so-called swivel caster, in which a wheel 8*a* is supported by a support 8*b* such that it is rotatable about a rotation axis extending in the left-right direction and the support 8*b* is supported by the chassis 14 such that it is pivotable about a pivot axis extending in an up-down direction. The right rear wheel 10 is supported by a right rear wheel plate 16 (see FIG. 6) fixed to the chassis 14 such that it is rotatable about a rotation axis extending in the left-right direction. The left rear wheel 12 is supported by a left rear wheel plate 18 fixed to the chassis 14 such that it is rotatable about a rotation axis extending in the right-rear direction. The rotation axis of the right rear wheel 10 and the rotation axis of the left rear wheel 12 are arranged coaxially.

(Front Main Brush 20 and Rear Main Brush 22)

A front main brush 20 and a rear main brush 22 are arranged along a front-rear direction below the chassis 14. In the cleaning machine 2, the front main brush 20 rotates in a direction that brings its lower end rearward and the rear main brush 22 rotates in a direction that brings its lower end forward, thereby raking up trash on the working plane. The front main brush 20 and the rear main brush 22 are attached to a main brush unit 23 (see FIG. 9) of the body unit 4.

Figure 4:
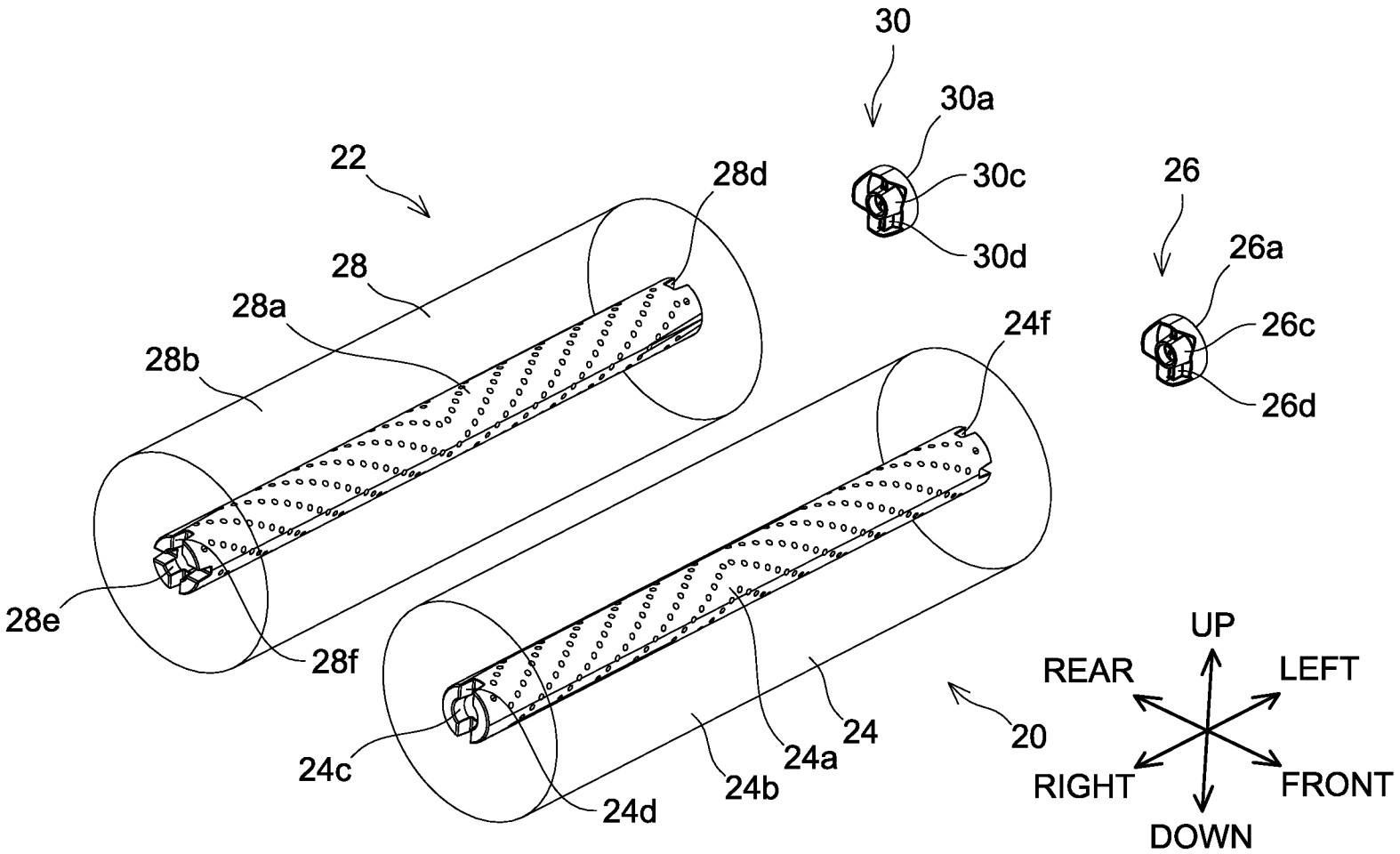
FIG. 4 is an exploded perspective view of a front main brush 20 and a rear main brush 22 of the cleaning machine 2 according to the embodiment, as viewed from the upper right front side.

As illustrated in FIG. 4, the front main brush 20 comprises a roll brush 24 and a brush cap 26. The roll brush 24 comprises a brush shaft 24*a* that has a substantially solid cylinder shape extending in the left-right direction and brush bristles 24*b* implanted in a surface of the brush shaft 24*a*. The rear main brush 22 comprises a roll brush 28 and a brush cap 30. The roll brush 28 comprises a brush shaft 28*a* that has a substantially solid cylinder shape extending in the left-right direction and brush bristles 28*b* implanted in a surface of the brush shaft 28*a*. In the drawings, the brush bristles 24*b*, 28*b* are indicated only by their envelope surfaces of tips of the brush bristles 24*b*, 28*b* and their detailed depiction is omitted for simplification of the drawings. In the front main brush 20, the brush bristles 24*b* are implanted, on the right side of the center of the brush shaft 24*a*, in a spiral shape that spirals counterclockwise from a right end of the brush shaft 24*a* toward the center, and are implanted, on the left side of the center of the brush shaft 24*a*, in a spiral shape that spirals clockwise from a left end of the brush shaft 24*a* toward the center. In the rear main brush 22, the brush bristles 28*b* are implanted, on the right side of the center of the brush shaft 28*a*, in a spiral shape that spirals clockwise from a right end of the brush shaft 28*a* toward the center, and are implanted, on the left side of the center of the brush shaft 28*a*, in a spiral shape that spirals counterclockwise from a left end of the brush shaft 28*a* toward the center.

Figure 5:
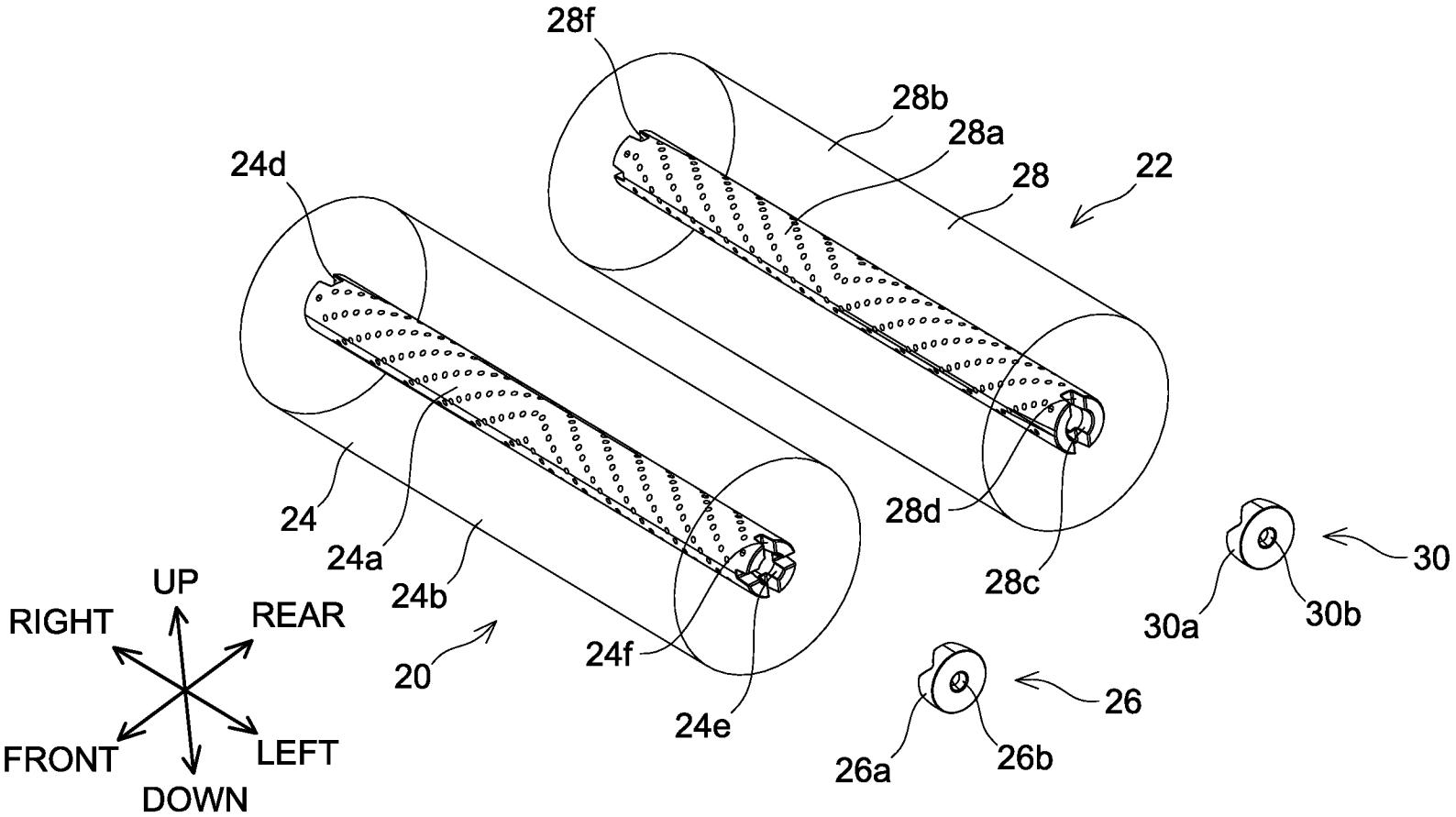
FIG. 5 is an exploded perspective view of the front main brush 20 and the rear main brush 22 of the cleaning machine 2 according to the embodiment, as viewed from the upper left front side.

A cylindrical groove 24*c* having a substantially cylindrical shape and an engagement groove 24*d* extending from the cylindrical groove 24*c* are defined at the right end of the brush shaft 24*a*. The engagement groove 24*d* has a linear shape extending radially. In the present embodiment, the engagement groove 24*d* is arranged as one linear groove. As illustrated in FIG. 5, a cylindrical groove 24*e* having a substantially cylindrical shape and engagement grooves 24*f* extending from the cylindrical groove 24*e* are defined at the left end of the brush shaft 24*a*. The engagement grooves 24*f* each have a linear shape extending radially and they are arranged as multiple linear grooves perpendicularly crossing each other. In the present embodiment, the engagement grooves 24*f* are arranged in a cross shape. The width of the engagement grooves 24*f* is smaller than the width of the engagement groove 24*d*. A cylindrical groove 28*c* having a substantially cylindrical shape and an engagement groove 28*d* extending from the cylindrical groove 28*c* are defined at the left end of the brush shaft 28*a*. The engagement groove 28*d* has a linear shape extending radially. In the present embodiment, the engagement groove 28*d* is arranged as one linear groove. As illustrated in FIG. 4, a cylindrical groove 28*e* having a substantially cylindrical shape and engagement grooves 28*f* extending from the cylindrical groove 28*e* are defined at the right end of the brush shaft 28*a*. The engagement grooves 28*f* each have a linear shape extending radially and they are arranged as multiple linear grooves perpendicularly crossing each other. In the present embodiment, the engagement grooves 28*f* are arranged in a cross shape. The width of the engagement grooves 28*f* is smaller than the width of the engagement groove 28*d*.

The brush cap 26 comprises a cap portion 26*a* covering the left end of the brush shaft 24*a*, a holder groove 26*b* (see FIG. 5) defined in an outer surface of the cap portion 26*a*, a cylindrical portion 26*c* having a substantially hollow cylinder shape and projecting from an inner surface of the cap portion 26*a*, and an engagement portion 26*d* extending from a side surface of the cylindrical portion 26*c*. The engagement portion 26*d* has a linear rib shape extending radially. In the present embodiment, the engagement portion 26*d* is arranged in a linear rib shape. The diameter of the cylindrical portion 26*c* is slightly smaller than the diameters of the cylindrical grooves 24*c*, 24*e* of the brush shaft 24*a*. The width of the rib of the engagement portion 26*d* is smaller than the widths of the engagement groove 24*d* and the engagement grooves 24*f* of the brush shaft 24*a*. Thus, when the brush cap 26 is attached to the left end of the brush shaft 24*a*, the cylindrical portion 26*c* enters the cylindrical groove 24*e* and the engagement portion 26*d* enters one of the engagement grooves 24*f*. The brush cap 30 comprises a cap portion 30*a* covering the left end of the brush shaft 28*a*, a holder groove 30*b* (see FIG. 5) defined in an outer surface of the cap portion 30*a*, a cylindrical portion 30*c* having a substantially hollow cylinder shape and projecting from an inner surface of the cap portion 30*a*, and an engagement portion 30*d* extending from a side surface of the cylindrical portion 30*c*. The engagement portion 30*d* has a linear rib shape extending radially. In the present embodiment, the engagement portion 30*d* is arranged in a linear rib shape. The diameter of the cylindrical portion 30*c* is slightly smaller than the diameters of the cylindrical grooves 28*c*, 28*e* of the brush shaft 28*a*. The width of the rib of the engagement portion 30*d* is smaller than the widths of the engagement groove 28*d* and the engagement grooves 28*f* of the brush shaft 28*a*. Thus, when the brush cap 30 is attached to the left end of the brush shaft 28*a*, the cylindrical portion 30*c* enters the cylindrical groove 28*c* and the engagement portion 30*d* enters the engagement groove 28*d*.

The roll brush 28 has the same shape and configuration as those of the roll brush 24 when reversed left and right. Thus, common components can be used for the roll brush 24 and the roll brush 28. Further, the brush cap 26 has the same shape and configuration as those of the brush cap 30. Thus, common components can be used for the brush cap 26 and the brush cap 30.

Figure 6:
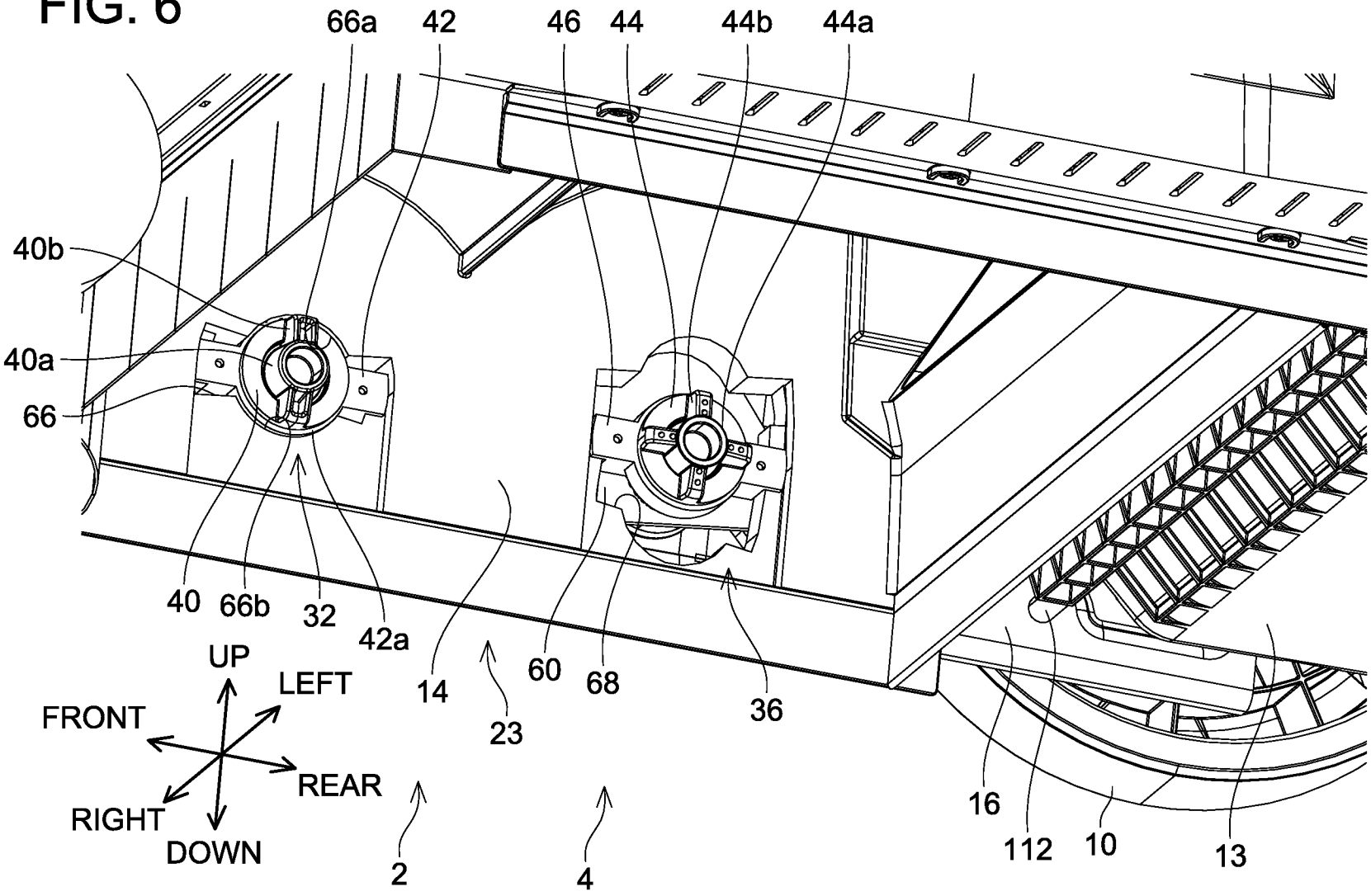
FIG. 6 is a perspective view in the vicinity of a right front brush attaching member 32 and a right rear brush attaching member 36 of the cleaning machine 2 according to the embodiment, as viewed from the lower left front side.
Figure 7:
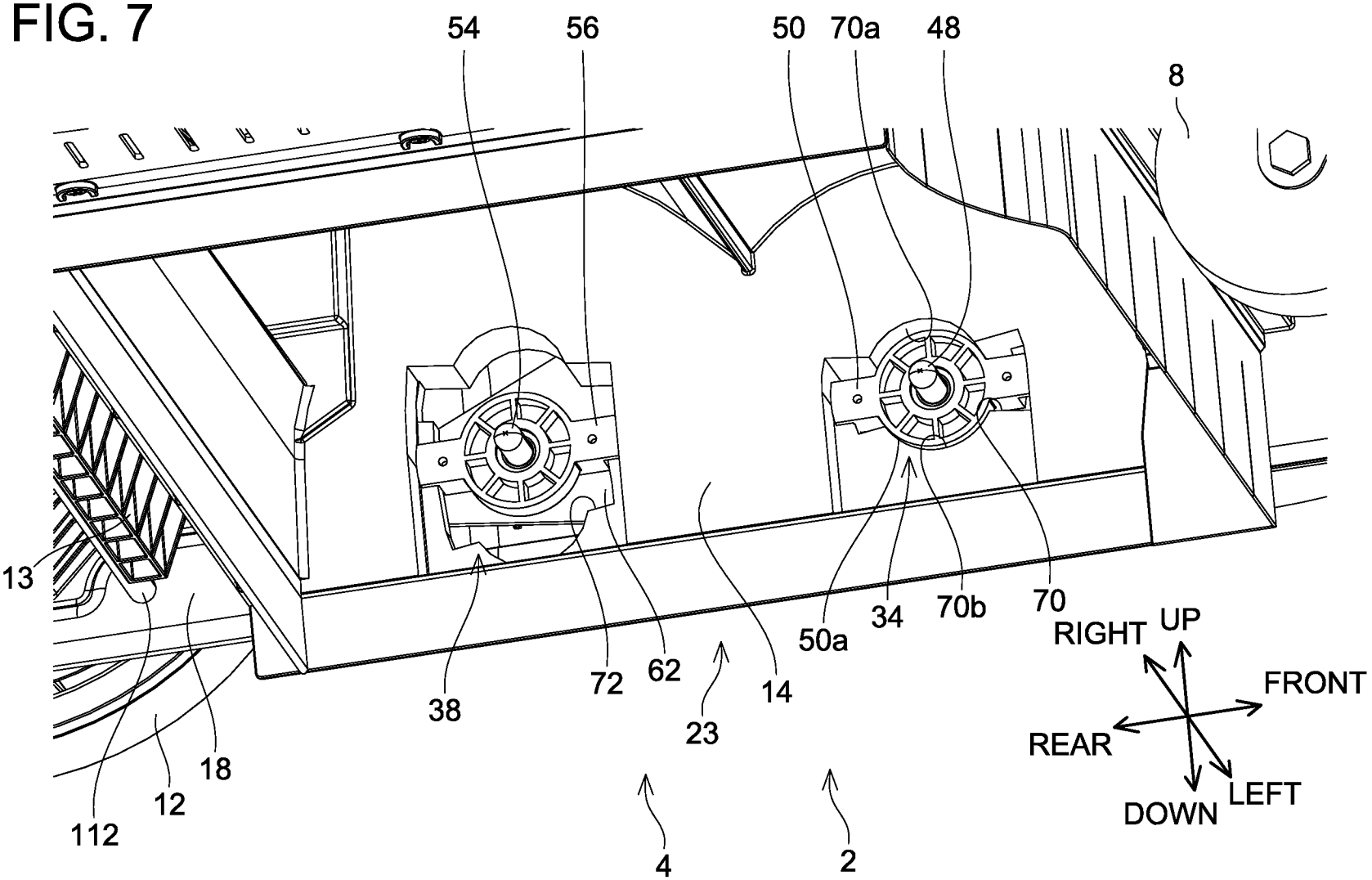
FIG. 7 is a perspective view in the vicinity of a left front brush attaching member 34 and a left rear brush attaching member 38 of the cleaning machine 2 according to the embodiment, as viewed from the lower right front side.

A right end of the front main brush 20 is attached to a right front brush attaching member 32 (see FIG. 6) of the main brush unit 23 and a left end of the front main brush 20 is attached to a left front brush attaching member 34 (see FIG. 7) of the main brush unit 23. A right end of the rear main brush 22 is attached to a right rear brush attaching member 36 (see FIG. 6) of the main brush unit 23 and a left end of the rear main brush 22 is attached to a left rear brush attaching member 38 (see FIG. 7) of the main brush unit 23. As illustrated in FIG. 6, the right front brush attaching member 32 and the right rear brush attaching member 36 are disposed in a lower right portion of the body unit 4. As illustrated in FIG. 7, the left front brush attaching member 34 and the left rear brush attaching member 38 are disposed in a lower left portion of the body unit 4.

As illustrated in FIG. 6, the right front brush attaching member 32 comprises a driven shaft 40 and a holder 42. The holder 42 holds the driven shaft 40 such that it is rotatable about a rotation axis extending in the left-right direction. The driven shaft 40 comprises a cylindrical portion 40*a* that projects in a hollow cylinder shape and an engagement portion 40*b* extending from the cylindrical portion 40*a*. The engagement portion 40*b* has a linear rib shape extending radially. In the present embodiment, the engagement portion 40*b* is arranged in a linear rib shape. The diameter of the cylindrical portion 40*a* is slightly smaller than the diameter of the cylindrical groove 24*c* of the brush shaft 24*a* of the front main brush 20. The width of the rib of the engagement portion 40*b* is slightly smaller than the width of the engagement groove 24*d* of the brush shaft 24*a* of the front main brush 20 and greater than the engagement grooves 28*f* of the brush shaft 28*a* of the rear main brush 22. Thus, the right end of the front main brush 20 can be attached to the driven shaft 40, while the right end of the rear main brush 22 cannot be attached to the driven shaft 40. This configuration can prevent the rear main brush 22 from being erroneously attached to the right front brush attaching member 32.

The right rear brush attaching member 36 comprises a driven shaft 44 and a holder 46. The holder 46 holds the driven shaft 44 such that it is rotatable about a rotation axis extending in the left-right direction. The driven shaft 44 comprises a cylindrical portion 44*a* that projects in a hollow cylinder shape and engagement portions 44*b* extending from the cylindrical portion 44*a*. The engagement portions 44*b* each extend radially and they comprise linear rib shapes perpendicular to each other. In the present embodiment, the engagement portions 44*b* are arranged in a cross rib shape. The diameter of the cylindrical portion 44*a* is slightly smaller than the diameter of the cylindrical groove 28*e* of the brush shaft 28*a* of the rear main brush 22. The width of the ribs of the engagement portions 44*b* is slightly smaller than the width of the engagement grooves 28*f* of the brush shaft 28*a* of the rear main brush 22. Thus, the right end of the rear main brush 22 can be attached to the driven shaft 44, while the right end of the front main brush 20 cannot be attached to the driven shaft 44. This configuration can prevent the front main brush 20 from being erroneously attached to the right rear brush attaching member 36.

Figure 8:
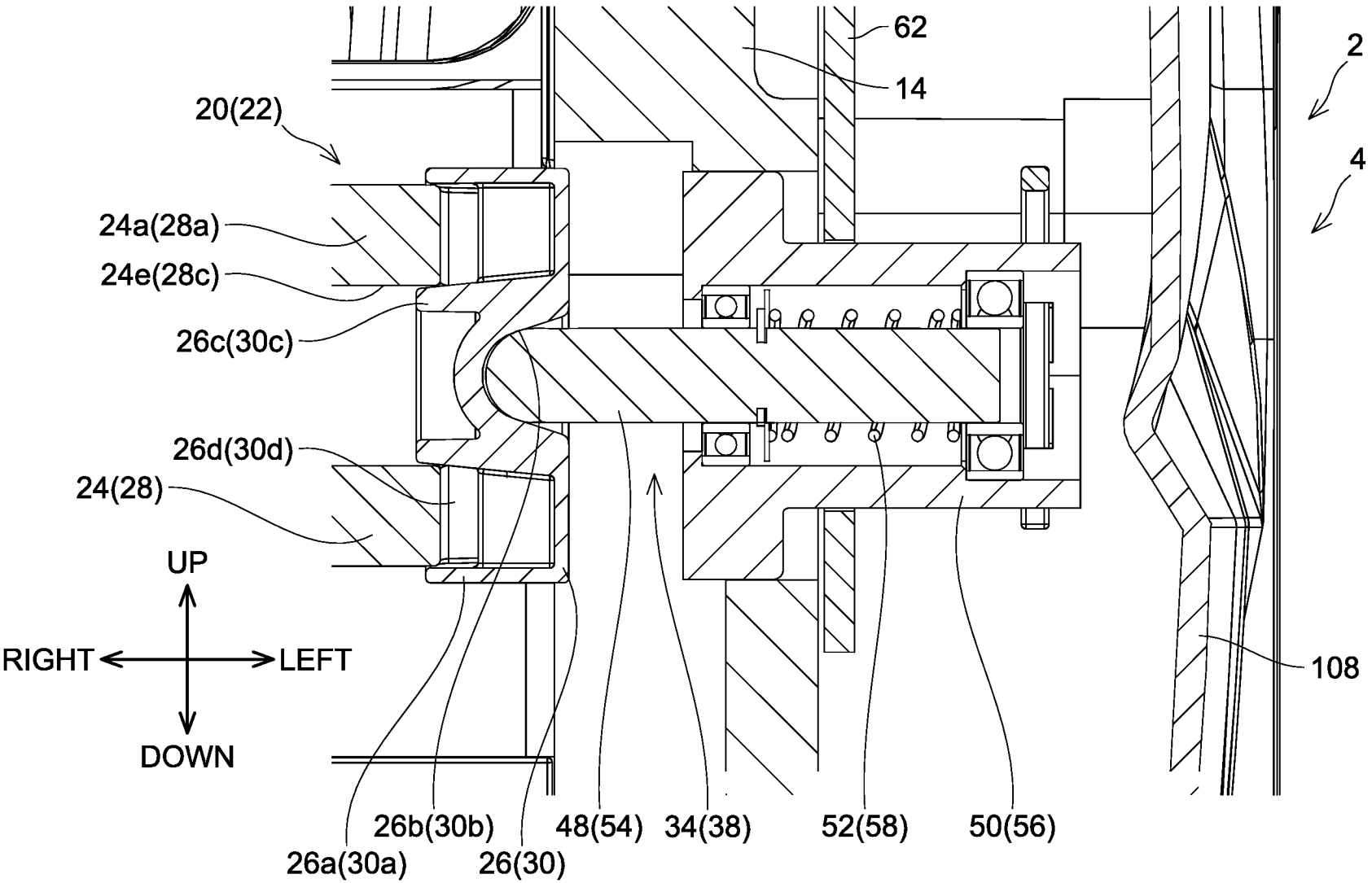
FIG. 8 is a vertical cross-sectional view in the vicinity of the left front brush attaching member 34 of the cleaning machine 2 according to the embodiment.

As illustrated in FIG. 7, the left front brush attaching member 34 comprises a plunger pin 48, a holder 50, and a compression spring 52 (see FIG. 8). As illustrated in FIG. 8, the holder 50 holds the plunger pin 48 such that it is movable in the left-right direction and rotatable about a rotation axis extending in the left-right direction. The compression spring 52 is housed in the holder 50 and biases the plunger pin 48 rightward with respect to the holder 50. A tip of the plunger pin 48 is substantially hemispherical. As illustrated in FIG. 7, the left rear brush attaching member 38 comprises a plunger pin 54, a holder 56, and a compression spring 58 (see FIG. 8). As illustrated in FIG. 8, the holder 56 holds the plunger pin 54 such that it is movable in the left-right direction and rotatable about a rotation axis extending in the left-right direction. The compression spring 58 is housed in the holder 56 and biases the plunger pin 54 rightward with respect to the holder 56. A tip of the plunger pin 54 is substantially hemispherical.

When the front main brush 20 is to be attached to the body unit 4, firstly the plunger pin 48 of the left front brush attaching member 34 is inserted into the holder groove 26*b* of the brush cap 26 and the front main brush 20 is pushed toward the left front brush attaching member 34, as illustrated in FIG. 8. The plunger pin 48 is thereby moved leftward against the biasing force of the compression spring 52, and as a result the right end of the front main brush 20 comes to be positioned leftward of the right front brush attaching member 32. In this state, the cylindrical portion 40*a* (see FIG. 6) of the right front brush attaching member 32 is inserted into the cylindrical groove 24*c* (see FIG. 4) of the front main brush 20 and the engagement portion 40*b* (see FIG. 6) of the right front brush attaching member 32 are inserted into the engagement groove 24*d* (see FIG. 4) of the front main brush 20. As a result, the front main brush 20 is attached to the right front brush attaching member 32 and the left front brush attaching member 34. In this attached state, the plunger pin 48 of the left front brush attaching member 34 is pressed against the brush cap 26 of the front main brush 20 by the biasing force of the compression spring 52 and the brush shaft 24*a* (see FIG. 4) of the front main brush 20 is pressed against the driven shaft 40 (see FIG. 6) of the right front brush attaching member 32. Thus, it is possible to prevent the front main brush 20 from accidentally coming off from the right front brush attaching member 32 and the left front brush attaching member 34. When the front main brush 20 is to be removed from the body unit 4, the front main brush 20 is pushed toward the left front brush attaching member 34 against the biasing force of the compression spring 52. The cylindrical portion 40*a* of the right front brush attaching member 32 is thereby released from the cylindrical groove 24*c* at the right end of the front main brush 20 and also the engagement portion 40*b* of the right front brush attaching member 32 are released from the engagement groove 24*d* at the right end of the front main brush 20. Then, when the front main brush 20 is moved rightward and downward, the plunger pin 48 of the left front brush attaching member 34 is released from the holder groove 26*b* of the brush cap 26. As a result, the front main brush 20 is removed from the right front brush attaching member 32 and the left front brush attaching member 34.

Similarly, when the rear main brush 22 is to be attached to the body unit 4, firstly the plunger pin 54 of the left rear brush attaching member 38 is inserted into the holder groove 30*b* of the brush cap 30 and the rear main brush 22 is pushed toward the left rear brush attaching member 38, as illustrated in FIG. 8. The plunger pin 54 is thereby moved leftward against the biasing force of the compression spring 58, and as a result the right end of the rear main brush 22 comes to be positioned leftward of the right rear brush attaching member 36. In this state, the cylindrical portion 44*a* (see FIG. 6) of the right rear brush attaching member 36 is inserted into the cylindrical groove 28*e* (see FIG. 4) of the rear main brush 22 and the engagement portions 44*b* (see FIG. 6) of the right rear brush attaching member 36 are inserted into the engagement grooves 28*f* (see FIG. 4) of the rear main brush 22. As a result, the rear main brush 22 is attached to the right rear brush attaching member 36 and the left rear brush attaching member 38. In this attached state, the plunger pin 54 of the left rear brush attaching member 38 is pressed against the brush cap 30 of the rear main brush 22 by the biasing force of the compression spring 58 and the brush shaft 28*a* (see FIG. 4) of the rear main brush 22 is pressed against the driven shaft 44 (see FIG. 6) of the right rear brush attaching member 36. Thus, it is possible to prevent the rear main brush 22 from accidentally coming off from the right rear brush attaching member 36 and the left rear brush attaching member 38. When the rear main brush 22 is to be removed from the body unit 4, the rear main brush 22 is pushed toward the left rear brush attaching member 38 against the biasing force of the compression spring 58. The cylindrical portion 44*a* of the right rear brush attaching member 36 is thereby released from the cylindrical groove 28*e* at the right end of the rear main brush 22 and also the engagement portions 44*b* of the right rear brush attaching member 36 are released from the engagement grooves 28*f* at the right end of the rear main brush 22. Then, when the rear main brush 22 is moved rightward and downward, the plunger pin 54 of the left rear brush attaching member 38 is released from the holder groove 30*b* of the brush cap 30. As a result, the rear main brush 22 is removed from the right rear brush attaching member 36 and the left rear brush attaching member 38.

(Main Brush Unit 23)

Figure 9:
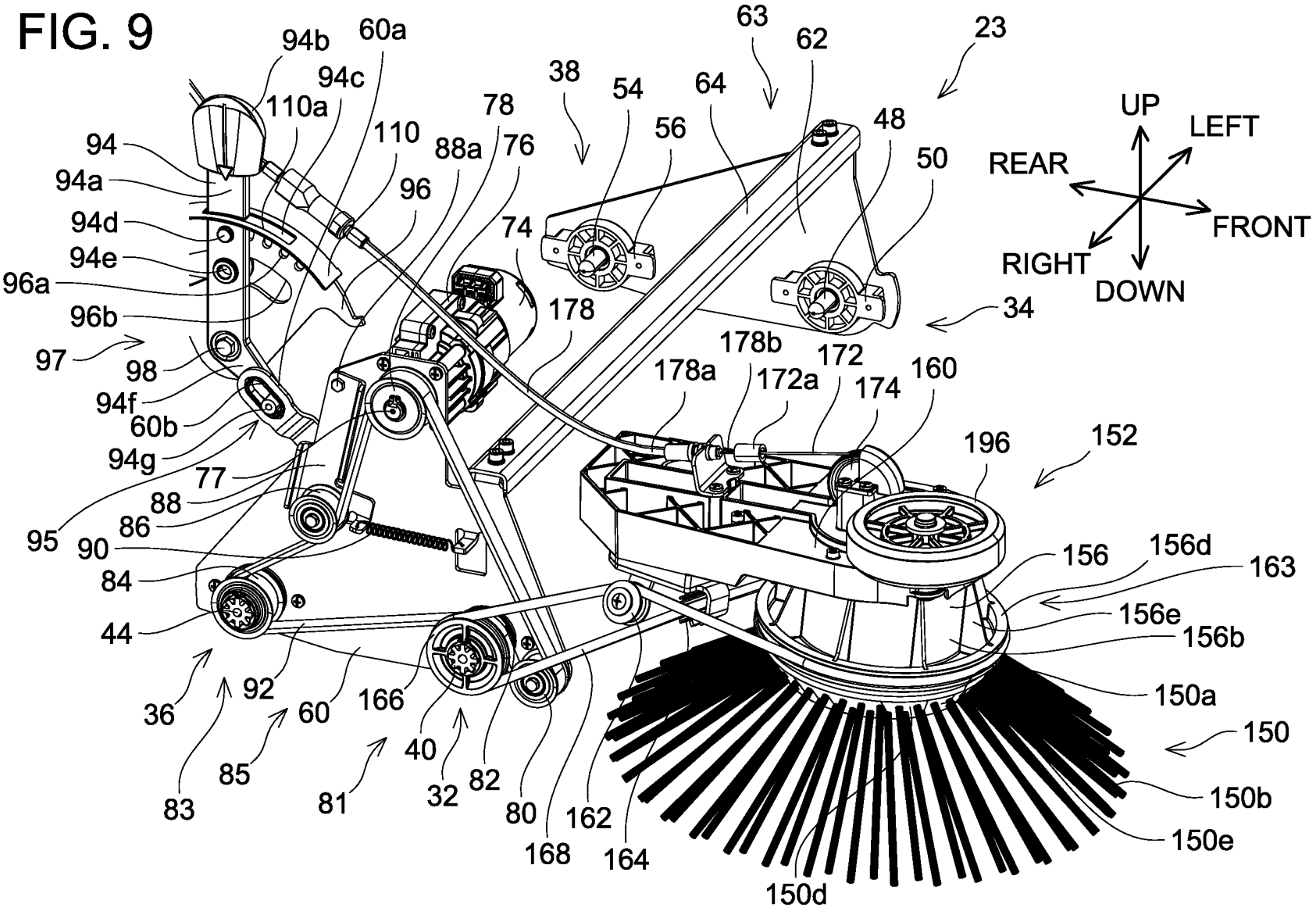
FIG. 9 is a perspective view of a main brush unit 23 and a side brush unit 152 of the cleaning machine 2 according to the embodiment, as viewed from the upper right front side.

As illustrated in FIG. 9, the right front brush attaching member 32 and the right rear brush attaching member 36 are supported by a right brush plate 60, and the left front brush attaching member 34 and the left rear brush attaching member 38 are supported by a left brush plate 62. The holder 42 (see FIG. 6) of the right front brush attaching member 32 and the holder 46 (see FIG. 6) of the right rear brush attaching member 36 penetrate the right brush plate 60 from left to right and are fixed to the right brush plate 60. The driven shaft 40 of the right front brush attaching member 32 and the driven shaft 44 of the right rear brush attaching member 36 project rightward beyond the right brush plate 60. The holder 50 of the left front brush attaching member 34 and the holder 56 of the left rear brush attaching member 38 penetrate the left brush plate 62 from right to left and are fixed to the left brush plate 62. The right brush plate 60 and the left brush plate 62 are coupled by a link member 64. The link member 64 is a C-shaped channel having the left-right direction as its longitudinal direction. A right end of the link member 64 is fixed to an upper front portion of the right brush plate 60, and a left end of the link member 64 is fixed to an upper front portion of the left brush plate 62. Hereinafter, the right brush plate 60, the left brush plate 62, and the link member 64 may be collectively referred to as a main brush supporting member 63.

As illustrated in FIG. 6, the right brush plate 60 is positioned rightward of the chassis 14. The holder 42 of the right front brush attaching member 32 passes through a right front opening 66 defined in the chassis 14 from right to left, and the holder 46 of the right rear brush attaching member 36 passes through a right rear opening 68 defined in the chassis 14 from right to left. The holder 42 of the right front brush attaching member 32 has a cylindrical portion 42*a* having a substantially hollow cylinder shape. The axis of the cylindrical portion 42*a* substantially coincides with the axis of the driven shaft 40. The right front opening 66 of the chassis 14 comprises an upper edge 66*a* and a lower edge 66*b* corresponding to the shape of a side surface of the cylindrical portion 42*a*. The cylindrical portion 42*a* of the holder 46 is pivotably supported by the upper edge 66*a* and the lower edge 66*b* of the right front opening 66 of the chassis 14, and thus the right brush plate 60 is pivotably supported by the chassis 14.

As illustrated in FIG. 7, the left brush plate 62 is positioned leftward of the chassis 14. The holder 50 of the left front brush attaching member 34 passes through a left front opening 70 defined in the chassis 14 from left to right, and the holder 56 of the left rear brush attaching member 38 passes through a left rear opening 72 defined in the chassis 14 from left to right. The holder 50 of the left front brush attaching member 34 has a cylindrical portion 50*a* having a substantially hollow cylinder shape. The axis of the cylindrical portion 50*a* substantially coincides with the axis of the plunger pin 48. The left front opening 70 of the chassis 14 comprises an upper edge 70*a* and a lower edge 70*b* corresponding to the shape of a side surface of the cylindrical portion 50*a*. The cylindrical portion 50*a* of the holder 50 is pivotably supported by the upper edge 70*a* and the lower edge 70*b* of the left front opening 70 of the chassis 14, and thus the left brush plate 62 is pivotably supported by the chassis 14.

As illustrated in FIG. 9, a motor 74 for brush (simply referred to as a motor 74, hereinafter) and a reducer mechanism 76 are attached to an upper portion of the right brush plate 60. An output shaft of the motor 74 is along the left-right direction. The motor 74 is supported by the reducer mechanism 76. The reducer mechanism 76 is, for example, a planetary gear reducer mechanism. The reducer mechanism 76 penetrates the right brush plate 60 from left to right and is fixed to the right brush plate 60. The reducer mechanism 76 is coupled with a drive shaft 77 projecting rightward beyond the right brush plate 60. The reducer mechanism 76 reduces rotation of the output shaft of the motor 74 and transmits it to the drive shaft 77.

A drive pulley 78, a guide pulley 80, a front driven pulley 82, a rear driven pulley 84, and a tensioner pulley 86 are disposed on the right side of the right brush plate 60. The drive pulley 78 is fixed to the drive shaft 77. The guide pulley 80 is rotatably supported by the right brush plate 60 at a lower front portion of the right brush plate 60. The front driven pulley 82 is fixed to the driven shaft 40 of the right front brush attaching member 32. The rear driven pulley 84 is fixed to the driven shaft 44 of the right rear brush attaching member 36. The tensioner pulley 86 is rotatably supported by a tensioner plate 88. The tensioner plate 88 is supported by the right brush plate 60 such that it is pivotable about a pivot axis 88*a*. The tensioner plate 88 is also coupled with the right brush plate 60 via a tension spring 90. The tensioner plate 88 is biased by the tension spring 90 with respect to the right brush plate 60 in a pivot direction that brings the tensioner pulley 86 forward. A main drive belt 92 is strapped on the drive pulley 78, the guide pulley 80, the front driven pulley 82, the rear driven pulley 84, and the tensioner pulley 86. The main drive belt 92 is strapped on a front portion of the drive pulley 78 onto a front portion of the guide pulley 80, on a rear portion of the guide pulley 80 onto a front portion of the front driven pulley 82, on an upper portion of the front driven pulley 82 onto a lower portion of the rear driven pulley 84, on an upper portion of the rear driven pulley 84 onto a lower portion of the tensioner pulley 86, and then on a front portion of the tensioner pulley 86 onto a rear portion of the drive pulley 78. Thus, in a right side view of the right brush plate 60, when the drive pulley 78 rotates counterclockwise, the front driven pulley 82 rotates clockwise and the rear driven pulley 84 rotates counterclockwise. That is, in the right-side view of the right brush plate 60, when the drive shaft 77 is rotated counterclockwise by the motor 74, the driven shaft 40 of the right front brush attaching member 32 is rotated clockwise and thus the front main brush 20 is rotated clockwise, and the driven shaft 44 of the right rear brush attaching member 36 is rotated counterclockwise and thus the rear main brush 22 is rotated counterclockwise. Hereinafter, the drive pulley 78, the front driven pulley 82, and the main drive belt 92 may be collectively referred to as a front main brush rotation transmitting mechanism 81, and the drive pulley 78, the rear driven pulley 84, and the main drive belt 92 may be collectively referred to as a rear main brush rotation transmitting mechanism 83. Further, the front main brush rotation transmitting mechanism 81 and the rear main brush rotation transmitting mechanism 83 may be collectively referred to as a main brush rotation transmitting mechanism 85. The tensioner pulley 86 is pressed against the main drive belt 92 by the biasing force of the tension spring 90, and thus loosening of the main drive belt 92 is prevented.

A cam piece 60*a* extending rearward and upward is disposed at an upper rear portion of the right brush plate 60. An elongated hole 60*b* is defined in the cam piece 60*a*. A longitudinal axis of the elongated hole 60*b* is along a straight line that passes the center of the rotation axis of the driven shaft 40 (i.e., the pivot axis on which the right brush plate 60 pivots with respect to the chassis 14) and the center of the elongated hole 60*b*.

A main brush lifting lever 94 is disposed near the right brush plate 60. The main brush lifting lever 94 comprises an operation arm 94*a* extending in the up-down direction, a grip 94*b* positioned at an upper end of the operation arm 94*a*, a shutter support 94*c* positioned below the grip 94*b* of the operation arm 94*a*, a pin support 94*d* positioned below the shutter support 94*c* of the operation arm 94*a*, a spring support 94*e* positioned below the pin support 94*d* of the operation arm 94*a*, a drive arm 94*f* extending forward and downward from a lower end of the operation arm 94*a*, and a cam projection 94*g* projecting rightward from the vicinity of a lower end of the drive arm 94*f*. The main brush lifting lever 94 is attached to a right handle plate 96 via a bolt 98 at the connected site of the operation arm 94*a* and the drive arm 94*f*. The right handle plate 96 is fixed to the chassis 14. The main brush lifting lever 94 is supported by the right handle plate 96 via the bolt 98 such that it is pivotable about a pivot axis extending in the left-right direction. Further, the main brush lifting lever 94 can tilt slightly in the left-right direction with respect to the right handle plate 96, with the bolt 98 as the supporting point. The cam projection 94*g* of the main brush lifting lever 94 is in the elongated hole 60*b* of the right brush plate 60. When the main brush lifting lever 94 pivots in the front-rear direction with respect to the right handle plate 96, the cam projection 94*g* pushes the edge of the elongated hole 60*b* and thus the right brush plate 60 pivots in the front-rear direction with respect to the chassis 14. Hereinafter, the cam piece 60*a* of the right brush plate 60 and the cam projection 94*g* of the main brush lifting lever 94 may be collectively referred to as a main brush pivot mechanism 95, and the main brush lifting lever 94 and the right handle plate 96 are collectively referred to as a main brush operation member 97.

Figure 10:
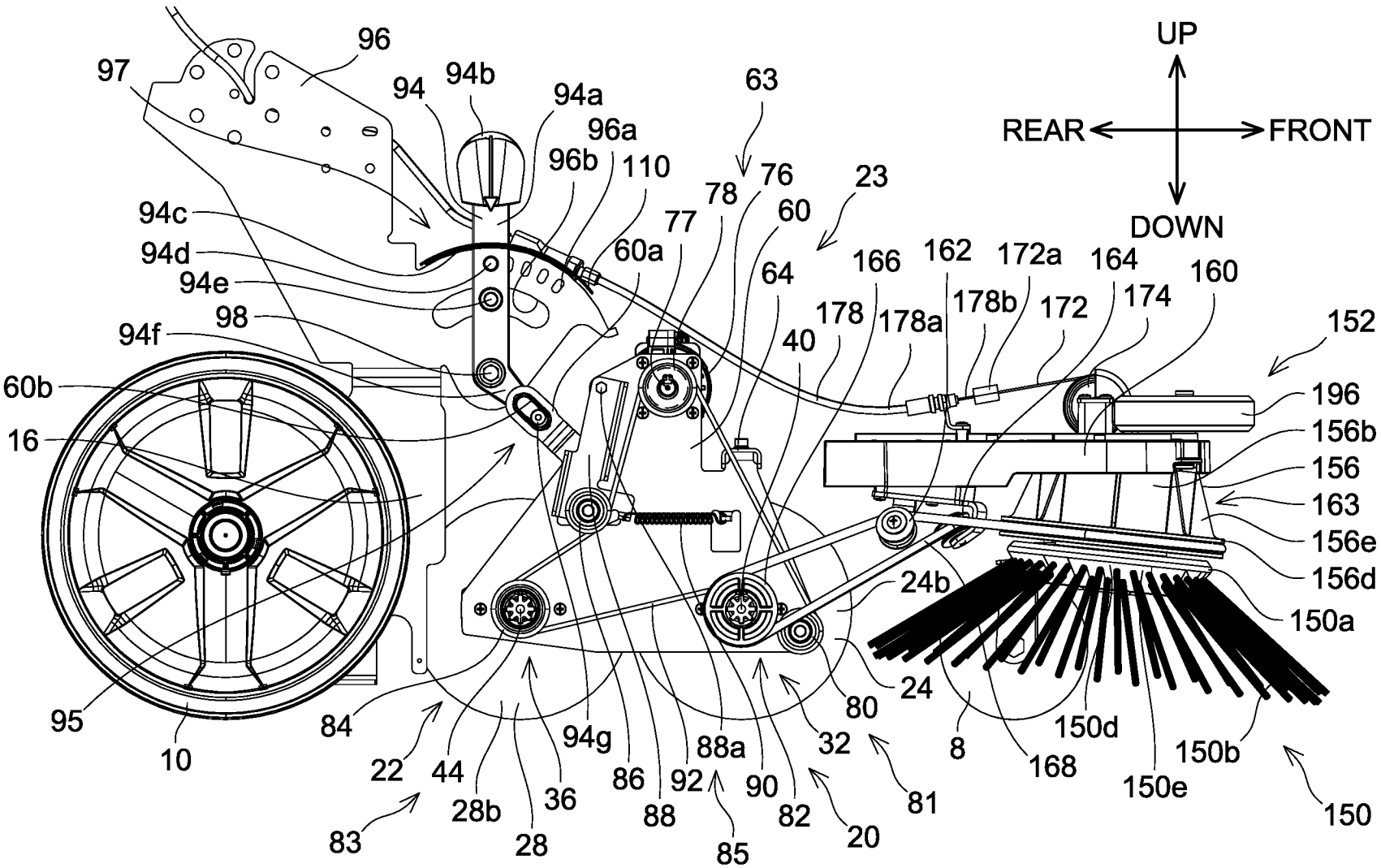
FIG. 10 is a right-side view of a front wheel 8, a right rear wheel 10, the main brush unit 23, and the side brush unit 152 of the cleaning machine 2 according to the embodiment, with the rear main brush 22 moved upward.

When the main brush lifting lever 94 is raised as illustrated in FIG. 10, the right brush plate 60 is at a pivot angle, with respect to the chassis 14, that makes the driven shaft 40 of the right front brush attaching member 32 positioned substantially at the same height as the driven shaft 44 of the right rear brush attaching member 36 in the up-down direction. In this case, lower ends of the front main brush 20 and the rear main brush 22 are positioned substantially at the same height as lower ends of the front wheel 8, the right rear wheel 10, and the left rear wheel 12 in the up-down direction.

Figure 11:
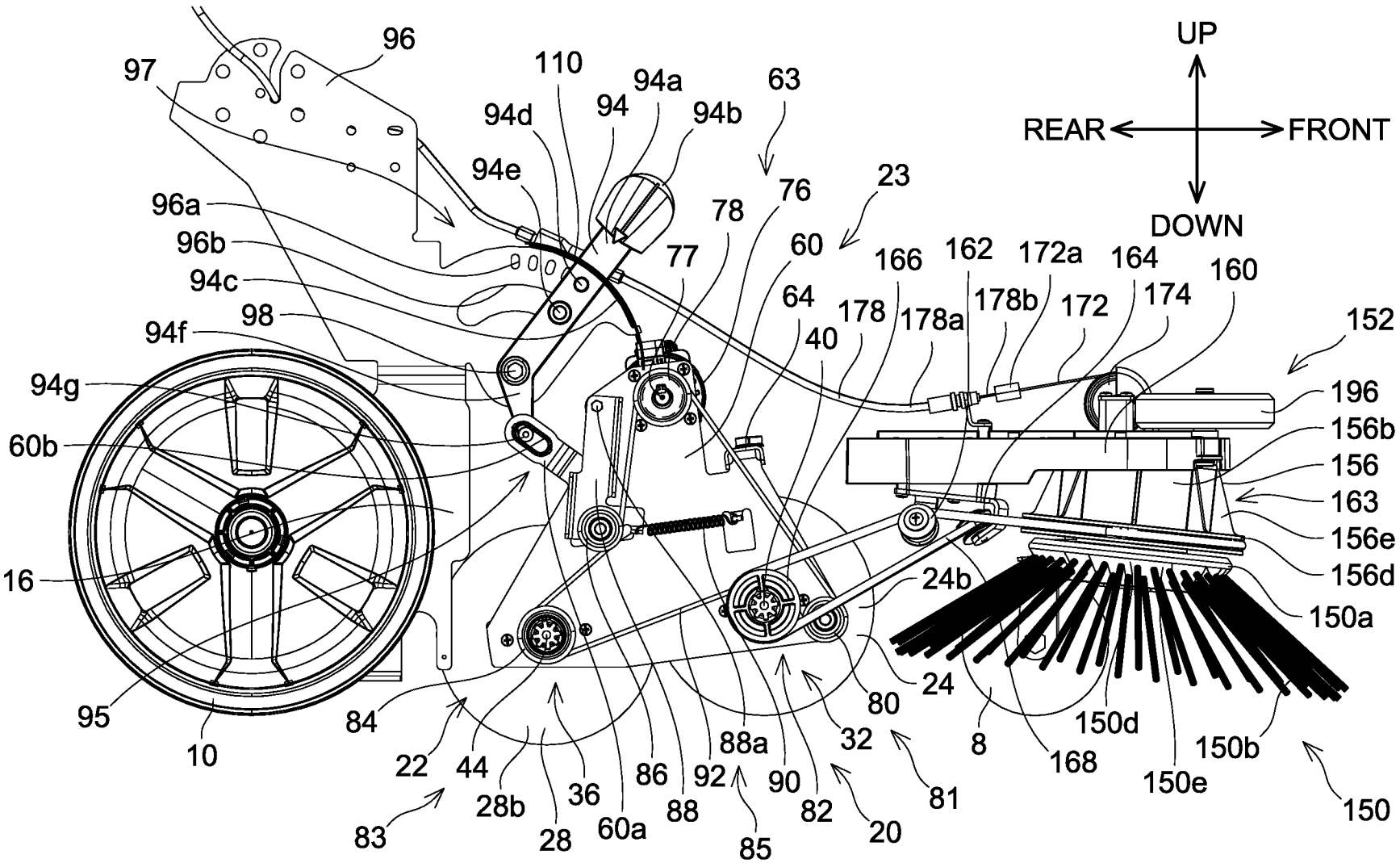
FIG. 11 is a right-side view of the front wheel 8, the right rear wheel 10, the main brush unit 23, and the side brush unit 152 of the cleaning machine 2 according to the embodiment, with the rear main brush 22 moved downward.

When the main brush lifting lever 94 is tilted forward as illustrated in FIG. 11, the right brush plate 60 pivots with respect to the chassis 14 such that the driven shaft 44 of the right rear brush attaching member 36 moves downward. In the state illustrated in FIG. 11, the driven shaft 44 of the right rear brush attaching member 36 is positioned lower than the driven shaft 40 of the right front brush attaching member 32. In this state, the position of the lower end of the front main brush 20 in the up-down direction is the same as that illustrated in FIG. 10, while the lower end of the rear main brush 22 is positioned lower than the lower ends of the front wheel 8, the right rear wheel 10, and the left rear wheel 12. Thus, the brush bristles 28*b* of the rear main brush 22 can be pressed hard against the working plane.

As illustrated in FIG. 9, a plurality of positioning holes 96*a* and an arc-shaped elongated hole 96*b* are defined in the right handle plate 96. The plurality of positioning holes 96*a* is arranged corresponding to the pin support 94*d* of the main brush lifting lever 94. The elongated hole 96*b* is arranged corresponding to the spring support 94*e* of the main brush lifting lever 94.

Figure 12:
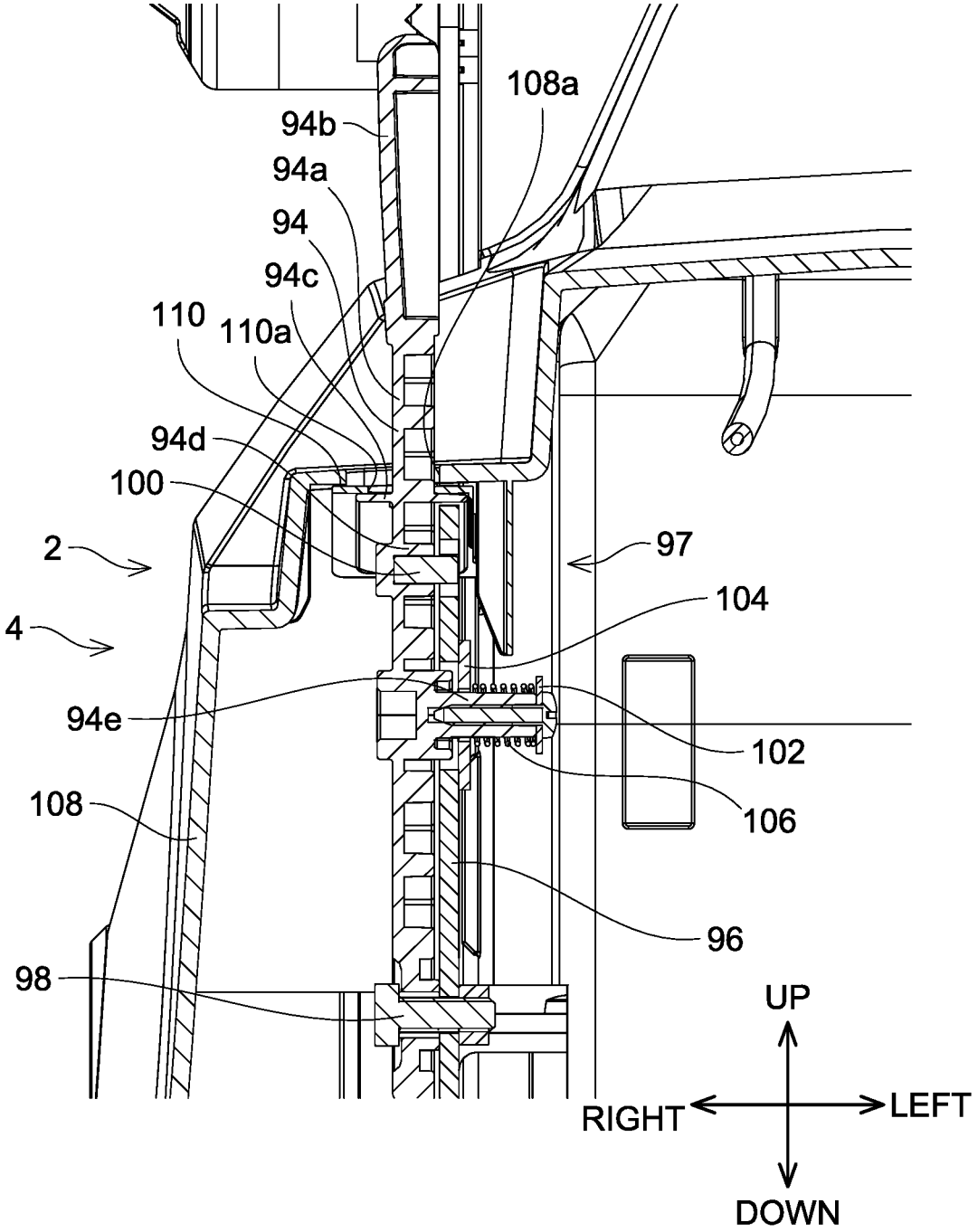
FIG. 12 is a vertical cross-sectional view in the vicinity of a main brush lifting lever 94 of the cleaning machine 2 according to the embodiment.

As illustrated in FIG. 12, a positioning pin 100 is attached to the pin support 94*d* of the main brush lifting lever 94. When the positioning pin 100 is in one of the positioning holes 96*a* of the right handle plate 96, pivoting of the main brush lifting lever 94 with respect to the right handle plate 96 is restricted. The spring support 94*e* of the main brush lifting lever 94 passes through the elongated hole 96*b* of the right handle plate 96 from right to left. A first washer 102 fixed to a left end of the spring support 94*e*, a second washer 104 contacting a left surface of the right handle plate 96, and a compression spring 106 biasing the first washer 102 leftward with respect to the second washer 104 are attached to the spring support 94*e*. When the user is not operating the main brush lifting lever 94, the main brush lifting lever 94 is tilted leftward with respect to the right handle plate 96 by the biasing force of the compression spring 106 and the positioning pin 100 is in one of the positioning holes 96*a*. When the user tilts the main brush lifting lever 94 rightward against the biasing force of the compression spring 106 to release the positioning pin 100 from the positioning hole 96*a*, pivoting of the main brush lifting lever 94 with respect to the right handle plate 96 is permitted. The user can adjust the position of the rear main brush 22 in the up-down direction by pivoting the main brush lifting lever 94 in the front-rear direction while the pivoting is permitted. When the user leaves the hand from the main brush lifting lever 94 after having adjusted the position of the rear main brush 22 in the up-down direction, the main brush lifting lever 94 is tilted leftward with respect to the right handle plate 96 by the biasing force of the compression spring 106 and the positioning pin 100 is inserted into one of the positioning holes 96*a*. This configuration allows the rear main brush 22 to be positioned at different positions in the up-down direction.

Figure 13:
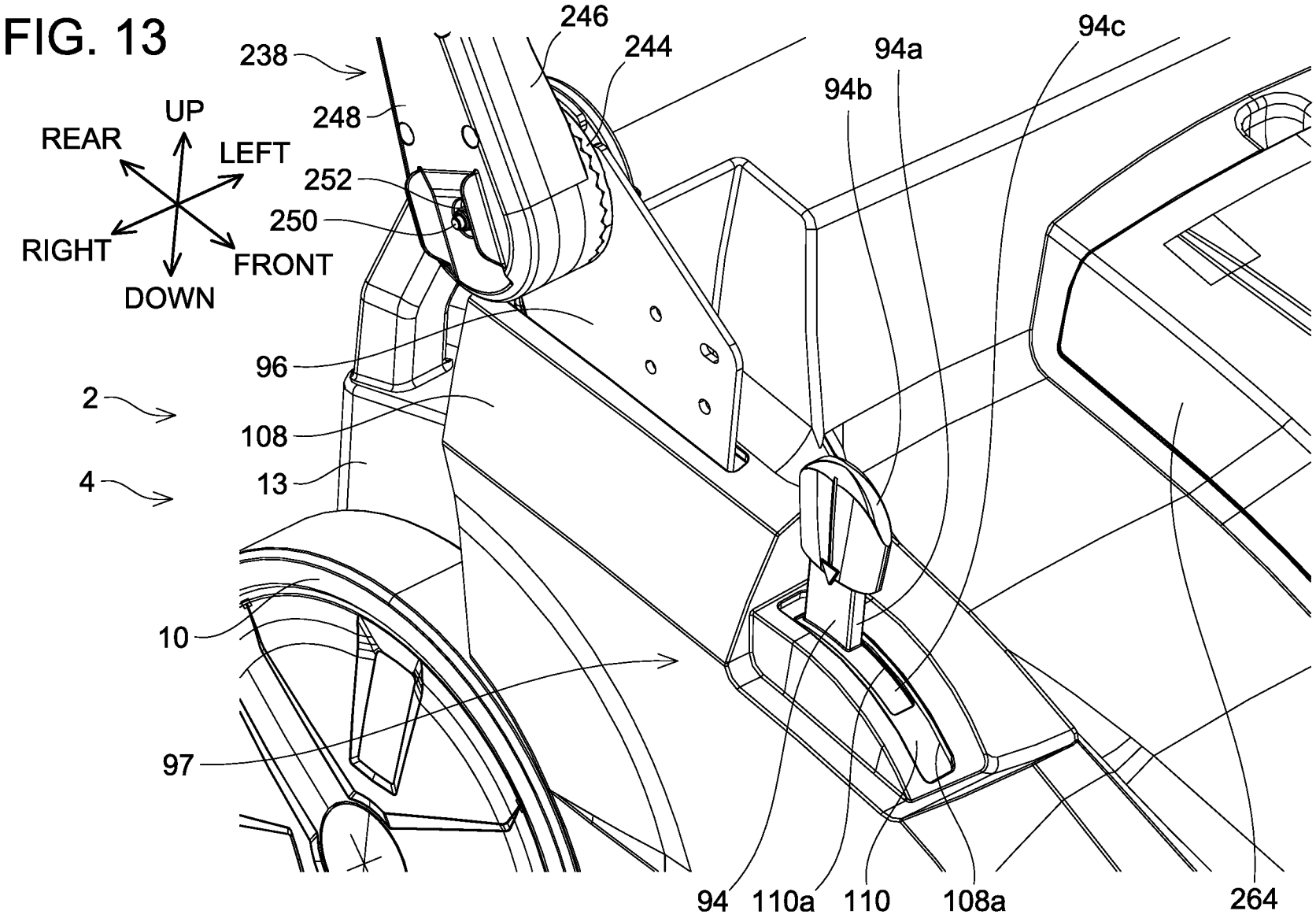
FIG. 13 is a perspective view in the vicinity of the main brush lifting lever 94 of the cleaning machine 2 according to the embodiment, as viewed from the upper right front side.

As illustrated in FIG. 13, the operation arm 94*a* of the main brush lifting lever 94 passes through, from below upward, a lever opening 108*a* of a body cover 108 covering an upper portion of the chassis 14, and the grip 94*b* of the main brush lifting lever 94 is positioned outside of the body cover 108. A shutter member 110 is attached to the main brush lifting lever 94, such that the user cannot see the inside of the body unit 4 through the lever opening 108*a*.

As illustrated in FIG. 9, the shutter member 110 has a substantially rectangular shape that is curved in the front-rear direction. The shutter member 110 has an elongated hole 110*a*. The shutter member 110 is placed on the shutter support 94*c* of the main brush lifting lever 94 with the operation arm 94*a* of the main brush lifting lever 94 passing through the elongated hole 110*a*. The shutter support 94*c* has a rectangular shape that is curved in the front-rear direction, corresponding to the shutter member 110. The shutter member 110 is slidably supported by the shutter support 94*c*. The shutter support 94*c* has dimensions and shape that close the elongated hole 110*a* wherever the operation arm 94*a* is positioned within the elongated hole 110*a*. Further, as illustrated in FIG. 13, the shutter member 110 has dimensions and shape that close the lever opening 108*a* along with the shutter support 94*c* wherever the operation arm 94*a* is positioned within the elongated hole 110*a* and wherever the operation arm 94*a* is positioned within the lever opening 108*a*. This configuration does not allow the user to see the inside of the body unit 4 through the lever opening 108*a*.

(Dust Container 13)

As illustrated in FIG. 3, trash raked up by the front main brush 20 and the rear main brush 22 is transferred rearward along a lower surface of the chassis 14 to the dust container 13 disposed at a rear portion of the chassis 14.

Figure 14:
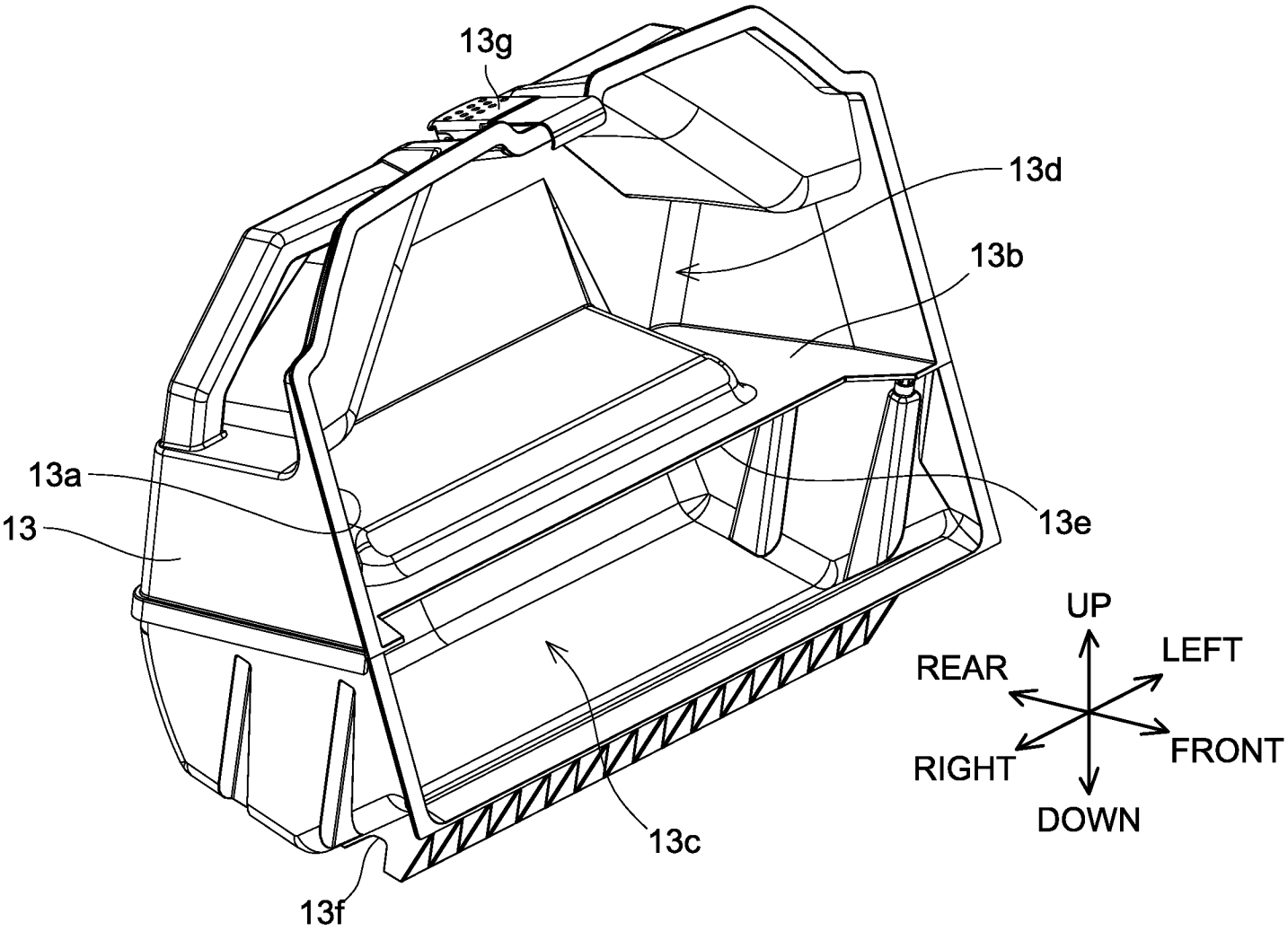
FIG. 14 is a perspective view of a dust container 13 of the cleaning machine 2 according to the embodiment, as viewed from the upper right front side.

As illustrated in FIG. 14, the dust container 13 has an opening 13*a* orientated forward and upward. A partition 13*b* is disposed in the dust container 13, and the partition 13*b* is inclined with its front end positioned higher than its rear end. The partition 13*b* partitions the inside of the dust container 13 into a lower accommodating section 13*c* and an upper accommodating section 13*d*. A notch 13*e* is defined at a front edge of the partition 13*b*. Among the trash transferred to the dust container 13 from the body unit 4, large trash is accommodated in the lower accommodating section 13*c* and small trash is accommodated in the upper accommodating section 13*d*. This configuration allows for collection of a large amount of trash as compared to a configuration without the partition 13*b*. Further, the notch 13*e* of the partition 13*b* facilitates transfer of trash to the upper accommodating section 13*d*. An engagement groove 13*f* extending in the left-right direction is defined in a lower surface of the dust container 13 near its front end. A latch 13*g* is disposed on an upper surface of the dust container 13 near its front end.

Figure 15:
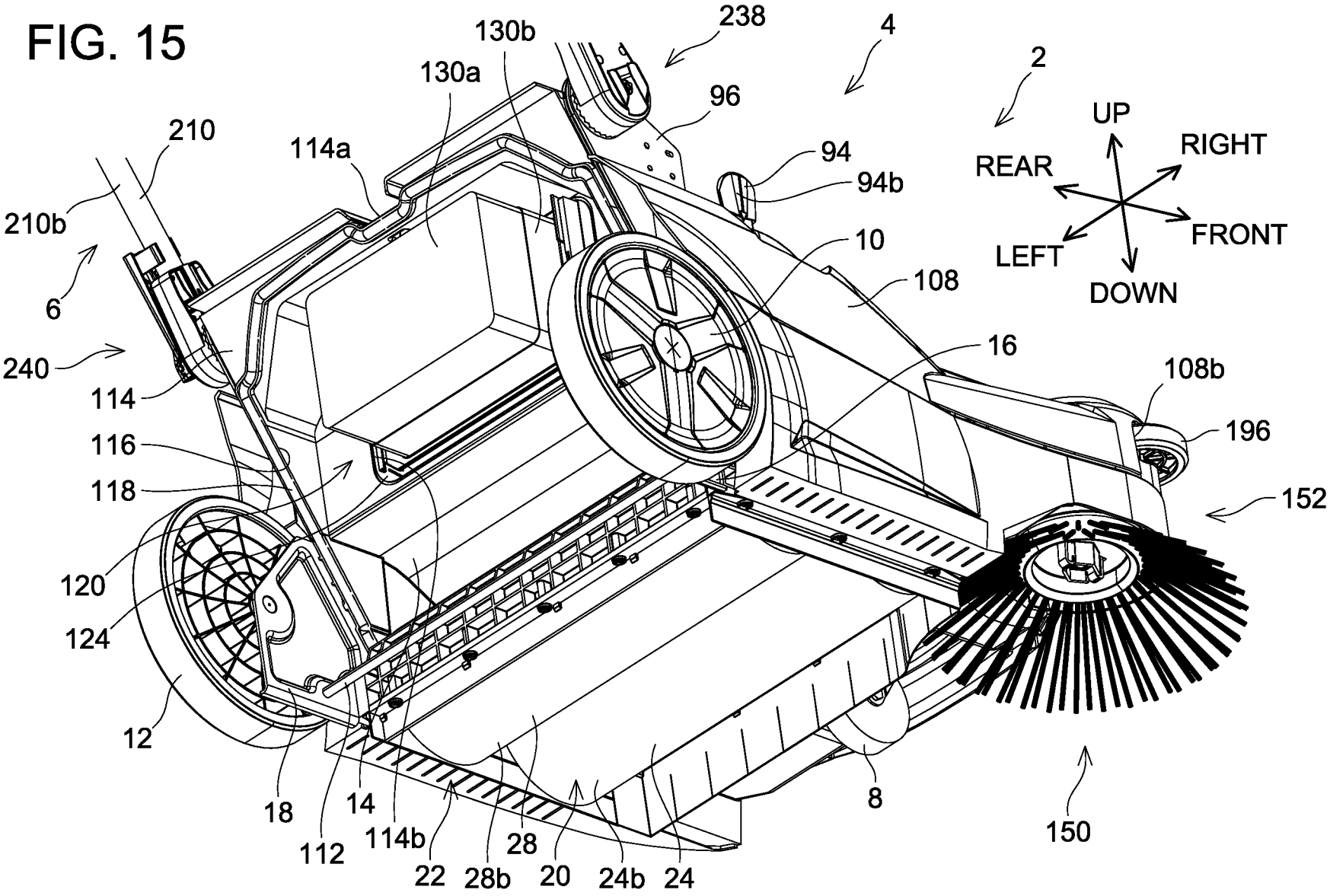
FIG. 15 is a perspective view of the cleaning machine 2 according to the embodiment with the dust container 13 removed, as viewed from the lower right rear side.

As illustrated in FIG. 15, an engagement shaft 112 is disposed at a lower rear portion of the body unit 4. A right end of the engagement shaft 112 is fixed to the right rear wheel plate 16, and a left end of the engagement shaft 112 is fixed to the left rear wheel plate 18. A duct 114 fixed to the chassis 14 is disposed at an upper rear portion of the body unit 4. Rear ends of the chassis 14 and the duct 114 define an opening 116 oriented rearward and downward. A rubber sealing material 118 is attached to the rear ends of the chassis 14 and the duct 114 such that it surrounds an upper edge, a right edge, and a left edge of the opening 116. A latch receiver 114*a* is disposed at an upper surface of the duct 114 near its rear end.

When the dust container 13 is to be attached to the body unit 4 as illustrated in FIG. 3, the engagement groove 13*f* of the dust container 13 is firstly engaged with the engagement shaft 112 of the body unit 4 with the dust container 13 tilted rearward, and then the dust container 13 is raised forward to engage the latch 13*g* of the dust container 13 with the latch receiver 114*a* of the body unit 4. In the state where the dust container 13 is attached to the body unit 4, the sealing material 118 is sealing a gap between the chassis 14 and the dust container 13 and a gap between the duct 114 and the dust container 13, and thus it is possible to prevent trash to be transferred to the dust container 13 from the body unit 4 from exiting to the outside. When the dust container 13 is to be detached from the body unit 4, the latch 13*g* of the dust container 13 is firstly disengaged from the latch receiver 114*a* of the body unit 4, and then the dust container 13 is tilted rearward and moved rearward away from the body unit 4. The engagement shaft 112 of the body unit 4 is thereby disengaged from the engagement groove 13*f* of the dust container 13, detaching the dust container 13 from the body unit 4. Since the dust container 13 is firstly tilted rearward in the detachment of the dust container 13 from the body unit 4, it is possible to prevent the trash in the dust container 13 from spilling out of the dust container 13.

(Filter Unit 120 and Fan Unit 122)

Figure 16:
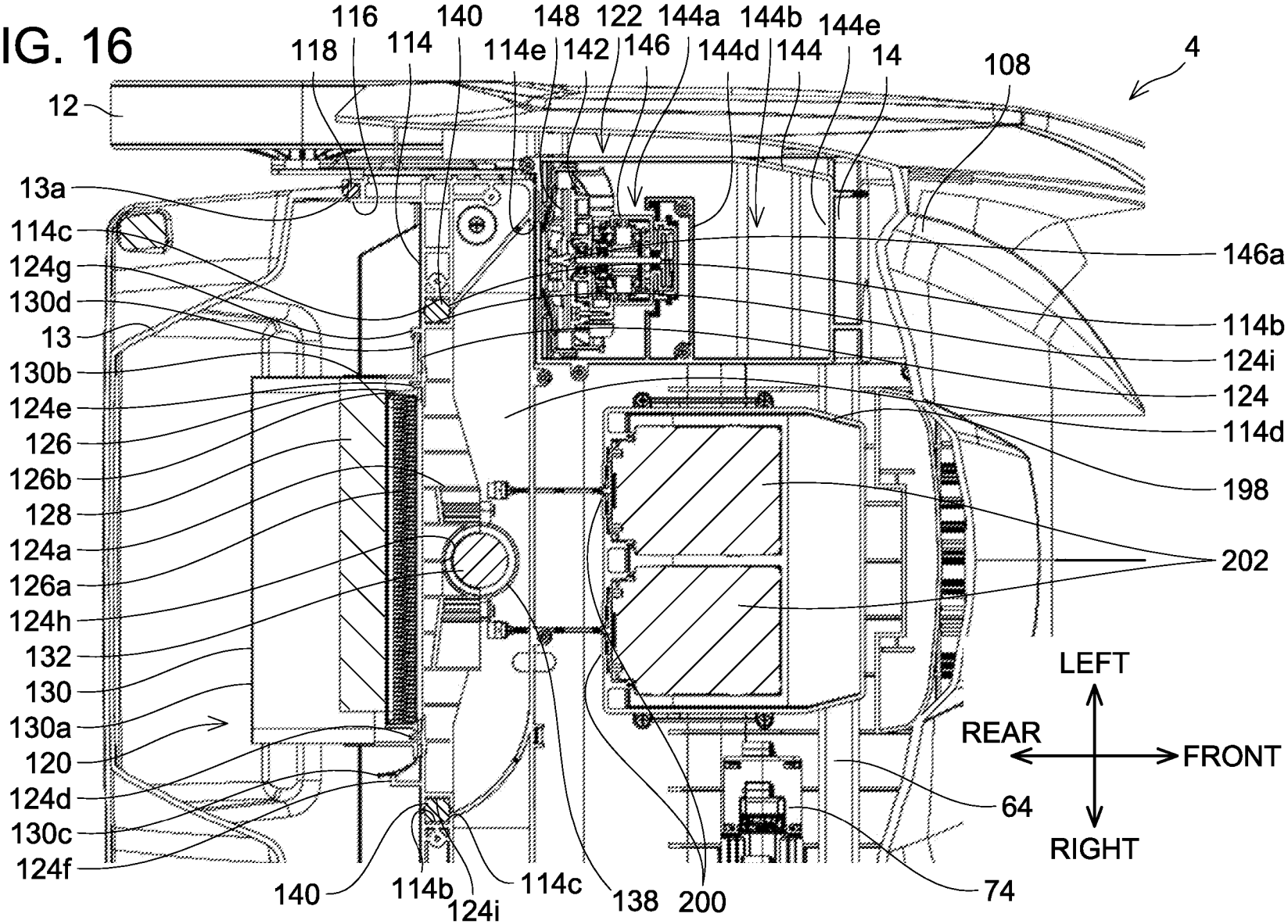
FIG. 16 is a horizontal cross-sectional view in the vicinity of a filter unit 120 and a fan unit 122 of the cleaning machine 2 according to the embodiment.

As illustrated in FIG. 16, a filter unit 120 and a fan unit 122 are attached to the duct 114. In the cleaning machine 2, the fan unit 122 suctions air through the duct 114 and the filter unit 120 to generate an air flow from below the chassis 14 toward the dust container 13. This facilitates transfer of trash raked up by the front main brush 20 and the rear main brush 22 to the dust container 13.

Figure 17:
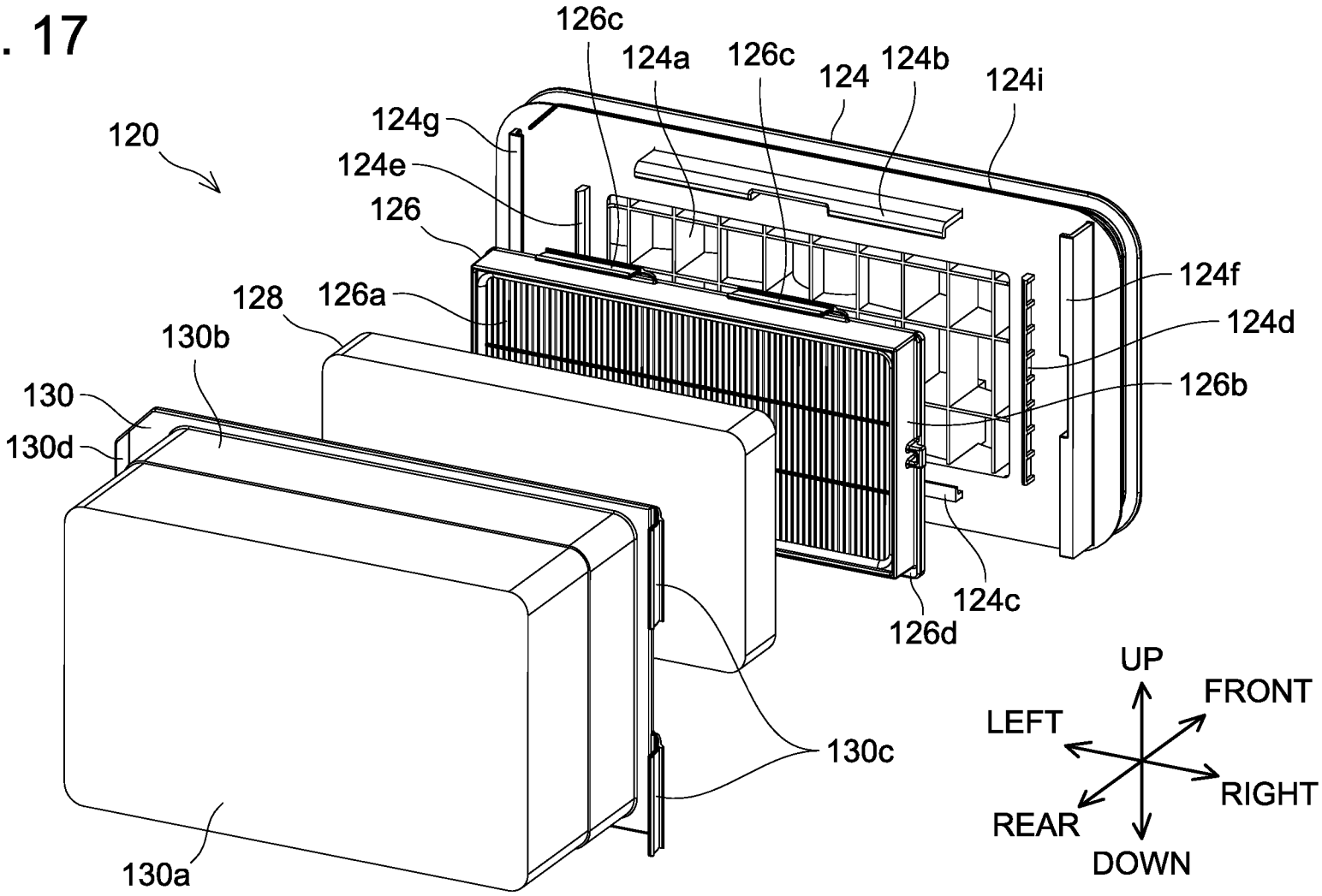
FIG. 17 is a perspective view of the filter unit 120 of the cleaning machine 2 according to the embodiment, as viewed from the upper right rear side.

As illustrated in FIG. 17, the filter unit 120 comprises a filter holder 124, a main filter 126, a sponge filter 128, and a prefilter 130. The filter holder 124 comprises a plurality of vent holes 124*a*, an upper inner filter holder portion 124*b*, a lower inner filter holder portion 124*c*, a right inner guide rib 124*d*, a left inner guide rib 124*e*, a right outer filter holder portion 124*f*, a left outer filter holder portion 124*g*, a motor holder portion 124*h* (see FIG. 18), and a seal holder portion 124*i*. The upper inner filter holder portion 124*b*, the lower inner filter holder portion 124*c*, the right inner guide rib 124*d*, the left inner guide rib 124*e*, the right outer filter holder portion 124*f*, and the left outer filter holder portion 124*g* are positioned on a rear surface of the filter holder 124. The motor holder portion 124*h* (see FIG. 18) is positioned at a front surface of the filter holder 124. The seal holder portion 124*i* is positioned at an outer peripheral surface of the filter holder 124.

The main filter 126 is a so-called HEPA (High Efficiency Particulate Air) filter. The main filter 126 is detachably attached to the filter holder 124. The main filter 126 comprises a filter body 126*a* and a filter frame 126*b* holding the filter body 126*a*. An upper engagement portion 126*c* configured to engage with the upper inner filter holder portion 124*b* and a lower engagement portion 126*d* configured to engage with the lower inner filter holder portion 124*c* are arranged on the filter frame 126*b*. The main filter 126 is attached to the filter holder 124 by inserting the lower engagement portion 126*d* in the lower inner filter holder portion 124*c*, contacting the filter frame 126*b* with the rear surface of the filter holder 124 between the right inner guide rib 124*d* and the left inner guide rib 124*e*, and then engaging the upper engagement portion 126*c* with the upper inner filter holder portion 124*b*. In the state where the filter holder 124 has the main filter 126 attached thereto, the filter body 126*a* of the main filter 126 covers the plurality of vent holes 124*a* of the filter holder 124 from behind. The sponge filter 128 is housed in the prefilter 130. In the state where the filter holder 124 has the sponge filter 128 and the prefilter 130 attached thereto, the sponge filter 128 covers the filter body 126*a* of the main filter 126 from behind. The prefilter 130 is detachably attached to the filter holder 124. The prefilter 130 comprises a cloth filter 130*a* and a filter frame 130*b* holding the cloth filter 130*a*. A right engagement portion 130*c* configured to engage with the right outer filter holder portion 124*f* and a left engagement portion 130*d* configured to engage with the left outer filter holder portion 124*g* are arranged on the filter frame 130*b*. The prefilter 130 is attached to the filter holder 124 by inserting the left engagement portion 130*d* in the left outer filter holder portion 124*g*, contacting the filter frame 130*b* with the rear surface of the filter holder 124, and then engaging the right engagement portion 130*c* with the right outer filter holder portion 124*f*. In the state where the filter holder 124 has the prefilter 130 attached thereto, the cloth filter 130*a* covers the sponge filter 128 from behind.

Figure 18:
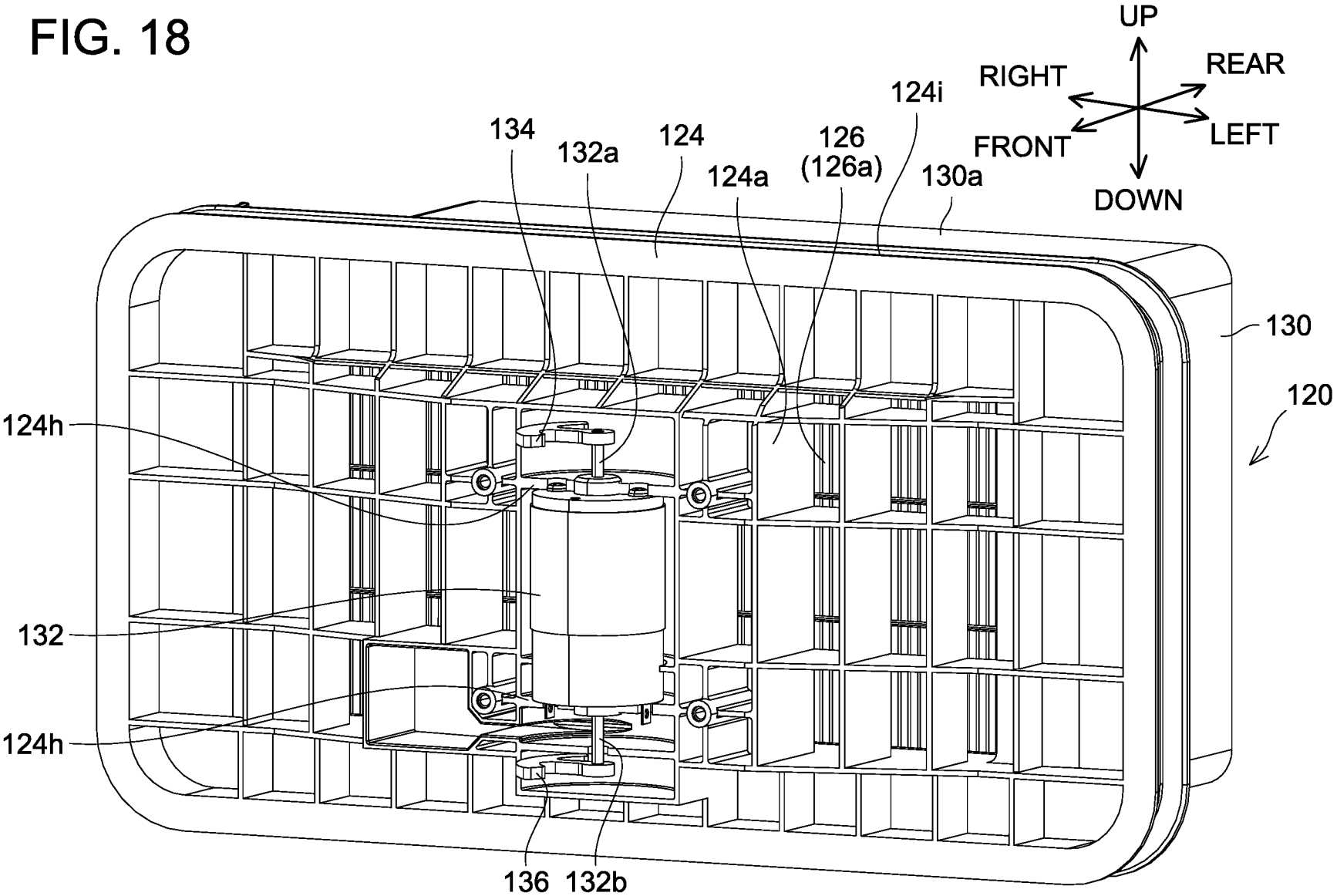
FIG. 18 is a perspective view of the filter unit 120 of the cleaning machine 2 according to the embodiment with a motor cover 138 removed, as viewed from the upper left front side.

As illustrated in FIG. 18, a filter motor 132 is attached to the motor holder portion 124*h* of the filter holder 124. The filter motor 132 is, for example, a DC brush motor. The filter motor 132 may be a DC brushless motor or an AC motor. The filter motor 132 comprises an upper output shaft 132*a* projecting upward and a lower output shaft 132*b* projecting downward. An upper eccentric weight 134 is fixed to the upper output shaft 132*a*. A lower eccentric weight 136 is fixed to the lower output shaft 132*b*. A motor cover 138 (see FIG. 16) covers the filter motor 132, the upper eccentric weight 134, and the lower eccentric weight 136 from the front. The motor cover 138 is fixed to the filter holder 124.

As illustrated in FIG. 16, a sealing material 140 is attached to the seal holder portion 124*i*. The sealing material 140 is substantially square in cross-section, is a loop in entire shape, is a rubber material, and surrounds outer side surface of the filter holder 124. An inlet hole 114*b* that is open rearward is defined in the duct 114. A filter unit attaching member 114*c* to which the filter unit 120 can be attached is arranged at the edge of the inlet hole 114*b* of the duct 114. The filter unit 120 is attached to the filter unit attaching member 114*c* via the sealing material 140.

When the fan unit 122 suctions air, dust adheres to a rear surface of the cloth filter 130*a* of the prefilter 130. Accumulation of dust on the cloth filter 130*a* hinders smooth air suction of the fan unit 122. While being actuated, the filter motor 132 vibrates due to rotation of the upper eccentric weight 134 (see FIG. 18) and the lower eccentric weight 136 (see FIG. 18), and thus the filter holder 124, the main filter 126, the sponge filter 128, and the prefilter 130 vibrate with respect to the duct 114. The dust adhering to the rear surface of the cloth filter 130*a* is thereby shaken off and ends up in the dust container 13. The sealing material 140 being interposed between the filter holder 124 and the duct 114 helps the filter holder 124 vibrate due to the vibration of the filter motor 132.

The duct 114 comprises an air flow path 114*d* in which air that has flowed through the filter unit 120 flows from right to left. An outlet 114*e* from which air flows out from the duct 114 is defined in the vicinity of a left end of the air flow path 114*d*. The outlet 114*e* is open forward.

The fan unit 122 comprises an electric-powered fan 142 and a noise reduction box 144. The electric-powered fan 142 is arranged to face the outlet 114*e* of the duct 114. The electric-powered fan 142 comprises a fan motor 146 and a centrifugal fan 148. The fan motor 146 is, for example, an DC brushless motor of inner rotor type. The fan motor 146 may be a motor of outer rotor type, an AC brush motor, or an AC motor. An output shaft 146*a* of the fan motor 146 extends in the front-rear direction. The centrifugal fan 148 is fixed to the output shaft 146*a*. When the fan motor 146 is actuated, the centrifugal fan 148 rotates and air in the duct 114 is thereby suctioned out through the outlet 114*e*.

Figure 19:
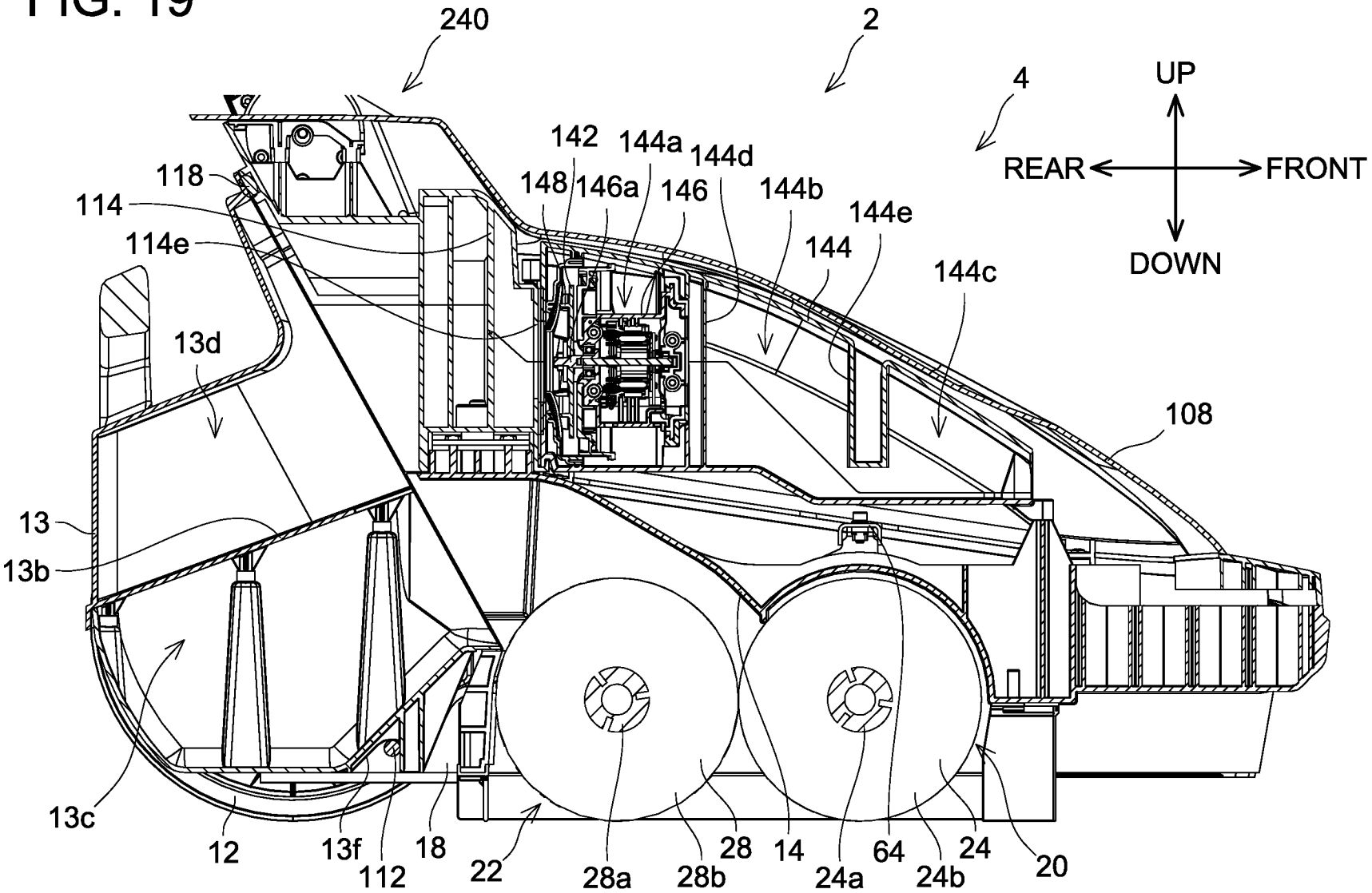
FIG. 19 is a vertical cross-sectional view in the vicinity of the fan unit 122 of the cleaning machine 2 according to the embodiment.

As illustrated in FIG. 19, the noise reduction box 144 comprises a fan accommodating chamber 144*a*, a first extension chamber 144*b*, and a second extension chamber 144*c*. The electric-powered fan 142 is housed in the fan accommodating chamber 144*a*. A first partition wall 144*d* separates the fan accommodating chamber 144*a* from the first extension chamber 144*b*. The first partition wall 144*d* extends in the up-down direction from an upper inner surface to a lower inner surface of the noise reduction box 144. Further, as illustrated in FIG. 16, the first partition wall 144*d* extends leftward from a right inner surface of the noise reduction box 144 in the left-right direction. There is a space between a left end of the first partition wall 144*d* and a left inner surface of the noise reduction box 144. As illustrated in FIG. 19, a second partition wall 144*e* separates the first extension chamber 144*b* from the second extension chamber 144*c*. As illustrated in FIG. 16, the second partition wall 144*e* extends in the left-right direction from the right inner surface to the left inner surface of the noise reduction box 144. Further, as illustrated in FIG. 19, the second partition wall 144*e* extends downward from the upper inner surface of the noise reduction box 144 in the up-down direction. There is a space between a lower end of the second partition wall 144*e* and the lower inner surface of the noise reduction box 144. A front end of the second extension chamber 144*c* is open to a space between the chassis 14 of the body unit 4 and the body cover 108. The air suctioned out from the duct 114 by the electric-powered fan 142 flows through the fan accommodating chamber 144*a*, the first extension chamber 144*b*, and the second extension chamber 144*c*, and then flows into the body unit 4. This air, which has flowed into the body unit 4, flows to the outside from seams between the chassis 14 and the body cover 108. Since the noise reduction box 144 comprises the first extension chamber 144*b* and the second extension chamber 144*c*, it can reduce noise caused by the actuation of the electric-powered fan 142 and thus prevent emission of loud noise to the outside of the body unit 4.

(Side Brush 150)

As illustrated in FIG. 1, a side brush 150 is disposed in a right front portion of the body unit 4. The cleaning machine 2 can transfer, for example, trash by a wall to the front main brush 20 and the rear main brush 22 by rotating the side brush 150 on the working plane.

Figure 20:
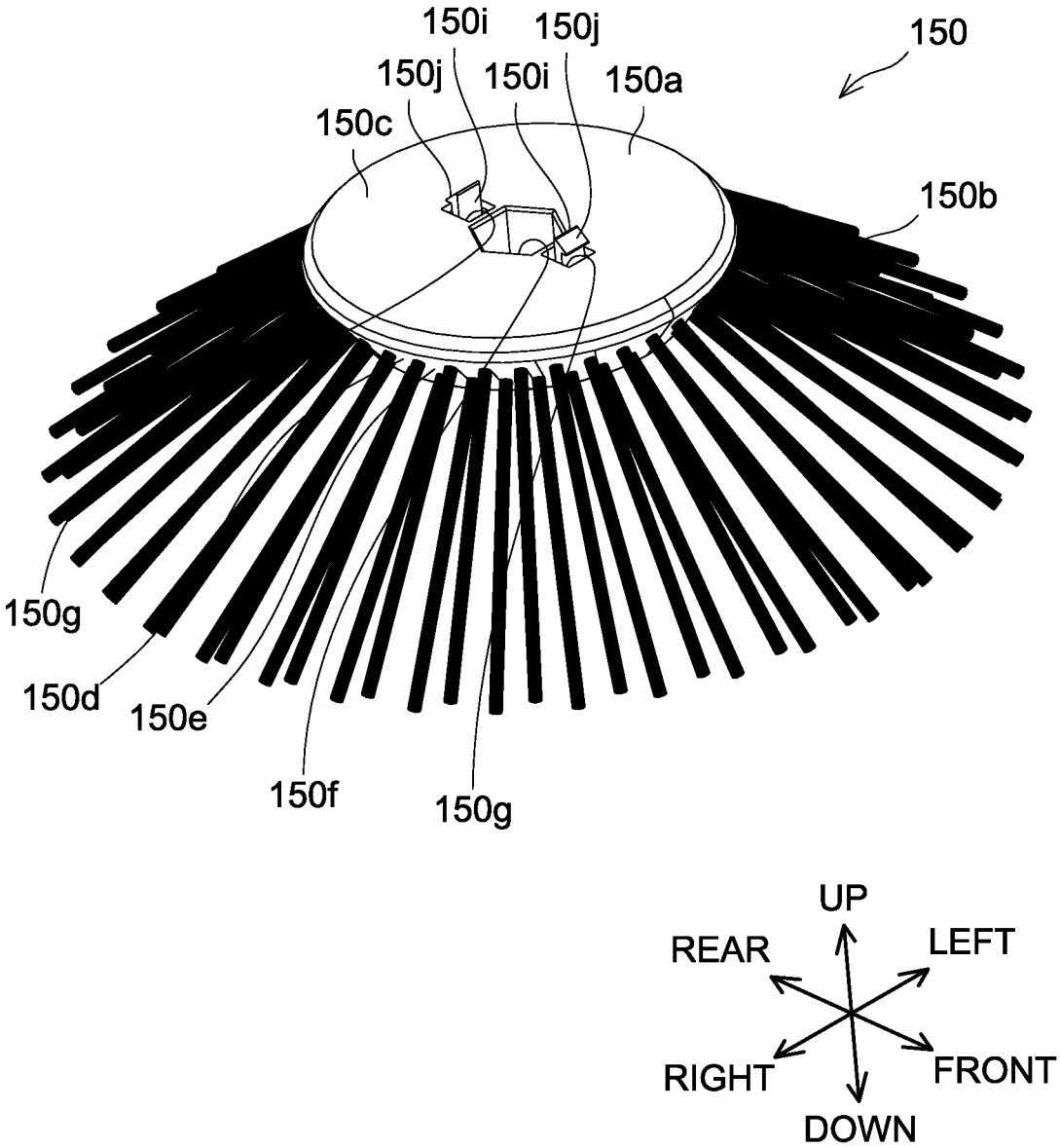
FIG. 20 is a perspective view of a side brush 150 of the cleaning machine 2 according to the embodiment, as viewed from the upper right front side.
Figure 21:
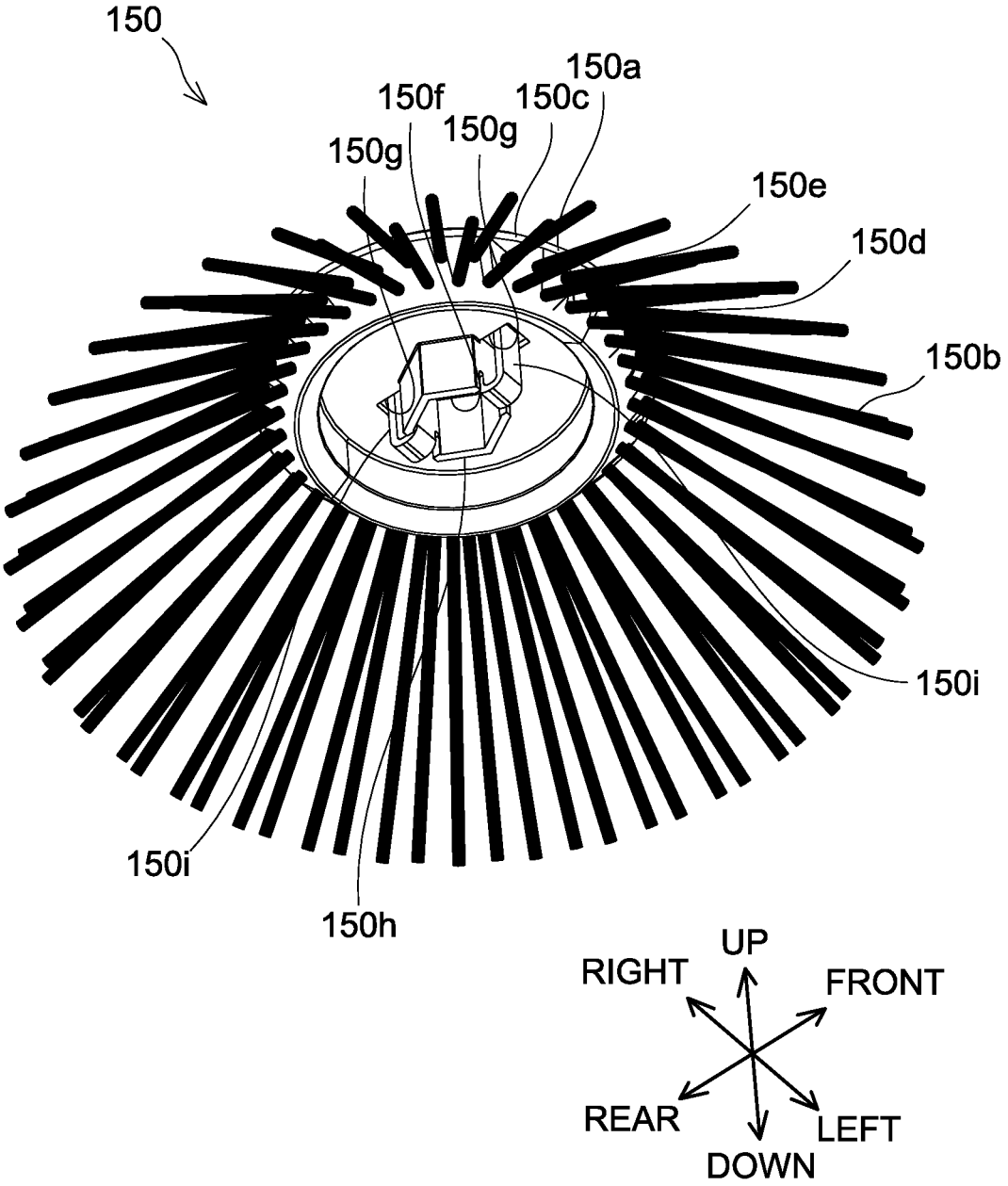
FIG. 21 is a perspective view of the side brush 150 of the cleaning machine 2 according to the embodiment, as viewed from the lower right front side.

As illustrated in FIG. 20, the side brush 150 is a bevel brush and comprises a brush cup 150*a* and brush bristles 150*b*. The brush cup 150*a* comprises a substantially disk-shaped base 150*c* and a support 150*d* projecting downward from the vicinity of a radially outer edge of the base 150*c*. The support 150*d* comprises a bevel surface 150*e* that bevels with respect to an axis passing the center of the base 150*c*. The brush bristles 150*b* are implanted in the bevel surface 150*e* of the brush cup 150*a*. An engagement hole 150*f* and a pair of through holes 150*g*, which are opposed to each other with the engagement hole 150*f* interposed therebetween, are defined in the base 150*c*. The engagement hole 150*f* is, for example, hexagonal. For example, one of the pair of through holes 150*g* is arranged to face one side of the engagement hole 150*f* and the other through hole 150*g* is arranged to face the side that is opposed to the one side of the engagement hole 150*f*. As illustrated in FIG. 21, an outer engagement tube 150*h* and a pair of operation pieces 150*i* are arranged at the base 150*c*. The outer engagement tube 150*h* projects downward from the edge of the engagement hole 150*f*, and the operation pieces 150*i* bend radially outward at a lower end of the outer engagement tube 150*h* and extend upward. The outer engagement tube 150*h* is, for example, hexagonal in cross-section. Each of the operation pieces 150*i* passes through a corresponding through hole 150*g* from below upward. As illustrated in FIG. 20, an engagement claw 150*j* is arranged at an upper end of each operation piece 150*i*. The side brush 150 is attached to a side brush unit 152 (see FIG. 22) disposed in the right front portion of the body unit 4.

Figure 22:
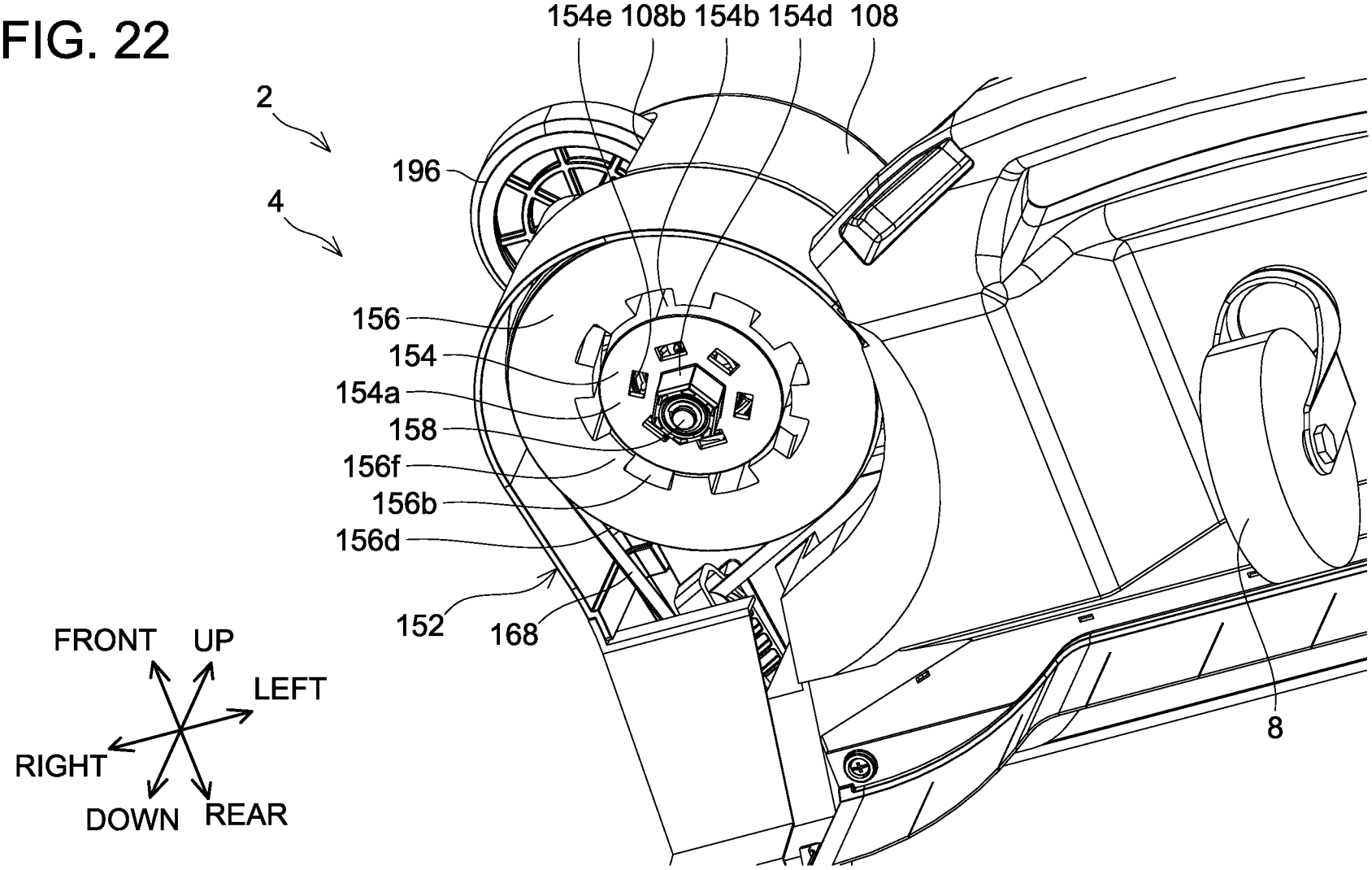
FIG. 22 is a perspective view in the vicinity of the side brush unit 152 of the cleaning machine 2 according to the embodiment with the side brush 150 removed, as viewed from the lower left front side.
Figure 23:
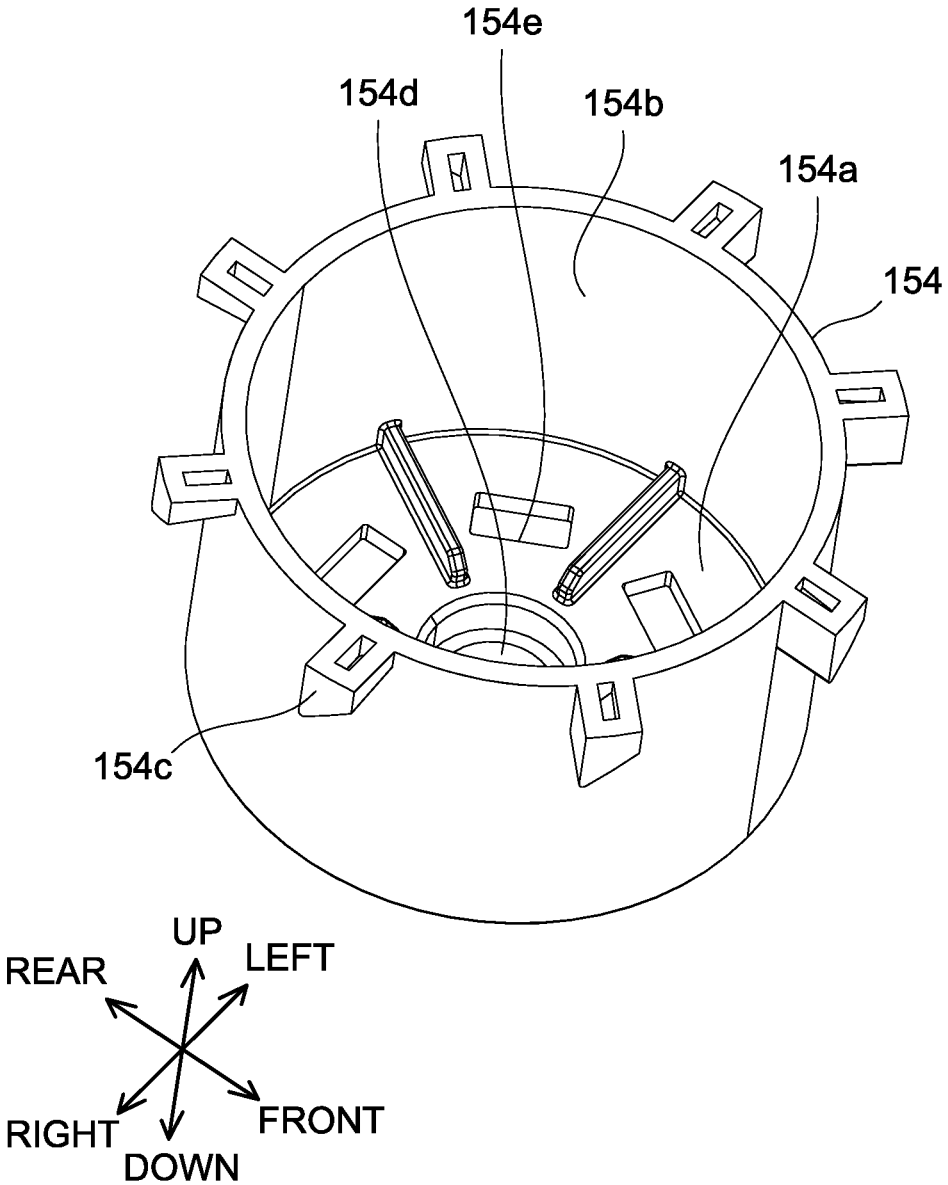
FIG. 23 is a perspective view of a brush holder 154 of the cleaning machine 2 according to the embodiment, as viewed from the upper right front side.

As illustrated in FIG. 22, the side brush unit 152 comprises a brush holder 154, a brush pulley 156, and a movable shaft 158. As illustrated in FIG. 23, the brush holder 154 comprises a substantially disk-shaped bottom plate 154*a* and a side plate 154*b* having a substantially hollow cylinder shape extending upward from a radially outer edge of the bottom plate 154*a*. A plurality of clutch claws 154*c* projecting radially outward is arranged at an upper end of the side plate 154*b*. The clutch claws 154*c* are arranged circumferentially at intervals of a predetermined angle (e.g., at intervals of 45 degrees). As illustrated in FIG. 22, an inner engagement tube 154*d* projecting downward and a plurality of engagement holes 154*e* surrounding the inner engagement tube 154*d* are arranged at the bottom plate 154*a*. For example, an inner surface of the inner engagement tube 154*d* is circular in cross-section and an outer surface thereof is hexagonal in cross-section. The cross-sectional shape of the outer surface of the inner engagement tube 154*d* corresponds to the shape of the engagement hole 150*f* of the side brush 150. The engagement holes 154*e* are arranged circumferentially at intervals of a predetermined angle (e.g., at intervals of 60 degrees). For example, each of the engagement holes 154*e* is arranged to face a corresponding side of the outer surface of the inner engagement tube 154*d*. The engagement claws 150*j* of the pair of the operation pieces 150*i* of the side brush 150 engage with two of the engagement holes 154*e*. Hereinafter, the engagement claws 150*j* of the side brush 150 and the plurality of engagement holes 154*e* of the brush holder 154 may be collectively referred to as a side brush engagement mechanism 151, and the outer engagement tube 150*h* of the side brush 150 and the inner engagement tube 154*d* of the brush holder 154 may be collectively referred to as a side brush fitting mechanism 153.

Figure 24:
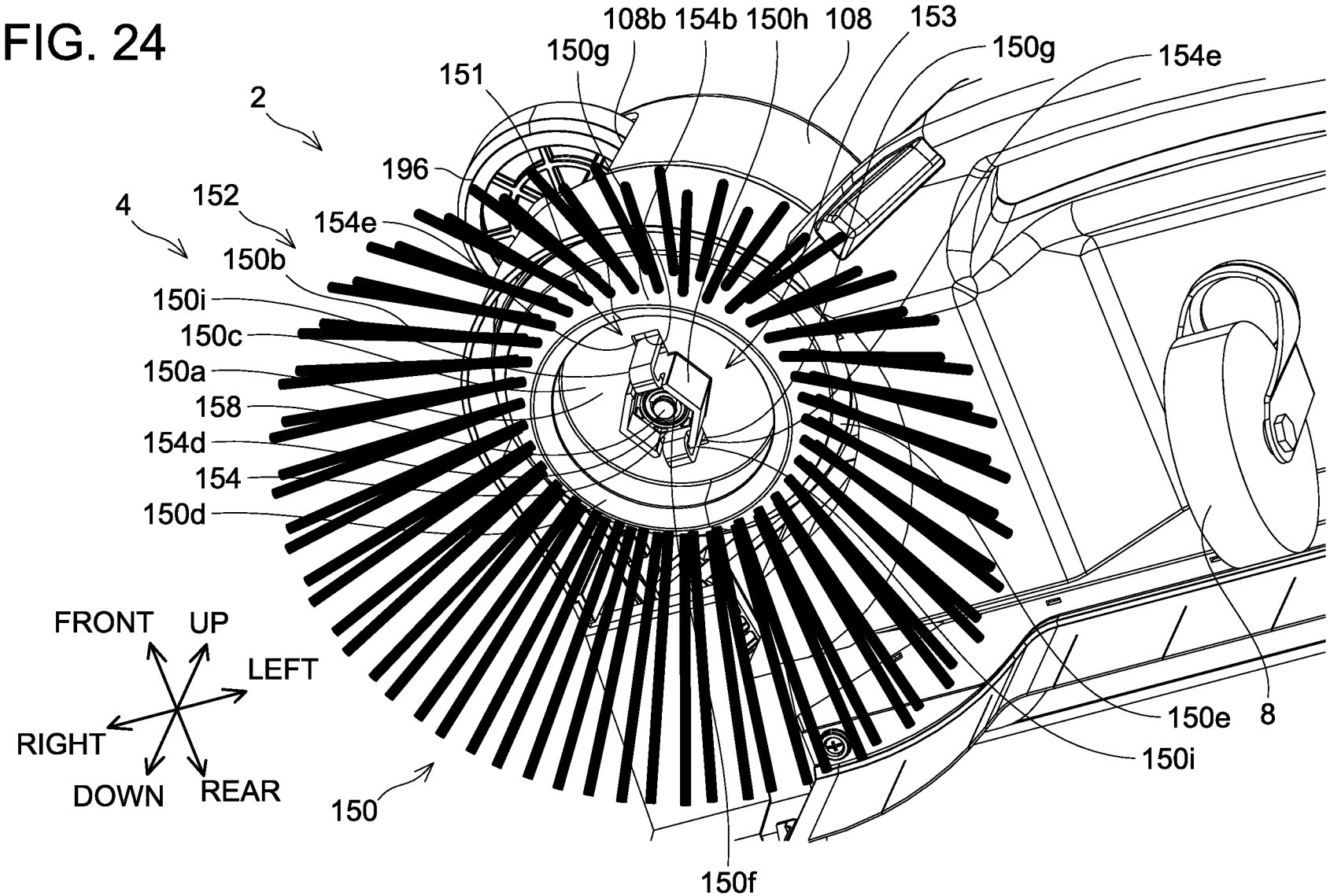
FIG. 24 is a perspective view in the vicinity of the side brush unit 152 of the cleaning machine 2 according to the embodiment with the side brush 150 attached, as viewed from the lower left front side.

When the side brush 150 is to be attached to the brush holder 154, the side brush 150 is aligned with the brush holder 154 and then the inner engagement tube 154*d* of the brush holder 154 is inserted into the engagement hole 150*f* of the side brush 150, as illustrated in FIG. 24. Then, when the side brush 150 is moved upward with respect to the brush holder 154, the engagement claws 150*j* of the pair of operation pieces 150*i* engage with the corresponding engagement holes 154*e* of the plurality of the engagement holes 154*e*, thereby fixing the side brush 150 to the brush holder 154. Since the engagement hole 150*f* and the inner engagement tube 154*d* both are hexagonal in the present embodiment, the pair of operation pieces 150*i* can be aligned with two of the engagement holes 154*e* by inserting the inner engagement tube 154*d* into the engagement hole 150*f*. Then, by simply moving the side brush 150 upward toward the brush holder 154 in that state, the pair of operation pieces 150*i* can be engaged with the corresponding engagement holes 154*e* of the plurality of engagement holes 154*e*. Further, since the engagement hole 150*f* and the inner engagement tube 154*d* both are hexagonal, the engagement hole 150*f* can be aligned with the inner engagement tube 154*d* just by rotating the side brush 150 by 60 degrees at most with respect to the brush holder 154. Thus, the engagement hole 150*f* can be aligned with the inner engagement tube 154*d* without rotating the side brush 150 by a large angle with respect to the brush holder 154, facilitating the alignment of the engagement hole 150*f* with the inner engagement tube 154*d* even when the user cannot see the brush holder 154 from below.

In the state where the brush holder 154 has the side brush 150 attached thereto, an inner surface of the outer engagement tube 150*h* of the side brush 150 is engaged with the entirety of the outer surface of the inner engagement tube 154*d* of the brush holder 154. This configuration can reduce occurrence of stress concentration when the brush holder 154 transmits rotation to the side brush 150.

When the side brush 150 is to be detached from the brush holder 154, the pair of operation pieces 150*i* is pressed radially inward below the base 150*c* of the side brush 150, thereby disengaging the engagement claws 150*j* of the pair of operation pieces 150*i* from the engagement holes 154*e*. Then, the side brush 150 is moved downward with respect to the brush holder 154 to pull the inner engagement tube 154*d* out from the engagement hole 150*f*. As a result, the side brush 150 is detached from the brush holder 154.

(Side Brush Unit 152)

Figure 25:
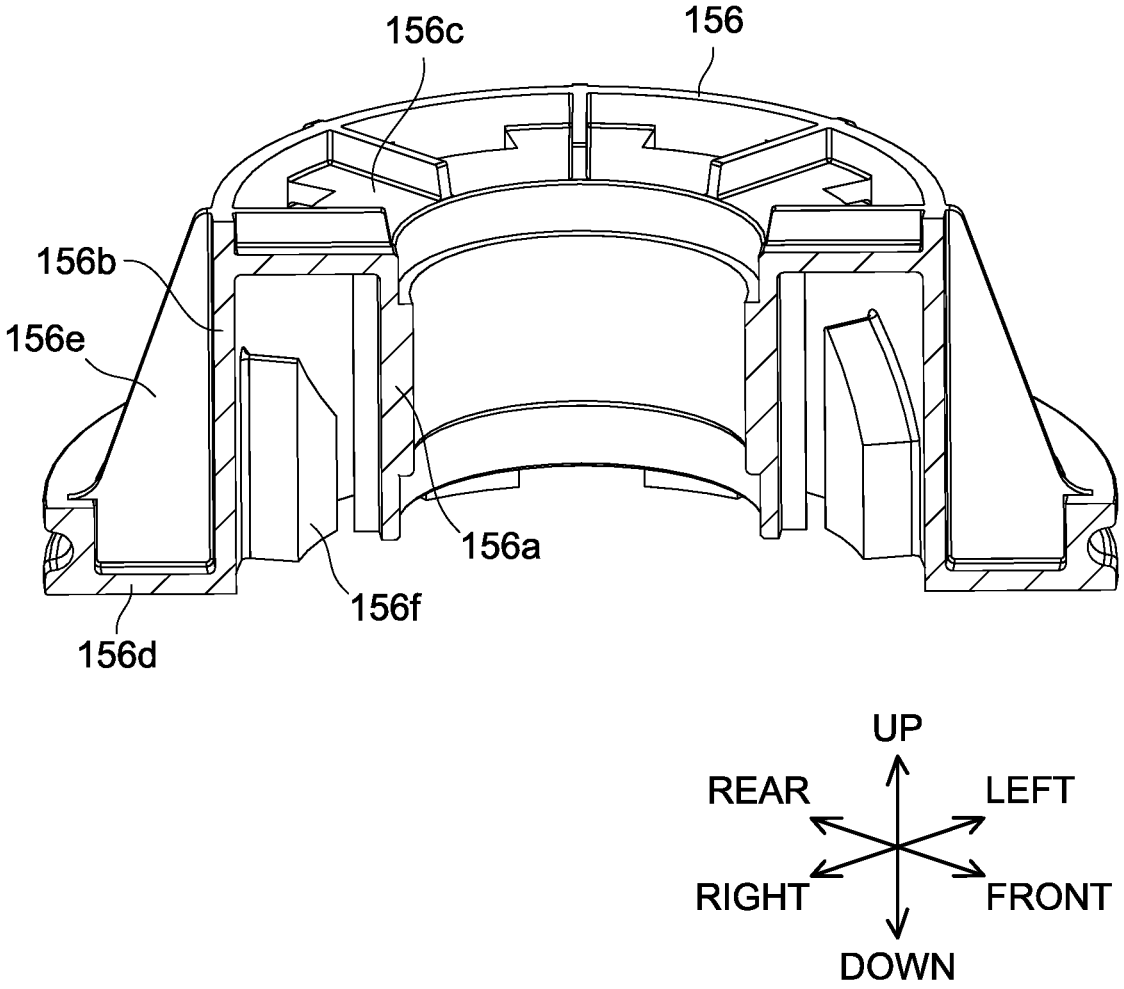
FIG. 25 is a perspective cross-sectional view of a brush pulley 156 of the cleaning machine 2 according to the embodiment, as viewed from the upper right front side.

As illustrated in FIG. 25, the brush pulley 156 comprises an inner wall 156*a* having a substantially hollow cylinder shape, an outer wall 156*b* having a substantially hollow cylinder shape, surrounding the inner wall 156*a*, and arranged coaxially with the inner wall 156*a*, a connector 156*c* connecting an upper end of the inner wall 156*a* to an upper end of the outer wall 156*b*, and a drum 156*d* projecting radially outward from a lower end of the outer wall 156*b*. A plurality of reinforcement ribs 156*e* is arranged between an outer surface of the outer wall 156*b* and an upper surface of the drum 156*d*. A plurality of clutch ribs 156*f* projecting radially inward is arranged on an inner surface of the outer wall 156*b*. The clutch ribs 156*f* extend upward from the lower end of the outer wall 156*b*. The clutch ribs 156*f* are arranged corresponding to the clutch claws 154*c* (see FIG. 23) of the brush holder 154 and arranged circumferentially at intervals of a predetermined angle (e.g., at intervals of 45 degrees).

Figure 26:
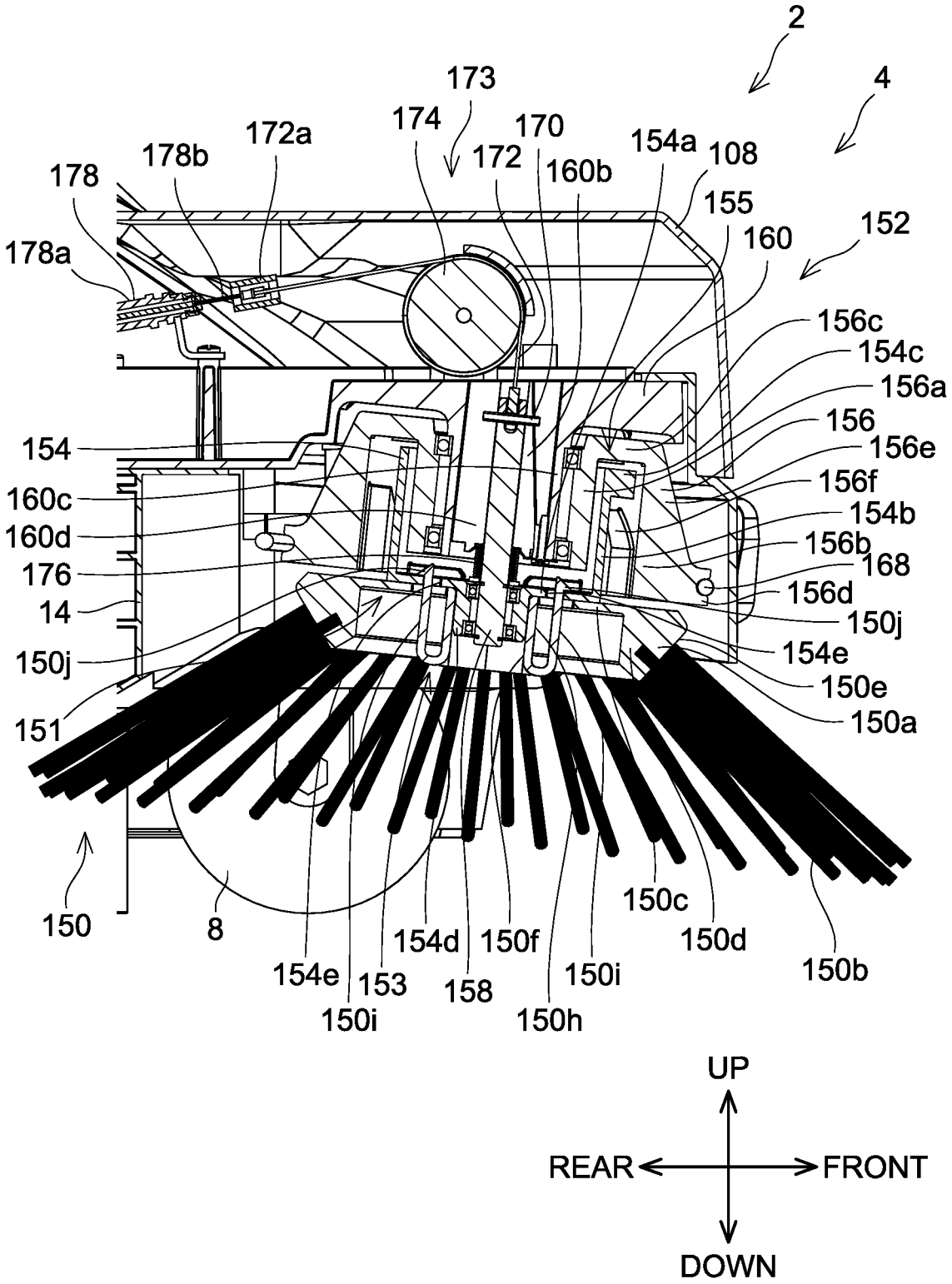
FIG. 26 is a vertical cross-sectional view in the vicinity of the side brush unit 152 of the cleaning machine 2 according to the embodiment, with the side brush 150 moved upward.
Figure 27:
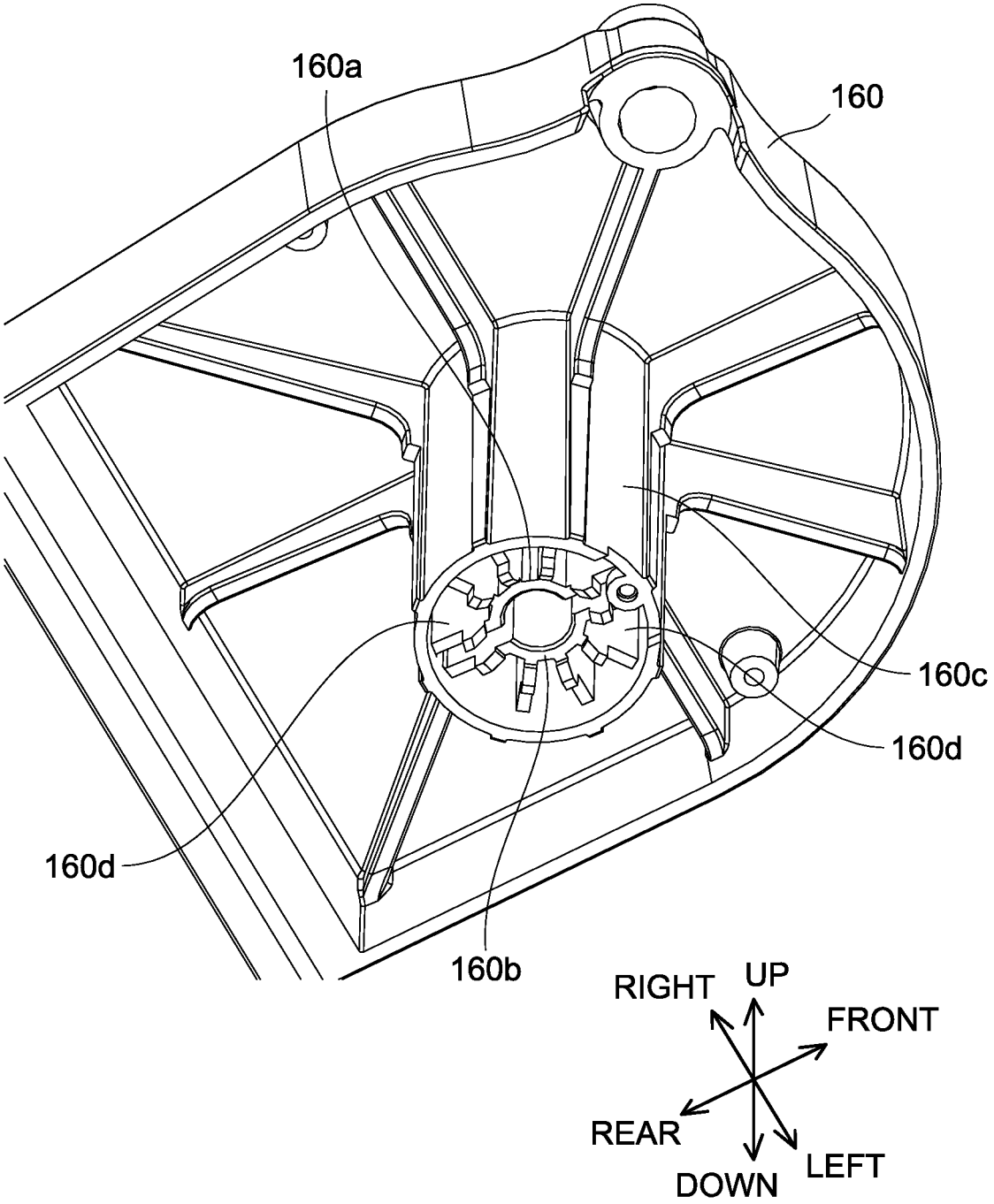
FIG. 27 is a perspective view of a front portion of a brush base 160 of the cleaning machine 2 according to the embodiment, as viewed from the lower left front side.

As illustrated in FIG. 26, the brush pulley 156 is attached to a brush base 160 fixed to the chassis 14. As illustrated in FIG. 27, the brush base 160 comprises a first inner wall 160*a* having a substantially hollow half cylinder shape, a second inner wall 160*b* having a substantially hollow half cylinder shape, and an outer wall 160*c* having a substantially hollow cylinder shape and surrounding the first inner wall 160*a* and the second inner wall 160*b*. The first inner wall 160*a* and the second inner wall 160*b* have substantially the same shape except that they are mirror reversed. The first inner wall 160*a*, the second inner wall 160*b*, and the outer wall 160*c* are arranged coaxially. A plurality of reinforcement ribs 160*d* is arranged between the first inner wall 160*a* and the outer wall 160*c* and between the second inner wall 160*b* and the outer wall 160*c*.

As illustrated in FIG. 26, the inner wall 156*a* of the brush pulley 156 is rotatably supported by the outer wall 160*c* of the brush base 160. Further, the side plate 154*b* of the brush holder 154 is inserted between the inner wall 156*a* and the outer wall 156*b* of the brush pulley 156 from below the brush pulley 156.

As illustrated in FIG. 9, a first guide pulley 162 and a second guide pulley 164 are disposed at the brush base 160. The first guide pulley 162 and the second guide pulley 164 are rotatably supported by the brush base 160. A relay pulley 166 is fixed to the driven shaft 40 of the right front brush attaching member 32. A sub drive belt 168 is strapped on the drum 156*d* of the brush pulley 156, the first guide pulley 162, the second guide pulley 164, and the relay pulley 166. The sub drive belt 168 is strapped on an upper portion of the relay pulley 166 onto an upper portion of the first guide pulley 162, on the upper portion of the first guide pulley 162 on to a right portion of the drum 156*d*, on a rear portion of the drum 156*d* on to a front portion of the second guide pulley 164, and then on a right portion of the second guide pulley 164 on to a lower portion of the relay pulley 166. When the relay pulley 166 is rotated clockwise by the motor 74 in the right-side view of the right brush plate 60, the brush pulley 156 is rotated counterclockwise in the top view of the brush base 160. Hereinafter, the drive pulley 78, the front driven pulley 82, the main drive belt 92, the driven shaft 40, the relay pulley 166, the brush pulley 156, and the sub drive belt 168 may be collectively referred to as a side brush rotation transmitting mechanism 163.

As illustrated in FIG. 26, the movable shaft 158 has a substantially solid cylinder shape. The vicinity of a lower end of the movable shaft 158 passes through the inner engagement tube 154*d* of the brush holder 154 and is rotatably supported by the inner engagement tube 154*d* of the brush holder 154. Further, the movable shaft 158 is inserted between the first inner wall 160*a* (see FIG. 27) and the second inner wall 160*b* from below the brush base 160 and is slidably supported by the first inner wall 160*a* and the second inner wall 160*b*. A distal end of a shaft cable 172 is connected to an upper end of the movable shaft 158 via a connection pin 170. The shaft cable 172 is strapped on a guide pulley 174. A cable connector 172*a* is disposed at a proximal end of the shaft cable 172. The guide pulley 174 is rotatably supported by the brush base 160. A compression spring 176 is attached to the movable shaft 158. The compression spring 176 biases the brush holder 154 downward with respect to the plurality of reinforcement ribs 160*d* of the brush base 160. Hereinafter, the movable shaft 158, the shaft cable 172, the cable connector 172*a*, and the guide pulley 174 may be collectively referred to as a side brush moving mechanism 173.

When the proximal end of the shaft cable 172 is pulled rearward as illustrated in FIG. 26, the movable shaft 158 and the brush holder 154 are pulled upward against the biasing force of the compression spring 176. In this case, tips of the brush bristles 150*b* of the side brush 150 are positioned higher than the lower end of the front wheel 8, and thus the side brush 150 is positioned above the working plane. Further, the clutch claws 154*c* of the brush holder 154 are positioned higher than the clutch ribs 156*f* of the brush pulley 156, and thus the clutch claws 154*c* are not engaged with the clutch ribs 156*f*. Therefore, the brush holder 154 and the side brush ISO are not rotated even when the brush pulley 156 is rotated by the motor 74. The position of the brush holder 154 illustrated in FIG. 26 may be referred to as a distant position.

Figure 28:
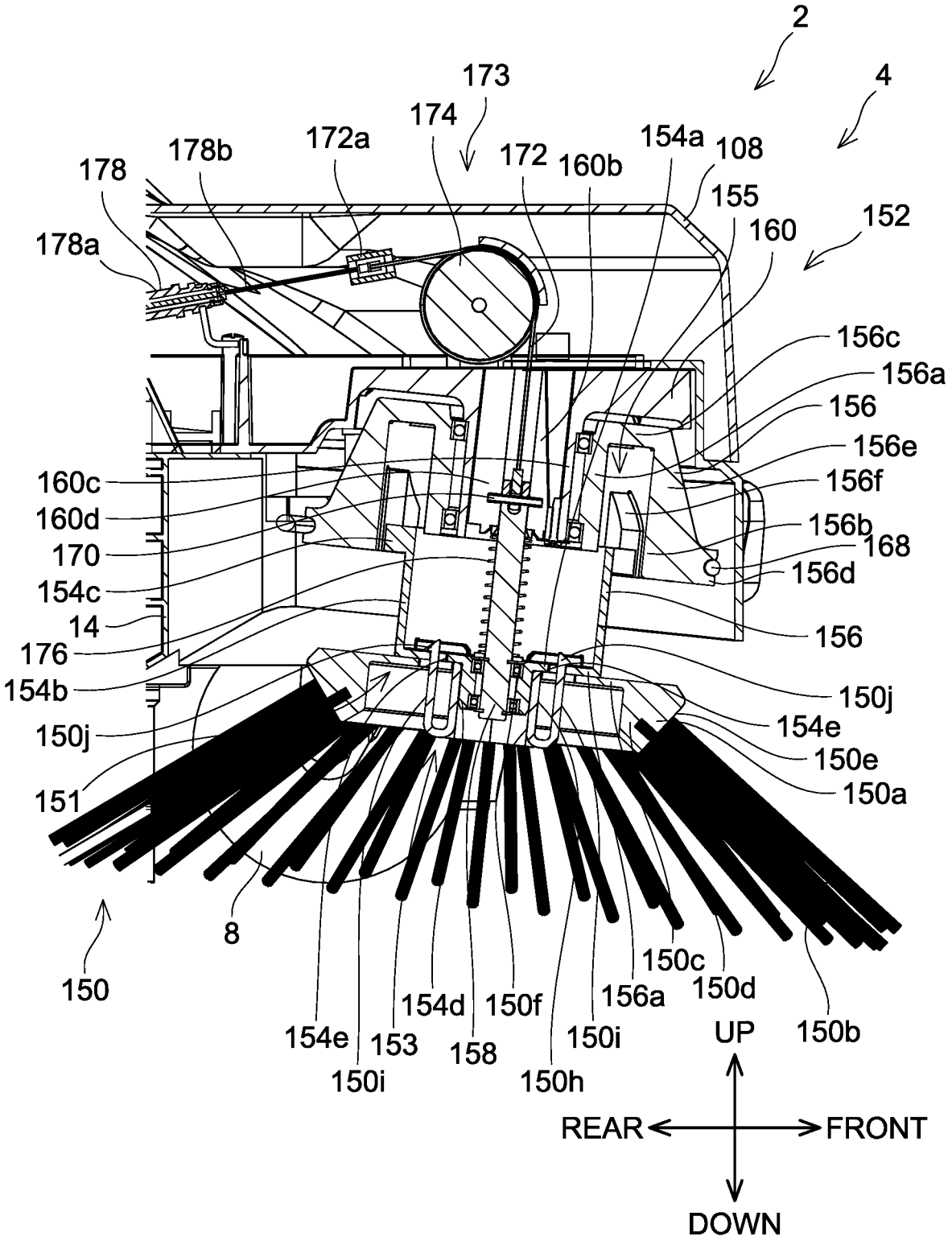
FIG. 28 is a vertical cross-sectional view in the vicinity of the side brush unit 152 of the cleaning machine 2 according to the embodiment, with the side brush 150 moved downward.

When the proximal end of the shaft cable 172 is pushed forward as illustrated in FIG. 28, the movable shaft 158 and the brush holder 154 are pushed downward by the biasing force of the compression spring 176. In this case, the tips of the brush bristles 150*b* of the side brush 150 are positioned lower than the lower end of the front wheel 8, and thus the side brush 150 is pressed against the working plane. Further, the clutch claws 154*c* of the brush holder 154 are positioned substantially at the same height in the up-down direction as the clutch ribs 156*f* of the brush pulley 156, and thus the clutch claws 154*c* engage with the clutch ribs 156*f*. Therefore, when the brush pulley 156 is rotated by the motor 74, the brush holder 154 and the side brush 150 are rotated as well. The position of the brush holder 154 illustrated in FIG. 28 may be referred to as an adjacent position. Hereinafter, the clutch claws 154*c* of the brush holder 154 and the clutch ribs 156*f* of the brush pulley 156 may be collectively referred to as a clutch mechanism 155.

A projection (not illustrated) that interferes with a rotation trajectory of the brush bristles 150*b* when the brush holder 154 is at the distant position and does not interfere with the rotation trajectory of the brush bristles 150*b* when the brush holder 154 is at the adjacent position may be arranged on the chassis 14. When the brush holder 154 is moved from the adjacent position to the distant position with the side brush 150 rotating, the side brush 150 continues to rotate by inertia for a while after the clutch claws 154*c* and the clutch ribs 156*f* of the clutch mechanism 155 have been disengaged from each other. The continued rotation of the side brush 150 after the brush holder 154 has moved to the distant position may cause the user to misunderstand that the clutch mechanism 155 is not functioning. With the above projection arranged on the chassis 14, when the brush holder 154 is moved from the adjacent position to the distant position with the side brush 150 rotating, the brush bristles 150*b* hit the projection repeatedly after the clutch claws 154*c* and the clutch ribs 156*f* of the clutch mechanism 155 have been disengaged from each other, thereby more promptly stopping the inertial rotation of the side brush 150. It is thus possible to prevent the user from misunderstanding that the clutch mechanism 155 is not functioning. Further, since the flexible brush bristles 150*b* hit the projection repeatedly, the chassis 14 and the side brush 150 can avoid being damaged by this hitting motion. The above projection may be shaped to guide trash collected by the side brush 150 toward the front main brush 20 and the rear main brush 22.

As illustrated in FIG. 9, a distal end of a brush operation cable 178 is attached to the brush base 160. The brush operation cable 178 comprises an outer cable 178*a*, and an inner cable 178*b* housed within the outer cable 178*a* and configured to advance and recede with respect to the outer cable 178*a*. A distal end of the outer cable 178*a* is fixed to the brush base 160. A distal end of the inner cable 178*b* is connected to the cable connector 172*a* at the proximal end of the shaft cable 172. The brush operation cable 178 extends to a side brush operation member 180 disposed on the handle unit 6 (see FIG. 1).

Figure 29:
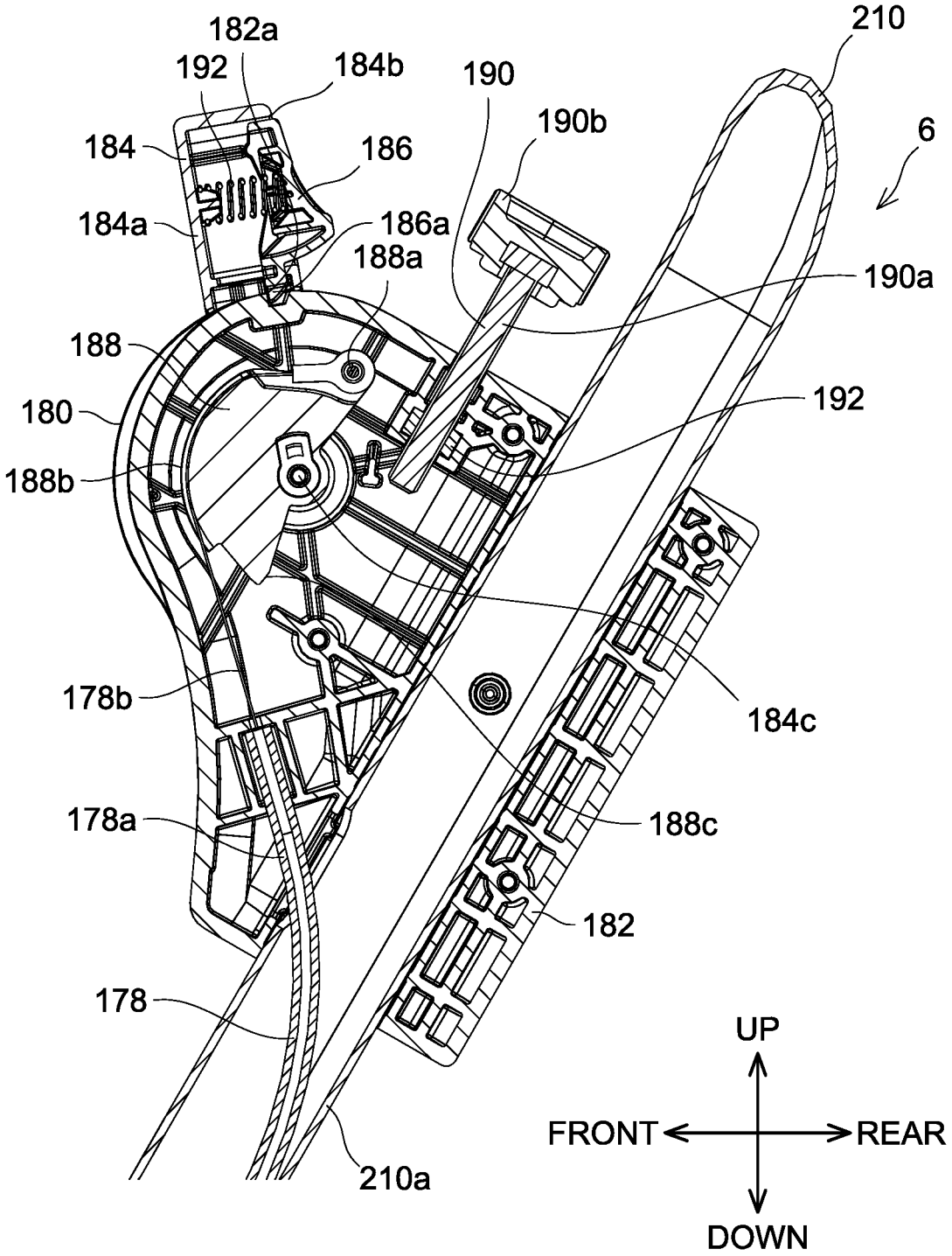
FIG. 29 is a vertical cross-sectional view in the vicinity of aside brush operation member 180 of the cleaning machine 2 according to the embodiment, with a side brush lifting lever 184 raised.
Figure 30:
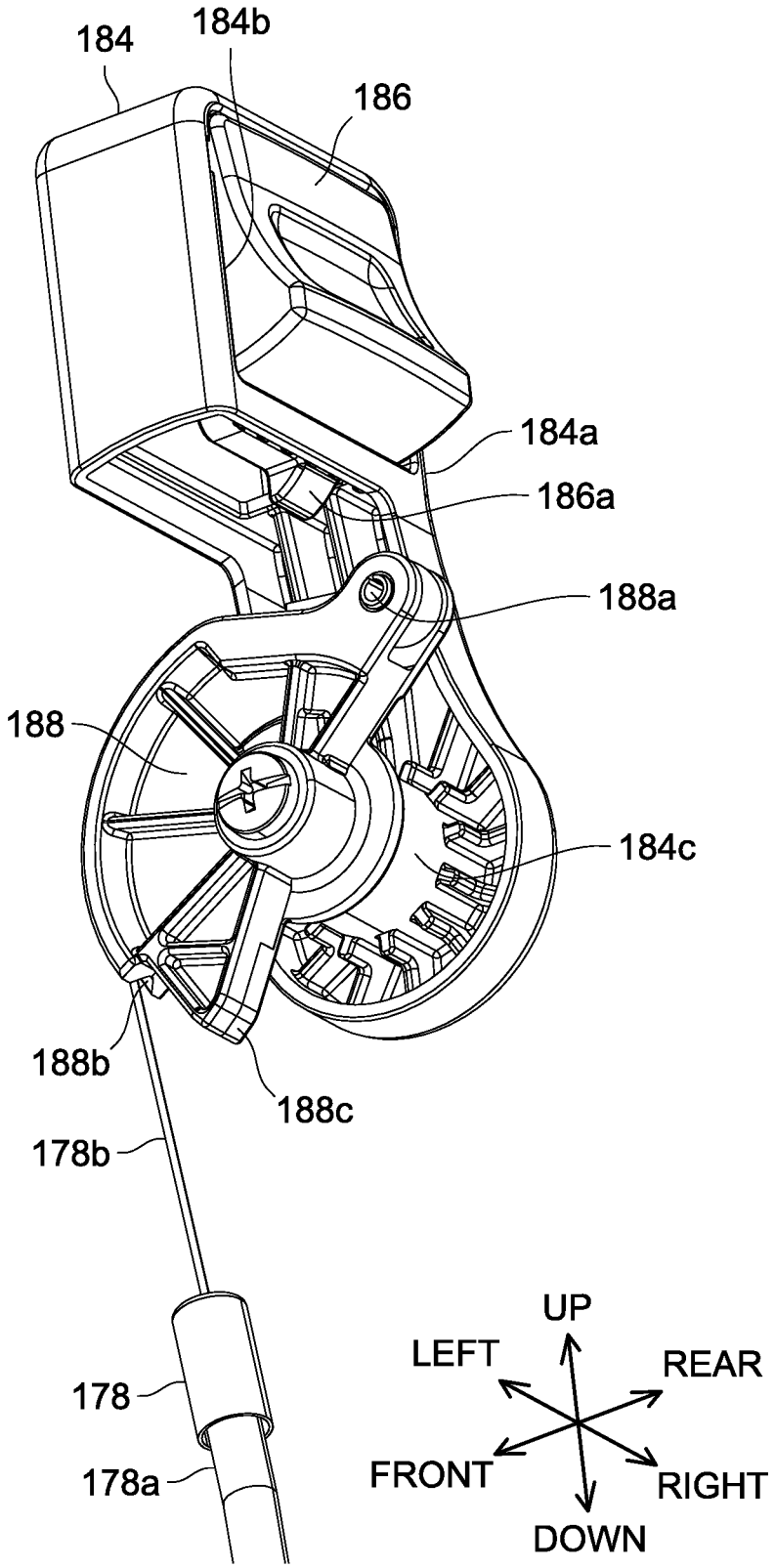
FIG. 30 is a perspective view of a brush operation cable 178, the side brush lifting lever 184, a lock-off switch 186, and a cable holder 188 of the cleaning machine 2 according to the embodiment, as viewed from the lower left rear side.

As illustrated in FIG. 29, the side brush operation member 180 comprises a case 182, a side brush lifting lever 184, a lock-off switch 186, a cable holder 188, and an adjustment bolt 190. As illustrated in FIG. 30, the side brush lifting lever 184 comprises a lever body 184*a* positioned outside of the case 182, a switch support 184*b* positioned in an upper portion of the lever body 184*a*, and a pivot shaft 184*c* extending leftward from a lower left portion of the lever body 184*a* and penetrating the case 182 from the outside to the inside. The lever body 184*a* is supported by the case 182 via the pivot shaft 184*c* such that it is pivotable about a pivot axis, which is the left-right direction. The lock-out switch 186 is supported by the switch support 184*b* near an upper end of the lock-off switch 186 such that it is pivotable about a pivot axis, which is the left-right direction. As illustrated in FIG. 29, the lock-off switch 186 is biased rearward with respect to the lever body 184*a* by a compression spring 192 disposed inside the lever body 184*a*. An engagement claw 186*a* is disposed at a lower portion of the lock-off switch 186. An engagement groove 182*a* corresponding to the engagement claw 186*a* is defined in an outer surface of the case 182. When the side brush lifting lever 184 is raised to its fullest extent, the engagement claw 186*a* of the lock-off switch 186 engages with the engagement groove 182*a*. In this state, forward tilt of the side brush lifting lever 184 is restricted. When the user pushes in the lock-off switch 186, the engagement claw 186*a* of the lock-off switch 186 is disengaged from the engagement groove 182*a*, and thus forward tilt of the side brush lifting lever 184 is permitted.

The cable holder 188 is hosed within the case 182. As illustrated in FIG. 30, the cable holder 188 is fixed to the pivot shaft 184*c* of the side brush lifting lever 184. The cable holder 188 comprises a support 188*a* supporting a proximal end of the inner cable 178*b* of the brush operation cable 178 such that it is rotatable, a guide groove 188*b* for guiding the inner cable 178*b*, and a stopper 188*c*. As illustrated in FIG. 29, a proximal end of the outer cable 178*a* of the brush operation cable 178 is positioned within and fixed to the case 182.

Figure 31:
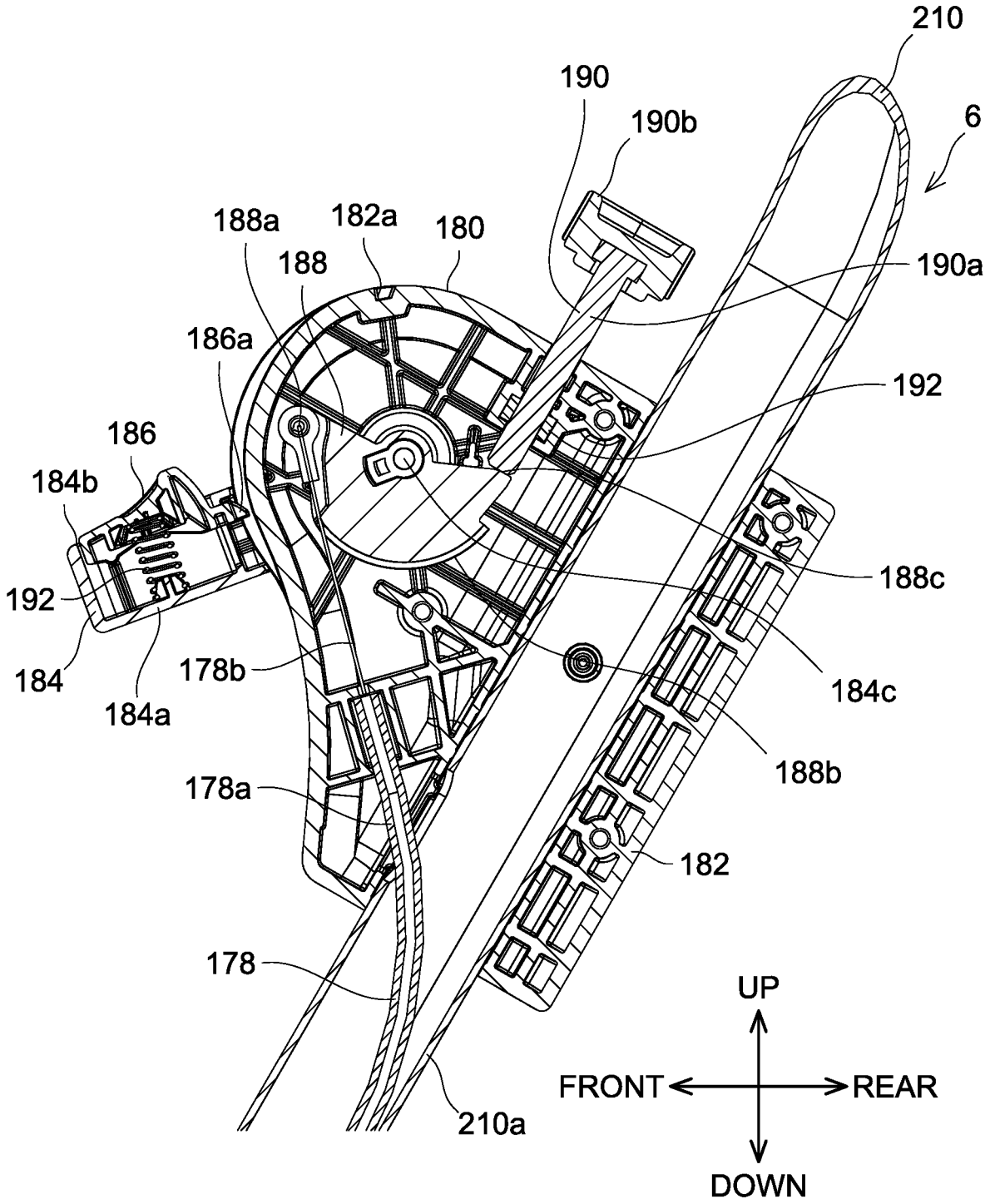
FIG. 31 is a vertical cross-sectional view in the vicinity of the side brush operation member 180 of the cleaning machine 2 according to the embodiment, with the side brush lifting lever 184 tilted.

The adjustment bolt 190 comprises a bolt 190*a* and an adjustment knob 190*b* fixed to a head of the bolt 190*a*. The bolt 190*a* penetrates the case 182 from the outside to the inside and is screwed in a nut 194 disposed within the case 182. The nut 194 is fixed to the case 182. As illustrated in FIG. 31, a tip of the bolt 190*a* contacts the stopper 188*c* of the cable holder 188 when the side brush lifting lever 184 is tilted, thereby restricting further tilt of the side brush lifting lever 184. The user can adjust the pivotable range of the side brush lifting lever 184 by rotating the adjustment knob 190*b* to adjust the position of the tip of the bolt 190*a*.

In the state where the side brush lifting lever 184 is raised rearward as illustrated in FIG. 29, the inner cable 178*b* is pulled out with respect to the outer cable 178*a* because the cable holder 188 is pulling the proximal end of the inner cable 178*b*. In this case, the proximal end of the shaft cable 172 is pulled rearward as illustrated in FIG. 26, and thus the side brush 150 is pulled upward against the biasing force of the compression spring 176. The position of the side brush lifting lever 184 illustrated in FIG. 29 may be referred to as a distant operation position.

In the state where the side brush lifting lever 184 is tilted forward as illustrated in FIG. 31, the inner cable 178*b* is tucked in with respect to the outer cable 178*a* because the cable holder 188 is not pulling the proximal end of the inner cable 178*b*. In this case, the proximal end of the shaft cable 172 is not pulled rearward as illustrated in FIG. 28, and thus the side brush 150 is pushed downward by the biasing force of the compression spring 176. The position of the side brush lifting lever 184 illustrated in FIG. 31 may be referred to as an adjacent operation position.

As illustrated in FIG. 9, a roller 196 is disposed at an upper right portion of the brush base 160. The roller 196 is supported by the brush base 160 such that it is rotatable about a rotation axis extending along the up-down direction. As illustrated in FIG. 1, a right front portion of the roller 196 projects to the outside of the body cover 108 through a roller opening 108*b* of the body cover 108. Therefore, when the body unit 4 accidentally hits a wall in front of or rightward of the body unit 4 while trash by the wall is collected by the side brush 150 and transferred to the front main brush 20 and the rear main brush 22, the roller 196 hits the wall before the body cover 108 does. This configuration can prevent damage to the wall and the body cover 108.

(Battery Box 198 and ECU 204)

As illustrated in FIG. 3, a battery box 198 is fixed to an upper surface of the chassis 14. As illustrated in FIG. 16, a plurality of battery attaching members 200 is disposed at the battery box 198. A battery pack 202 is detachably attached to each of the battery attaching members 200. Each of the battery packs 202 comprises a secondary battery cell (not illustrated) such as a lithium-ion battery cell.

As illustrated in FIG. 3, an ECU (Electronic Control Unit) 204 is fixed to the upper surface of the chassis 14. The ECU 204 comprises a control circuit board 206 and a case 208 housing the control circuit board 206. The control circuit board 206 comprises a microcontroller, a plurality of switching elements, etc., and controls operations of the headlight 9, the motor 74, the filter motor 132, and the fan motor 146 by controlling electric power supplied from the battery packs 202 to the headlight 9, the motor 74, the filter motor 132, and the fan motor 146.

(Handle Unit 6)

As illustrated in FIG. 1, the handle unit 6 comprises a substantially U-shaped handle frame 210 extending upward and rearward. The handle frame 210 is formed by bending a pipe that have substantially circular cross-sectional shapes. The handle frame 210 comprises a right linear portion 210*a* extending upward and rearward from an upper right rear portion of the body unit 4, a left linear portion 210*b* extending upward and rearward from an upper left rear portion of the body unit 4, an upper linear portion 210*c* positioned above and forward of upper ends of the right linear portion 210*a* and the left linear portion 210*b* and extending in the left-right direction, a right coupler 210*d* coupling the upper end of the right linear portion 210*a* to a right end of the upper linear portion 210*c*, and a left coupler 210*e* coupling the upper end of the left linear portion 210*b* to a left end of the upper linear portion 210*c*. The side brush operation member 180 is positioned in the vicinity of the upper end of the right linear portion 210*a* of the handle frame 210.

Figure 32:
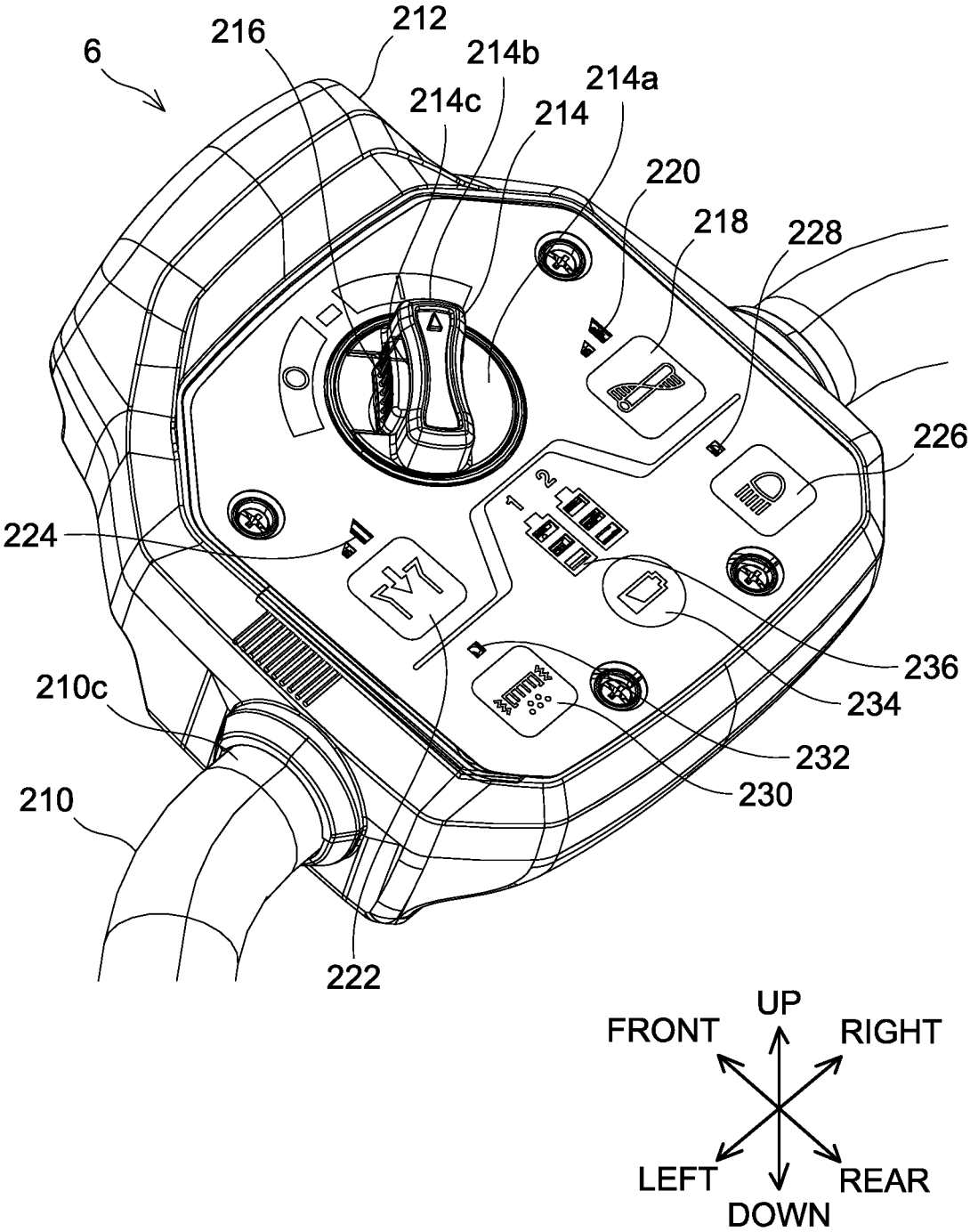
FIG. 32 is a perspective view of a switch operation member 212 of the cleaning machine 2 according to the embodiment, as viewed from the upper left rear side.

A switch operation member 212 is attached to the upper linear portion 210*c* of the handle frame 210. As illustrated in FIG. 32, the switch operation member 212 comprises a main power switch 214, a lock-off button 216, a brush rotational speed switching button 218, a brush rotational speed indicator 220, a fan air volume switching button 222, a fan air volume indicator 224, a lighting button 226, a lighting indicator lamp 228, a dust-off button 230, a dust-off indicator lamp 232, a remaining battery charge button 234, and a remaining battery charge indicator 236.

The main power switch 214 is dial switch configured to rotate between an ON position and an OFF position. At the ON position, the cleaning machine 2 is turned on. At the OFF position, the cleaning machine 2 is turned off. The main power switch 214 comprises a substantially disk-shaped base 214*a* and a substantially cuboid-shaped tab 214*b* projecting from the base 214*a*. As viewed in a direction perpendicular to the base 214*a*, the tab 214*b* comprises a recess 214*c* recessed inward near the center of a longitudinal side of the tab 214*b*. The lock-off button 216 is arranged at the recess 214*c* of the main power switch 214. The lock-off button 216 is supported by the main power switch 214 such that it is movable between a lock position at which the lock-off button 216 is positioned radially outward of the recess 214*c* and an unlock position closer to the tab 214*b* than the lock position is to the tab 214*b*. The lock-off button 216 is biased by a compression spring (not illustrated) toward the lock position from the unlock position. When the lock-off button 216 is at the lock position, the lock-off button 216 restricts the rotation of the main power switch 214 from the OFF position to the ON position. When the lock-off button 216 is at the unlock position, the lock-off button 216 permits the rotation of the main power switch 214 from the OFF position to the ON position. Once the main power switch 214 has been rotated from the OFF position to the ON position, the lock-off button 216 is maintained at the unlock position until the main power switch 214 is rotated from the ON position to the OFF position. This configuration can prevent the cleaning machine 2 from being accidentally turned on due to the user rotating the main power switch 214 from the OFF position to the ON position unintentionally.

The brush rotational speed switching button 218 is a button for changing rotational speed of the front main brush 20, the rear main brush 22, and the side brush 150. In the cleaning machine 2, the rotational speed can be changed among multiple levels (e.g., two levels). The ECU 204 controls the rotational speed of the motor 74, when driving it, according to the rotational speed set by the brush rotational speed switching button 218. The brush rotational speed indicator 220 changes the number of lighted windows according to the rotational speed set by the brush rotational speed switching button 218.

The fan air volume switching button 222 is a button for switching on/off of the electric-powered fan 142 and changing an air volume at the electric-powered fan 142. In the cleaning machine 2, the air volume at the electric-powered fan 142 can be changed among multiple levels (e.g., two levels). The ECU 204 controls the rotational speed of the fan motor 146, when driving it, according to the air volume set by the fan air volume switching button 222. The fan air volume indicator 224 changes the number of lighted windows according to the air volume at the electric-powered fan 142 set by the fan air volume switching button 222.

The lighting button 226 is a button for switching on/off of the headlight 9. The lighting indicator lamp 228 is on when the headlight 9 is on, while it is off when the headlight 9 is off. The dust-off button 230 is a button for switching on/off of the filter motor 132. The dust-off indicator lamp 232 is on when the filter motor 132 is on, while it is off when the filter motor 132 is off. The remaining battery charge button 234 is a button for switching on/off of the remaining battery charge indicator 236. When the remaining battery charge indicator 236 is on, it lights one or more windows according to the remaining battery charge in each battery pack 202, while when the remaining battery charge indicator 236 is off, it does not light any of the windows.

Figure 33:
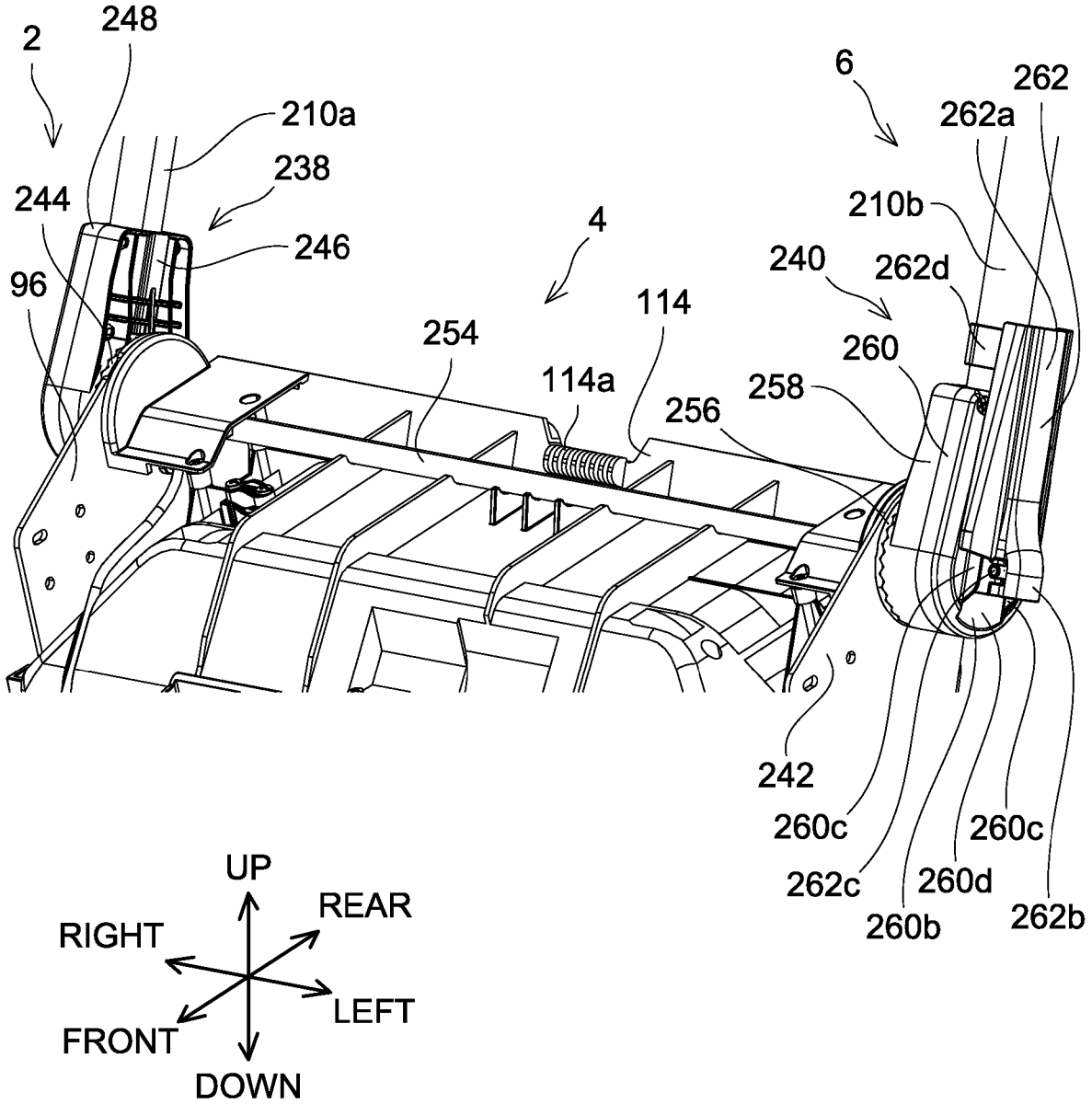
FIG. 33 is a perspective view of a right handle attaching member 238 and a left handle attaching member 240 of the cleaning machine 2 according to the embodiment with a body cover 108 removed, as viewed from the upper left front side.

As illustrated in FIG. 33, a lower end of the right linear portion 210*a* of the handle frame 210 is coupled to the right handle plate 96 of the body unit 4 via a right handle attaching member 238. A lower end of the left linear portion 210*b* of the handle frame 210 is coupled to a left handle plate 242 of the body unit 4 via a left handle attaching member 240. The left handle plate 242 is fixed to the chassis 14.

Figure 34:
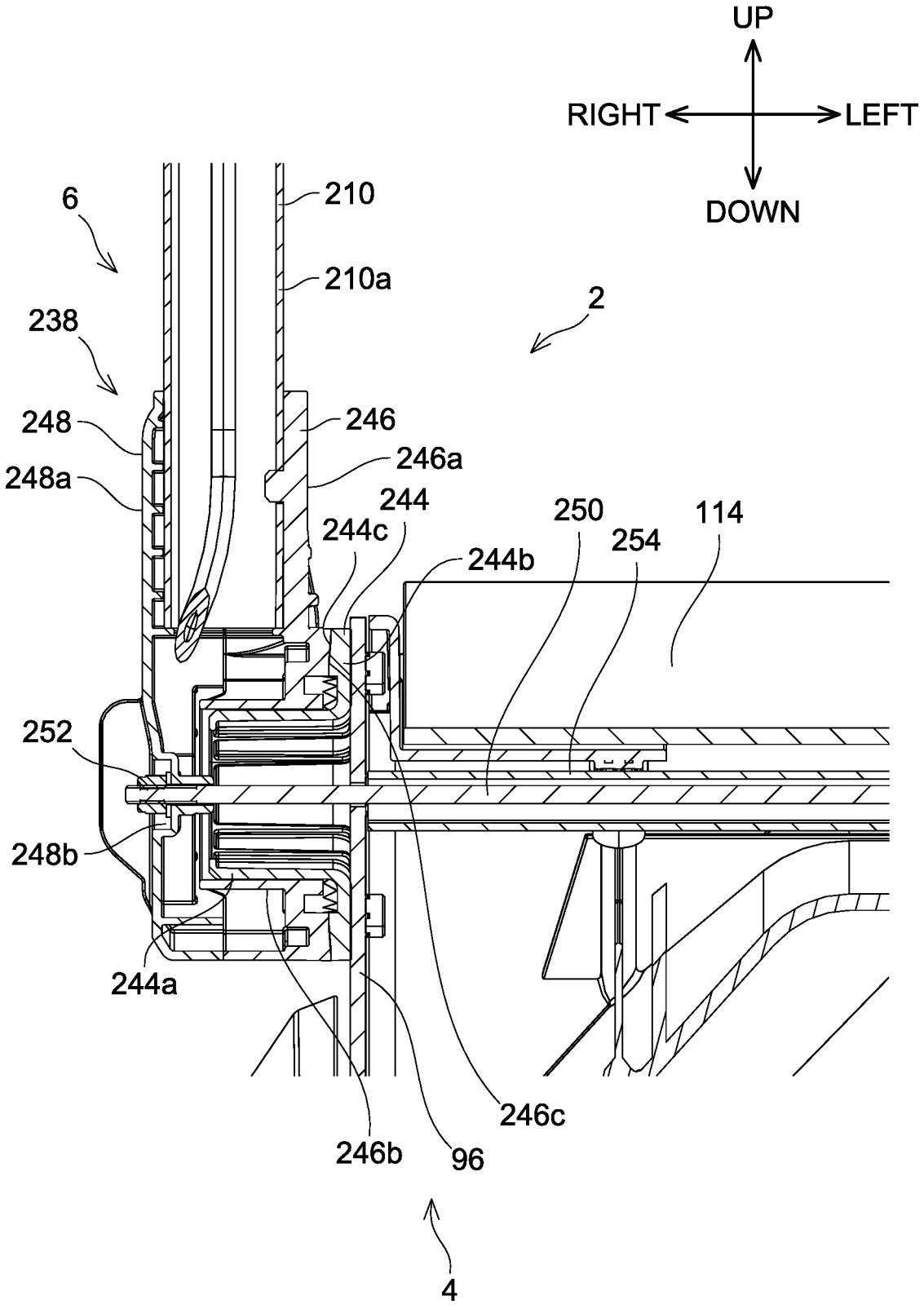
FIG. 34 is a vertical cross-sectional view in the vicinity of the right handle attaching member 238 of the cleaning machine 2 according to the embodiment.

As illustrated in FIG. 34, the right handle attaching member 238 comprises a body-side cam 244, a handle-side cam 246, and a cover 248. The body-side cam 244 is fixed to the right handle plate 96. The body-side cam 244 comprises an inner cylindrical portion 244*a* that has a substantially hollow cylinder shape extending in the left-right direction and a cam portion 244*b* that bends radially outward from a left end of the inner cylindrical portion 244*a*. A teeth surface 244*c* oriented rightward and from which a plurality of teeth projects is arranged on the cam portion 244*b*. The handle-side cam 246 and the cover 248 are fixed to the right linear portion 210*a* of the handle frame 210. The handle-side cam 246 is positioned leftward of the right linear portion 210*a*. The handle-side cam 246 comprises a handle support 246*a* supporting the right linear portion 210*a* and an outer cylindrical portion 246*b* that is connected to a lower end of the handle support 246*a* and has a substantially hollow cylinder shape extending in the left-right direction. The inner diameter of the outer cylindrical portion 246*b* is slightly greater than the outer diameter of the inner cylindrical portion 244*a*. The inner cylindrical portion 244*a* is inserted in the outer cylindrical portion 246*b* from the left. The inner cylindrical portion 244*a* supports the outer cylindrical portion 246*b* such that the outer cylindrical portion 246*b* is rotatable. A teeth surface 246*c* oriented leftward and from which a plurality of teeth projects is arranged on the handle support 246*a*. The teeth surface 246*c* is configured to mesh with the teeth surface 244*c* of the body-side cam 244. The cover 248 is positioned rightward of the right linear portion 210*a*. The cover 248 comprises a handle support 248*a* supporting the right linear portion 210*a* and a shaft support 248*b* supporting a connecting shaft 250. A right end of the connecting shaft 250 is screwed in a nut 252 disposed on an outer side of the shaft support 248*b*. The connecting shaft 250 passes through the inner cylindrical portion 244*a* and penetrates the right handle plate 96. The connecting shaft 250 passes through a connection pipe 254 supported by an upper surface of the duct 114 and extends up to the left handle attaching member 240.

Figure 35:
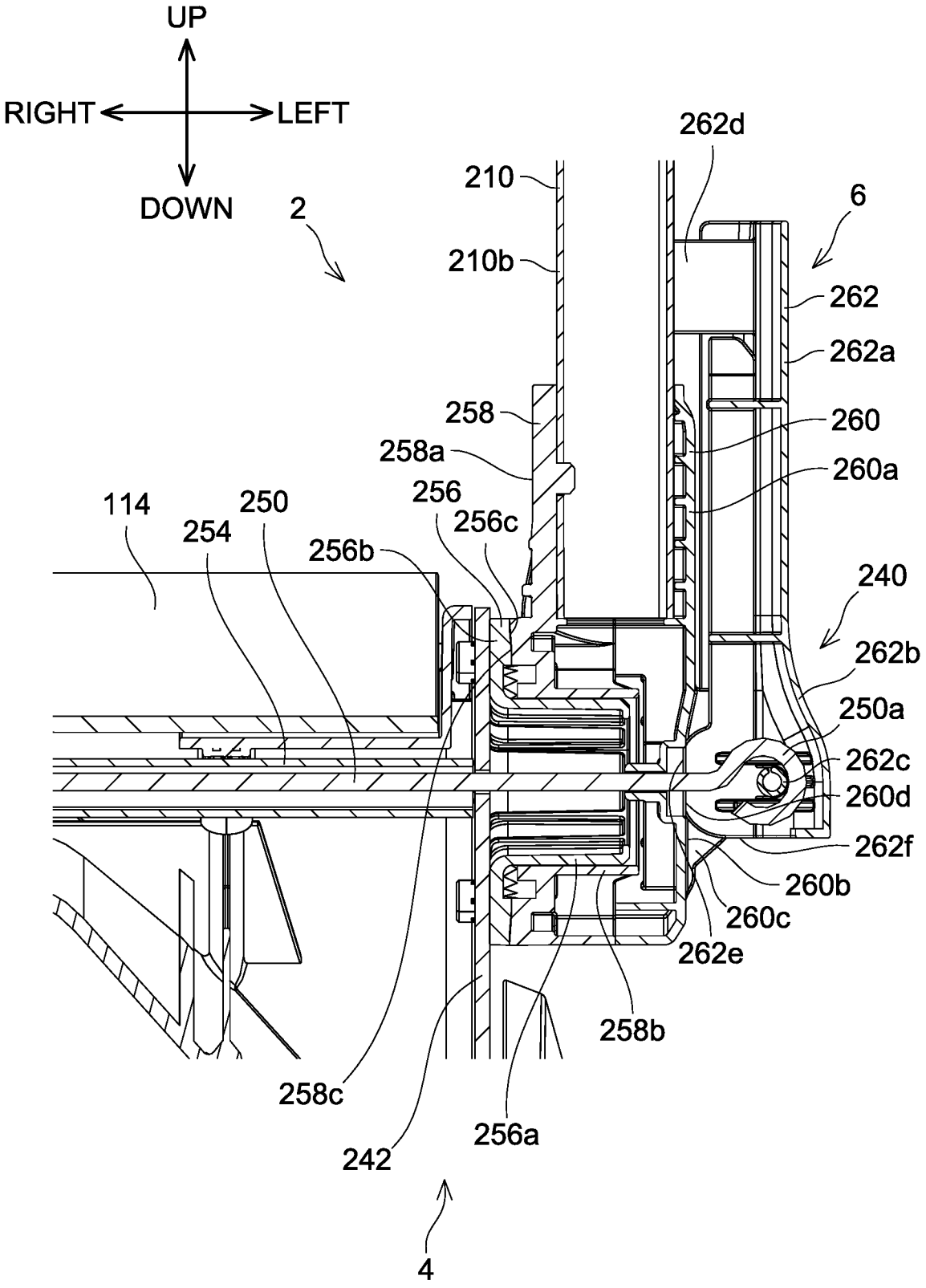
FIG. 35 is a vertical cross-sectional view in the vicinity of the left handle attaching member 240 of the cleaning machine 2 according to the embodiment.

As illustrated in FIG. 35, the left handle attaching member 240 comprises a body-side cam 256, a handle-side cam 258, a cover 260, and a lever 262. The body-side cam 256 is fixed to the left handle plate 242. The body-side cam 256 comprises an inner cylindrical portion 256*a* that has a substantially hollow cylinder shape extending in the left-right direction and a cam portion 256*b* that bends radially outward from a right end of the inner cylindrical portion 256*a*. A teeth surface 256*c* oriented leftward and from which a plurality of teeth projects is arranged on the cam portion 256*b*. The handle-side cam 258 and the cover 260 are fixed to the left linear portion 210*b* of the handle frame 210. The handle-side cam 258 is positioned rightward of the left linear portion 210*b*. The handle-side cam 258 comprises a handle support 258*a* supporting the left linear portion 210*b* and an outer cylindrical portion 258*b* that is connected to a lower end of the handle support 258*a* and has a substantially hollow cylinder shape extending in the left-right direction. The inner diameter of the outer cylindrical portion 258*b* is slightly greater than the outer diameter of the inner cylindrical portion 256*a*. The inner cylindrical portion 256*a* is inserted in the outer cylindrical portion 258*b* from the right. The inner cylindrical portion 256*a* supports the outer cylindrical portion 258*b* such that the outer cylindrical portion 258*b* is rotatable. A teeth surface 258*c* oriented rightward and from which a plurality of teeth projects is arranged on the handle support 258*a*. The teeth surface 258*c* is configured to mesh with the teeth surface 256*c* of the body-side cam 256. The cover 260 is positioned leftward of the left linear portion 210*b*. The cover 260 comprises a handle support 260*a* supporting the left linear portion 210*b* and a lever receiver 260*b* at which the lever 262 is arranged. As illustrated in FIG. 33, the lever receiver 260*b* comprises a pair of guide ribs 260*c* projecting leftward and a cam surface 260*d* that is interposed between the pair of guide ribs 260*c* and oriented leftward. As illustrated in FIG. 35, the connecting shaft 250 penetrates the left handle plate 242 and passes through the inner cylindrical portion 256*a*. A left end of the connecting shaft 250 penetrates the lever receiver 260*b* of the cover 260 and projects to the outside of the cover 260. A ring-shaped engagement portion 250*a* is disposed at the left end of the connecting shaft 250. The lever 262 is positioned leftward of the cover 260. The lever 262 comprises an operation member 262*a* configured to be operated by the user and a shaft support 262*b* connected to a lower end of the operation member 262*a*. The shaft support 262*b* comprises a support pin 262*c* supporting the engagement portion 250*a* of the connecting shaft 250. As illustrated in FIG. 33, the shaft support 262*b* of the lever 262 is interposed between the pair of guide ribs 260*c*. The lever 262 is configured to pivot with respect to the cover 260 about a pivot shaft, which is the support pin 262*c*, in a direction defined by the pair of guide ribs 260*c*. An engagement portion 262*d* configured to engage with the left linear portion 210*b* when the lever 262 is raised to be substantially parallel to the left linear portion 210*b* is arranged on the operation member 262*a*. As illustrated in FIG. 35, the shaft support 262*b* comprises a first cam surface 262*e* configured to contact the cam surface 260*d* of the cover 260 when the lever 262 is raised to be substantially parallel to the left linear portion 210*b* and a second cam surface 262*f* configured to contact the cam surface 260*d* of the cover 260 when the lever 262 is tilted to be away from the left linear portion 210*b*. The distance from the support pin 262*c* to the first cam surface 262*e* is greater than the distance from the support pin 262*c* to the second cam surface 262*f*.

When the lever 262 is raised to be substantially parallel to the left linear portion 210*b*, the support pin 262*c* is pulling the left end of the connecting shaft 250 leftward by the first cam surface 262*e* of the lever 262 contacting the cam surface 260*d* of the cover 260. In this case, the cover 260 is pressed rightward by the lever 262 at the left handle attaching member 240. Thus, the handle-side cam 258 is fixed to the body-side cam 256 with the teeth surface 258*c* meshing with the teeth surface 256*c*. Further, at the right handle attaching member 238 illustrated in FIG. 34, the cover 248 is pressed leftward by the nut 252. Thus, the handle-side cam 246 is fixed to the body-side cam 244 with the teeth surface 246*c* meshing with the teeth surface 244*c*. In this state, an attaching angle of the handle unit 6 with respect to the body unit 4 is fixed.

When the lever 262 is tilted to be away from the left linear portion 210*b* at the left handle attaching member 240 illustrated in FIG. 35, the support pin 262*c* does not pull the connecting shaft 250 no longer by the second cam surface 262*f* of the lever 262 contacting the cam surface 260*d* of the cover 260. In this case, at the left handle attaching member 240, the teeth surface 258*c* and the teeth surface 256*c* are released from each other, and thus the handle-side cam 258 becomes pivotable with respect to the body-side cam 256. Further, at the right handle attaching member 238 illustrated in FIG. 34, the teeth surface 246*c* and the teeth surface 244*c* are released from each other, and thus the handle-side cam 246 becomes pivotable with respect to the body-side cam 244. In this state, the attaching angle of the handle unit 6 with respect to the body unit 4 is freely adjusted. After the adjustment of the attaching angle of the handle unit 6 with respect to the body unit 4 is completed, the attaching angle of the handle unit 6 with respect to the body unit 4 is fixed again by raising the lever 262 to be substantially parallel to the left linear portion 210*b*.

(Battery Cover 264)

Figure 36:
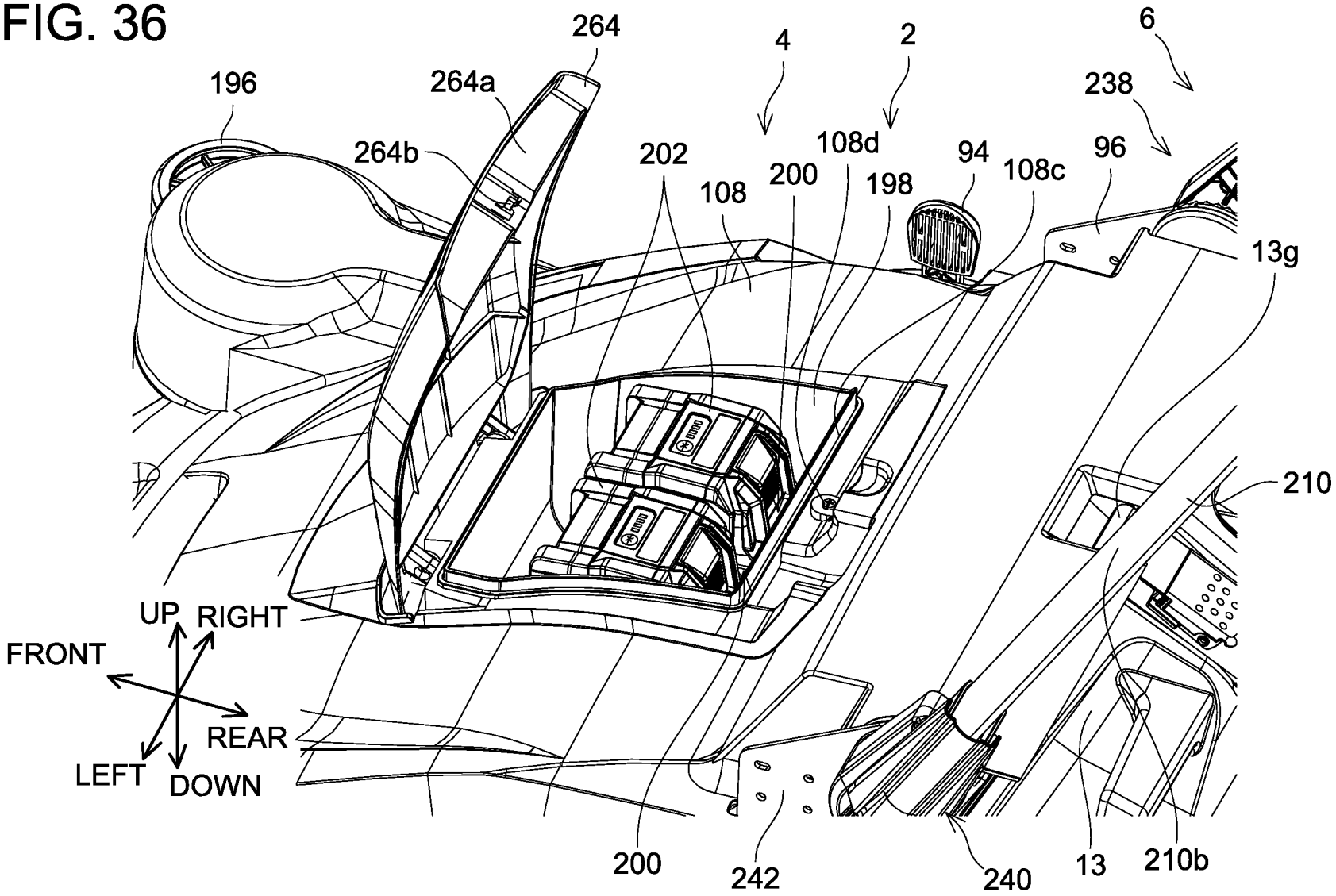
FIG. 36 is a perspective view in the vicinity of a battery box 198 of the cleaning machine 2 according to the embodiment with a battery cover 264 open, as viewed from the upper left rear side.

As illustrated in FIG. 36, a battery opening 108*c* is defined in the body cover 108, corresponding to the battery box 198. A battery cover 264 is disposed at the battery opening 108*c*. The battery cover 264 is supported by the body cover 108 such that it is pivotable about a pivot axis extending in the left-right direction near a front end of the battery cover 264. When the battery cover 264 is open, the battery packs 202 can be attached to or detached from the battery attaching members 200 by being slid in the up-down direction with respect to the battery attaching members 200. When the battery cover 264 is closed, the battery cover 264 covers the entirety of the battery opening 108*c*.

At the battery opening 108*c*, an upper end of the battery box 198 is positioned above an upper surface of the body cover 108. A water blocking rib 264*a* is arranged on an inner surface of the battery cover 264. The water blocking rib 264*a* is shaped to surround the battery box 198 when the battery cover 264 is closed. Further, when the battery cover 264 is closed, a lower end of the water blocking rib 264*a* contacts the upper surface of the body cover 108 below the upper end of the battery box 198. When the battery cover 264 is closed, a labyrinth structure is defined by the water blocking rib 264*a* and the battery box 198, thereby preventing entry of water through the battery cover 264.

A permanent magnet 264*b* is attached to the center of a rear end of the battery cover 264 in the left-right direction. The permanent magnet 264*b* is arranged corresponding to a metal screw 108*d* for fixing the body cover 108 to the chassis 14. When the battery cover 264 is closed, a magnetic force between the permanent magnet 264*b* and the screw 108*d* acts in a direction that brings the battery cover 264 to be closed. This prevents unintentional opening of the battery cover 264. Further, as illustrated in FIG. 3, when the battery cover 264 is closed, the gravity acting on the battery cover 264 acts in the direction that brings the battery cover 264 to be closed. This prevents unintentional opening of the battery cover 264.

Figure 37:
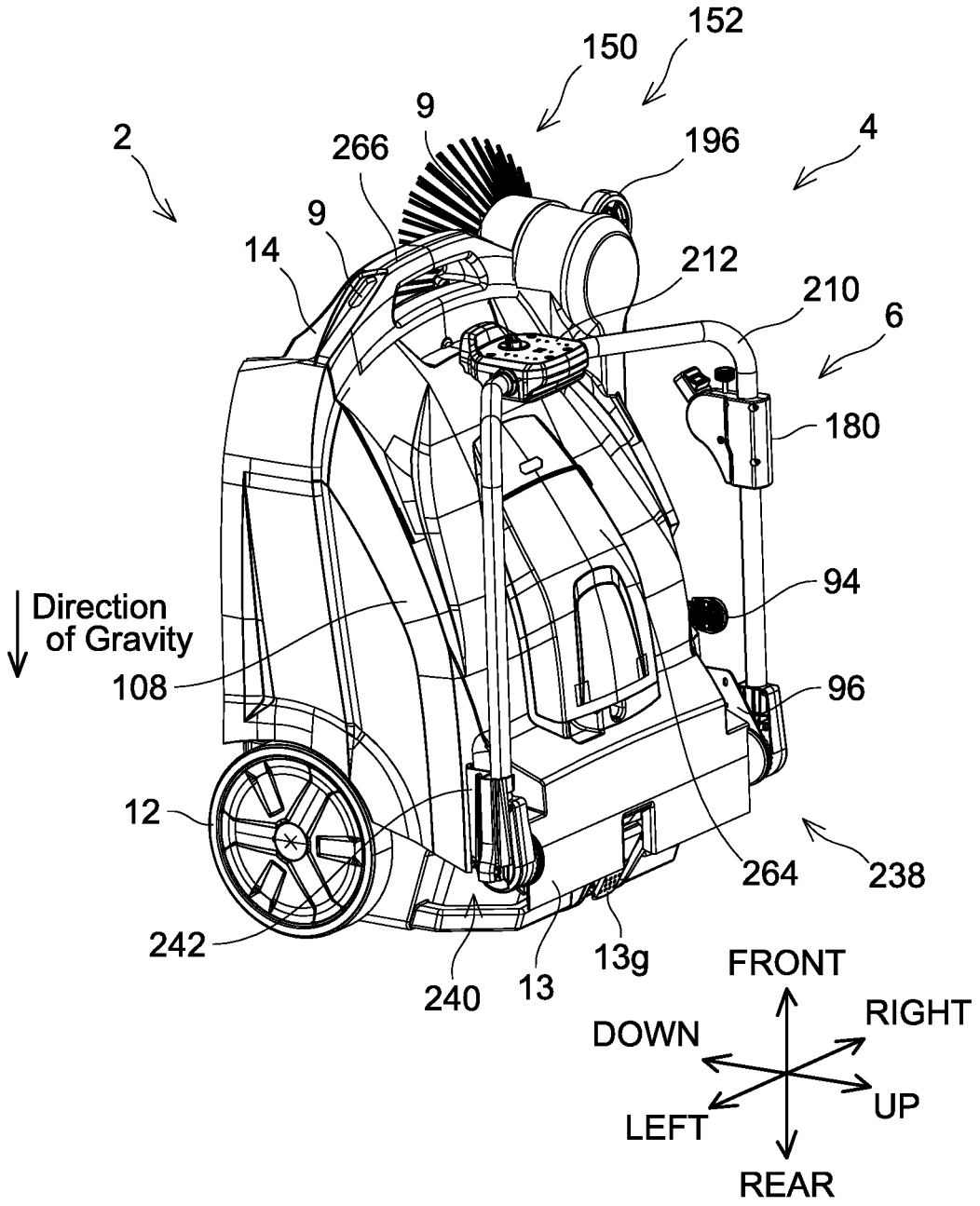
FIG. 37 is a perspective view of the cleaning machine 2 according to the embodiment, with a handle unit 6 folded with respect to a body unit 4, as viewed from the upper right front side.

When the cleaning machine 2 is not in use, it can be stored with the handle unit 6 folded with respect to the body unit 4 and the rear surface of the dust container 13 contacting the working surface, as illustrated in FIG. 37. This configuration can reduce a required space to store the cleaning machine 2. Even when the cleaning machine 2 is placed as illustrated in FIG. 37, the gravity acting on the battery cover 264 acts in the direction that brings the battery cover 264 to be closed. Thus, unintentional opening of the battery cover 264 can be prevented. With the handle unit 6 folded to the body unit 4 as illustrated in FIG. 37, the user can carry the cleaning machine 2 by gripping a grip 266 arranged at a front end of the chassis 14.

(Variants)

In the embodiment above, the cleaning machine 2 comprises the motor 74 and the reducer mechanism 76, and rotates the front main brush 20, the rear main brush 22, and the side brush 150 by rotating the drive shaft 77 by the motor 74. Unlike this, the cleaning machine 2 may not comprise the motor 74 or the reducer mechanism 76. In this case, by providing the cleaning machine 2 with, for example, a rotation transmitting mechanism (not illustrated) that transmits the rotation of the right rear wheel 10 and the left rear wheel 12 to the drive shaft 77, the front main brush 20, the rear main brush 22, and the side brush 150 can rotate using the rotation of the right rear wheel 10 and the left rear wheel 12 when the user moves the cleaning machine 2.

In the embodiment above, the cleaning machine 2 does not comprise a drive source for rotating the right rear wheel 10 and the left rear wheel 12. Unlike this, the cleaning machine 2 may comprise a wheel motor (not illustrated) for rotating the right rear wheel 10 and the left rear wheel 12. In this case, the ECU 204 may control the wheel motor by controlling electrical power to be supplied from the battery packs 202 to the wheel motor. In this case, a button configured to be operated by the user to switch on/off of the wheel motor may be arranged at the switch operation member 212 of the handle unit 6. Alternatively, the cleaning machine 2 may be a self-propelled cleaning machine without the handle unit 6.

In the embodiment above, the cleaning machine 2 comprises the front wheel 8, the right rear wheel 10, and the left rear wheel 12 and is pushed forward from behind by the user gripping the handle unit 6, that is, the cleaning machine 2 is a so-called sweeper-type cleaning machine. The cleaning machine 2 may be a scrubber, a polisher, or the like. Alternatively, the cleaning machine 2 may be a dust collector, a robotic cleaner, or the like that does not comprise the handle unit 6. Alternatively, the cleaning machine 2 may be a handheld cleaning machine that does not comprise the front wheel 8, the right rear wheel 10, nor the left rear wheel 12, such as a handheld cleaner, a mop, etc.

In the embodiment above, the pivot axis for the pivot of the main brush supporting member 63 with respect to the chassis 14 substantially coincides with the rotation axis for the rotation of the front main brush 20 with respect to the chassis 14, and only the rear main brush 22 moves in the up-down direction with respect to the chassis 14 according to the operation on the main brush lifting lever 94. Unlike this, the pivot axis for the pivot of the main brush supporting member 63 with respect to the chassis 14 may be at a different position from the position of the rotation axis for the rotation of the front main brush 20 with respect to the chassis 14, and both the front main brush 20 and the rear main brush 22 may move in the up-down direction with respect to the chassis 14 according to the operation on the main brush lifting lever 94.

The front main brush 20, the rear main brush 22, and/or the side brush 150 may be brush(es) of different type(s) than those described in the embodiment above.

As described, in one or more embodiments, the cleaning machine 2 comprises the rear main brush 22 (an example of the first brush) comprising the brush shaft 28*a* (an example of the first brush shaft) extending in the left-right direction and the brush bristles 28*b* (an example of the first brush body) held by the brush shaft 28*a*, the front main brush 20 (an example of the second brush) comprising the brush shaft 24*a* (an example of the second brush shaft) extending in the left-right direction and the brush bristles 24*b* (an example of the second brush body) held by the brush shaft 24*a*, the main brush supporting member 63 (an example of the brush supporting member) supporting each of the front main brush 20 and the rear main brush 22 such that the front main brush 20 and the rear main brush 22 are rotatable, the body unit 4 (an example of the body) supporting the main brush supporting member 63 such that the main brush supporting member 63 is pivotable, and the main brush pivot mechanism 95 (an example of the pivot mechanism) configured to pivot the main brush supporting member 63 with respect to the body unit 4. At least the rear main brush 22 moves in the up-down direction with respect to the body unit 4 when the main brush supporting member 63 pivots with respect to the body unit 4.

According to the configuration above, at least the rear main brush 22 can be moved in the up-down direction without changing the distance between the front main brush 20 and the rear main brush 22.

In one or more embodiments, the front main brush 20 and the rear main brush 22 are arranged along the front-rear direction.

According to the configuration above, in the cleaning machine 2 in which the front main brush 20 and the rear main brush 22 are arranged along the front-rear direction, at least the rear main brush 22 can be moved in the up-down direction without changing the distance between the front main brush 20 and the rear main brush 22.

In one or more embodiments, the pivot axis of the main brush supporting member 63 and the rotation axis of the front main brush 20 are substantially coaxial.

According to the configuration above, the rear main brush 22 can be moved in the up-down direction without moving the front main brush 20 in the up-down direction.

In one or more embodiments, the main brush supporting member 63 comprises the right brush plate 60 (an example of the first brush supporting member) supporting one end of the front main brush 20 and one end of the rear main brush 22 such that the front main brush 20 and the rear main brush 22 are rotatable; and the left brush plate 62 (an example of the second brush supporting member) supporting the other end of the front main brush 20 and the other end of the rear main brush 22 such that the front main brush 20 and the rear main brush 22 are rotatable.

According to the configuration above, each of the front main brush 20 and the rear main brush 22 can be rotatably supported at its opposing ends. The front main brush 20 and the rear main brush 22 can be supported stably.

In one or more embodiments, the main brush supporting member 63 further comprises the link member 64 (an example of the coupling member) that couples the right brush plate 60 with the left brush plate 62.

According to the configuration above, it is possible to make a pivot angle of the right brush plate 60 with respect to the body unit 4 substantially equal to a pivot angle of the left brush plate 62 with respect to the body unit 4. At least the rear main brush 22 can be moved stably in the up-down direction.

In one or more embodiments, the main brush pivot mechanism 95 is configured to pivot the right brush plate 60 with respect to the body unit 4.

According to the configuration above, the right brush plate 60 and the left brush plate 62 can be pivoted with respect to the body unit 4 by using the main brush pivot mechanism 95 with a simple configuration.

In one or more embodiments, the cleaning machine 2 further comprises the motor 74 for brush (an example of the motor) for rotating the front main brush 20 and the rear main brush 22. The motor 74 is supported by the main brush supporting member 63.

According to the configuration above, positional relationships between the front main brush 20 and the motor 74 and between the rear main brush 22 and the motor 74 do not change even when the main brush supporting member 63 is pivoted with respect to the body unit 4, which allows for simplification in a mechanism for transmitting rotation from the motor 74 to the front main brush 20 and a mechanism for transmitting rotation from the motor 74 to the rear main brush 22.

In one or more embodiments, the cleaning machine 2 further comprises the main brush operation member 97 (an example of the brush operation member) coupled to the main brush pivot mechanism 95 and configured to receive an operation related to a movement of at least the rear main brush 22 in the up-down direction from the user.

According to the configuration above, the user can cause at least the rear main brush 22 to move in the up-down direction by operating the main brush operation member 97.

In one or more embodiments, the main brush operation member 97 is disposed closer to the user than the front main brush 20 and the rear main brush 22 are to the user when viewed from the user.

According to the configuration above, the user can operate the main brush operation member 97 more easily.

In one or more embodiments, the main brush operation member 97 comprises the right handle plate 96 (an example of the lever supporting member) and the main brush lifting lever 94 (an example of the operation lever) pivotably supported by the right handle plate 96.

According to the configuration above, the user can cause at least the rear main brush 22 to move in the up-down direction simply by pivoting the main brush lifting lever 94.

In one or more embodiments, the body unit 4 comprises the body cover 108 (an example of the housing). The main brush lifting lever 94 projects to the outside through the lever opening 108*a* (an example of the opening) of the body cover 108. The cleaning machine 2 further comprises the shutter member 110 attached to the main brush lifting lever 94 inside the body cover 108 and configured to cover the lever opening 108*a* of the body cover 108.

According to the configuration above, it is possible to prevent the user from seeing the inside of the body unit 4 through the lever opening 108*a* of the body cover 108. Further, it is possible to prevent entry of foreign matters into the body unit 4 through the lever opening 108*a* of the body cover 108.

In one or more embodiments, the main brush operation member 97 further comprises the positioning pin 100 (an example of the engagement portion) disposed on the main brush lifting lever 94 and the plurality of positioning holes 96*a* (an example of the plurality of engageable portions) disposed in the right handle plate 96 and configured to engage with the positioning pin 100.

According to the configuration above, a pivot angle of the main brush lifting lever 94 with respect to the right handle plate 96 can be changed among multiple different angles, and thus the position of at least the rear main brush 22 in the up-down direction with respect to the body unit 4 can be changed among multiple different positions.

In one or more embodiments, the rear main brush 22 moves downward with respect to the body unit 4 when the user tilts the main brush lifting lever 94. The rear main brush 22 moves upward with respect to the body unit 4 when the user raises the main brush lifting lever 94.

According to the configuration above, the user can intuitively understand how at least the rear main brush 22 moves in the up-down direction in response to the operation on the main brush lifting lever 94.

In one or more embodiments, the body unit 4 comprises the front wheel 8, the right rear wheel 10, and the left rear wheel 12 (an example of the wheel) and the chassis 14 supported by the front wheel 8, the right rear wheel 10, and the left rear wheel 12.

According to the configuration above, at least the rear main brush 22 can be moved in the up-down direction without changing the distance between the front main brush 20 and the rear main brush 22 in the cleaning machine 2 configured to clean the working plane positioned below the cleaning machine 2.

In one or more embodiments, the cleaning machine 2 further comprises the handle unit 6 (an example of the handle) extending rearward and upward from the chassis 14 and configured to be gripped by the user.

According to the configuration above, at least the rear main brush 22 can be moved in the up-down direction without changing the distance between the front main brush 20 and the rear main brush 22 in the cleaning machine 2 operated by the user gripping the handle unit 6.

What is claimed is:

1. A cleaning machine comprising:

a first brush comprising a first brush shaft extending in a left-right direction and a first brush body held by the first brush shaft;

a second brush comprising a second brush shaft extending in the left-right direction and a second brush body held by the second brush shaft;

a brush supporting member supporting each of the first brush and the second brush such that the first brush and the second brush are rotatable; and a body pivotally supporting the brush supporting member, wherein the first brush, the body and the brush supporting member are configured such that at least the first brush moves in an up-down direction with respect to the body when the brush supporting member pivots with respect to the body, and a pivot axis of the brush supporting member and a rotation axis of the second brush are substantially coaxial.

2. The cleaning machine according to claim 1, further comprising a motor configured to rotate the first brush and the second brush, wherein the motor is supported by the brush supporting member.

3. The cleaning machine according to claim 1, wherein the first brush and the second brush are arranged along a front-rear direction.

4. The cleaning machine according to claim 3, wherein the brush supporting member comprises:

a first brush supporting member supporting one end of the first brush and one end of the second brush such that the first brush and the second brush are rotatable;

a second brush supporting member supporting other end of the first brush and other end of the second brush such that the first brush and the second brush are rotatable; and a coupling member that couples the first brush supporting member with the second brush supporting member, the first brush supporting member is pivotally connected to the body by a pivot mechanism, the cleaning machine further comprises a motor configured to rotate the first brush and the second brush, the motor is supported by the brush supporting member, the cleaning machine further comprises a brush operation member configured to receive an operation from a user related to pivoting of the brush supporting member to move at least the first brush in the up-down direction, the brush operation member is closer to the user than the first brush and the second brush when viewed from the user, the brush operation member comprises:

a lever supporting member; and an operation lever pivotably supported by the lever supporting member, the body comprises a housing, the operation lever projects to outside through an opening of the housing, the cleaning machine further comprises a shutter member attached to the operation lever inside the housing and configured to cover the opening of the housing, the brush operation member further comprises:

an engagement portion on the operation lever; and a plurality of engageable portions on the lever supporting member and configured to engage with the engagement portion, the first brush, the body and the operation lever are configured such that:

the first brush moves downward with respect to the body when the user tilts the operation lever; and the first brush moves upward with respect to the body when the user raises the operation lever, the body comprises:

a wheel; and a chassis supported by the wheel, and the cleaning machine further comprises a handle extending rearward and upward from the chassis and configured to be gripped by the user.

5. The cleaning machine according to claim 1, wherein the brush supporting member comprises:

a first brush supporting member supporting one end of the first brush and one end of the second brush such that the first brush and the second brush are rotatable; and a second brush supporting member supporting other end of the first brush and other end of the second brush such that the first brush and the second brush are rotatable.

6. The cleaning machine according to claim 5, wherein the brush supporting member further comprises a coupling member that couples the first brush supporting member with the second brush supporting member.

7. The cleaning machine according to claim 6, wherein the first brush supporting member is pivotably connected to the body by a pivot mechanism.

8. The cleaning machine according to claim 1, further comprising a brush operation member configured to receive an operation from a user related to pivoting of the brush supporting member to move at least the first brush in the up-down direction.

9. The cleaning machine according to claim 8, wherein the brush operation member is closer to the user than the first brush and the second brush when viewed from the user.

10. The cleaning machine according to claim 8, wherein the brush operation member comprises:

a lever supporting member; and an operation lever pivotably supported by the lever supporting member.

11. The cleaning machine according to claim 10, wherein the body comprises a housing, the operation lever projects outside through an opening of the housing, and the cleaning machine further comprises a shutter member attached to the operation lever inside the housing and configured to cover the opening of the housing.

12. The cleaning machine according to claim 10, wherein the brush operation member further comprises:

an engagement portion on the operation lever; and a plurality of engageable portions on the lever supporting member and configured to engage with the engagement portion.

13. The cleaning machine according to claim 10, wherein the first brush, the body and the operation lever are configured such that the first brush moves downward with respect to the body when the user tilts the operation lever, and the first brush moves upward with respect to the body when the user raises the operation lever.

14. The cleaning machine according to claim 1, wherein the body comprises:

a wheel; and a chassis supported by the wheel.

15. The cleaning machine according to claim 14, further comprising a handle extending rearward and upward from the chassis and configured to be gripped by a user.

16. A cleaning machine comprising:

a first brush comprising a first brush shaft extending in a left-right direction and a first brush body held by the first brush shaft;

a second brush comprising a second brush shaft extending in the left-right direction and a second brush body held by the second brush shaft;

a brush supporting member supporting each of the first brush and the second brush such that the first brush and the second brush are rotatable;

a body pivotally supporting the brush supporting member; and a motor configured to rotate the first brush and the second brush, wherein the first brush, the body and the brush supporting member are configured such that at least the first brush moves in an up-down direction with respect to the body when the brush supporting member pivots with respect to the body, and the motor is supported by the brush supporting member.

17. A cleaning machine comprising:

a first brush comprising a first brush shaft extending in a left-right direction and a first brush body held by the first brush shaft;

a second brush comprising a second brush shaft extending in the left-right direction and a second brush body held by the second brush shaft;

a brush supporting member supporting each of the first brush and the second brush such that the first brush and the second brush are rotatable; and a body pivotally supporting the brush supporting member, wherein the first brush, the body and the brush supporting member are configured such that at least the first brush moves in an up-down direction with respect to the body when the brush supporting member pivots with respect to the body, the first brush and the second brush are arranged along a front-rear direction, a pivot axis of the brush supporting member and a rotation axis of the second brush are substantially coaxial, the brush supporting member comprises:

a first brush supporting member supporting one end of the first brush and one end of the second brush such that the first brush and the second brush are rotatable;

a second brush supporting member supporting other end of the first brush and other end of the second brush such that the first brush and the second brush are rotatable; and a coupling member that couples the first brush supporting member with the second brush supporting member, the first brush supporting member is pivotally connected to the body by a pivot mechanism, the cleaning machine further comprises a motor configured to rotate the first brush and the second brush, the motor is supported by the brush supporting member, the cleaning machine further comprises a brush operation member coupled to the pivot mechanism and configured to receive an operation related to a movement of at least the first brush in the up-down direction from a user, the brush operation member is closer to the user than the first brush and the second brush when viewed from the user, the brush operation member comprises:

a lever supporting member; and an operation lever pivotably supported by the lever supporting member, the body comprises a housing, the operation lever projects to outside through an opening of the housing, the cleaning machine further comprises a shutter member attached to the operation lever inside the housing and configured to cover the opening of the housing, the brush operation member further comprises:

an engagement portion on the operation lever; and a plurality of engageable portions on the lever supporting member and configured to engage with the engagement portion, the first brush, the body and the operation lever are configured such that:

the first brush moves downward with respect to the body when the user tilts the operation lever; and the first brush moves upward with respect to the body when the user raises the operation lever, the body comprises:

a wheel; and a chassis supported by the wheel, and the cleaning machine further comprises a handle extending rearward and upward from the chassis and configured to be gripped by the user.

* * * * *